US010544905B2

(12) United States Patent
Jiang et al.

(10) Patent No.: US 10,544,905 B2
(45) Date of Patent: Jan. 28, 2020

(54) LED BULB LAMP

(71) Applicant: ZHEJIANG SUPER LIGHTING ELECTRIC APPLIANCE CO., LTD., Zhejiang (CN)

(72) Inventors: Tao Jiang, Zhejiang (CN); Yi-Ching Chen, Hsinchu County (TW)

(73) Assignee: ZHEJIANG SUPER LIGHTING ELECTRIC APPLIANCE CO., LTD., Zhejiang (CN)

( * ) Notice: Subject to any disclaimer, the term of this patent is extended or adjusted under 35 U.S.C. 154(b) by 56 days.

(21) Appl. No.: 15/858,036

(22) Filed: Dec. 29, 2017

(65) Prior Publication Data

US 2018/0119892 A1 May 3, 2018

Related U.S. Application Data

(63) Continuation-in-part of application No. 29/627,379, filed on Nov. 27, 2017, and a continuation-in-part of (Continued)

(30) Foreign Application Priority Data

Sep. 28, 2014 (CN) ..... 2014 1 0510593
Feb. 2, 2015 (CN) ..... 2015 1 0053077
(Continued)

(51) Int. Cl.
*F21K 9/232* (2016.01)
*H05B 33/08* (2006.01)

(52) U.S. Cl.
CPC ..... *F21K 9/232* (2016.08); *H05B 33/0806* (2013.01)

(58) Field of Classification Search
CPC ..... F21K 9/232; F21K 9/238
See application file for complete search history.

(56) References Cited

U.S. PATENT DOCUMENTS 8,455,895 B2 6/2013 Chai et al.
8,933,619 B1 1/2015 Ou
(Continued)

FOREIGN PATENT DOCUMENTS

CN 201448620 U 5/2010
CN 101826588 A 9/2010
(Continued)

*Primary Examiner* — William N Harris
(74) *Attorney, Agent, or Firm* — Andrew M. Calderon; Roberts Mlotkowski Safran Cole & Calderon, P.C.

(57) ABSTRACT

An LED light bulb includes a bulb shell, a bulb base, two conductive supports, a stem, and an LED filament. The bulb base is connected with the bulb shell. The two conductive supports are disposed in the bulb shell. The stem extends from the bulb base to inside of the bulb shell. The LED filament includes a plurality of LED chips and two conductive electrodes. The LED chips are arranged in an array along an elongated direction of the LED filament. The two conductive electrodes are respectively disposed at two ends of the LED filament and connected to the LED chips. The two conductive electrodes are respectively connected to the two conductive supports. The LED filament is curled to satisfy symmetry characteristics. Brightness presented by portions of the LED filament in different quadrants in a top view or in a side view is in line symmetry or in point symmetry.

45 Claims, 87 Drawing Sheets

Related U.S. Application Data application No. 15/723,297, filed on Oct. 3, 2017, and a continuation-in-part of application No. 29/619,287, filed on Sep. 28, 2017, which is a continuation-in-part of application No. 15/499,143, filed on Apr. 27, 2017, now Pat. No. 10,240,724, which is a continuation-in-part of application No. 15/384,311, filed on Dec. 19, 2016, which is a continuation-in-part of application No. 15/366,535, filed on Dec. 1, 2016, which is a continuation-in-part of application No. 15/308,995, filed on Nov. 4, 2016, which is a continuation-in-part of application No. 15/237,983, filed on Aug. 16, 2016, now Pat. No. 10,228,093, which is a continuation-in-part of application No. 15/168,541, filed on May 31, 2016, now Pat. No. 9,995,474, which is a continuation-in-part of application No. PCT/CN2015/090815, filed on Sep. 25, 2015.

(30) Foreign Application Priority Data

| | | |
|---|---|---|
| Jun. 10, 2015 | (CN) | 2015 1 0316656 |
| Jun. 19, 2015 | (CN) | 2015 1 0347410 |
| Aug. 7, 2015 | (CN) | 2015 1 0489363 |
| Aug. 17, 2015 | (CN) | 2015 1 0502630 |
| Sep. 2, 2015 | (CN) | 2015 1 0555889 |
| Dec. 19, 2015 | (CN) | 2015 1 0966906 |
| Jan. 22, 2016 | (CN) | 2016 1 0041667 |
| Apr. 27, 2016 | (CN) | 2016 1 0272153 |
| Apr. 29, 2016 | (CN) | 2016 1 0281600 |
| Jun. 3, 2016 | (CN) | 2016 1 0394610 |
| Jul. 7, 2016 | (CN) | 2016 1 0544049 |
| Jul. 22, 2016 | (CN) | 2016 1 0586388 |
| Nov. 1, 2016 | (CN) | 2016 1 0936171 |
| Dec. 6, 2016 | (CN) | 2016 1 1108722 |
| Jan. 13, 2017 | (CN) | 2017 1 0024877 |
| Feb. 14, 2017 | (CN) | 2017 1 0079423 |
| Mar. 9, 2017 | (CN) | 2017 1 0138009 |
| Mar. 23, 2017 | (CN) | 2017 1 0180574 |
| Apr. 11, 2017 | (CN) | 2017 1 0234618 |
| May 8, 2017 | (CN) | 2017 1 0316641 |
| Sep. 18, 2017 | (CN) | 2017 1 0839083 |
| Sep. 21, 2017 | (CN) | 2017 3 0450712 |
| Sep. 22, 2017 | (CN) | 2017 3 0453237 |
| Sep. 22, 2017 | (CN) | 2017 3 0453239 |
| Sep. 26, 2017 | (CN) | 2017 1 0883625 |
| Oct. 16, 2017 | (CN) | 2017 3 0489929 |
| Oct. 27, 2017 | (CN) | 2017 3 0517887 |
| Oct. 30, 2017 | (CN) | 2017 3 0520672 |
| Nov. 3, 2017 | (CN) | 2017 3 0537542 |
| Nov. 3, 2017 | (CN) | 2017 3 0537544 |
| Dec. 26, 2017 | (CN) | 2017 1 1434993 |

(56) References Cited

U.S. PATENT DOCUMENTS

| | | | | |
|---|---|---|---|---|
| 9,016,900 | B2 | 4/2015 | Takeuchi et al. | |
| 9,488,767 | B2 * | 11/2016 | Nava | F21K 9/232 |
| 9,761,765 | B2 | 9/2017 | Basin et al. | |
| 9,982,854 | B2 | 5/2018 | Ma et al. | |
| 2004/0008525 | A1 | 1/2004 | Shibata | |
| 2009/0184618 | A1 * | 7/2009 | Hakata | H01L 25/0753 313/1 |
| 2013/0058080 | A1 | 3/2013 | Ge et al. | |
| 2013/0058580 | A1 | 3/2013 | Ge et al. | |
| 2013/0147348 | A1 | 6/2013 | Motoya et al. | |
| 2013/0235592 | A1 | 9/2013 | Takeuchi et al. | |
| 2013/0265796 | A1 * | 10/2013 | Kwisthout | F21K 9/232 362/555 |
| 2013/0293098 | A1 | 11/2013 | Li et al. | |
| 2014/0268779 | A1 | 9/2014 | Sorensen et al. | |
| 2014/0369036 | A1 | 12/2014 | Feng | |
| 2015/0069442 | A1 | 3/2015 | Liu et al. | |
| 2015/0070871 | A1 | 3/2015 | Chen et al. | |
| 2015/0211723 | A1 | 7/2015 | Athalye | |
| 2015/0255440 | A1 | 9/2015 | Hsieh | |
| 2016/0223180 | A1 | 8/2016 | Jiang | |
| 2016/0223182 | A1 | 8/2016 | Jiang | |
| 2016/0238199 | A1 | 8/2016 | Yeung et al. | |
| 2016/0363267 | A1 | 12/2016 | Jiang et al. | |
| 2016/0377237 | A1 * | 12/2016 | Zhang | F21K 9/232 362/311.02 |
| 2017/0012177 | A1 | 1/2017 | Trottier | |
| 2017/0016582 | A1 | 1/2017 | Yang et al. | |
| 2017/0051878 | A1 | 2/2017 | Jiang et al. | |
| 2017/0074462 | A1 | 3/2017 | Jiang et al. | |
| 2017/0084809 | A1 | 3/2017 | Jiang et al. | |
| 2017/0130906 | A1 | 5/2017 | Jiang et al. | |
| 2017/0167663 | A1 * | 6/2017 | Hsiao | F21K 9/232 |

FOREIGN PATENT DOCUMENTS

| | | | |
|---|---|---|---|
| CN | 101834263 | | 9/2010 |
| CN | 102121576 | A | 7/2011 |
| CN | 102364710 | | 2/2012 |
| CN | 202252991 | | 5/2012 |
| CN | 202252991 | U | 5/2012 |
| CN | 102751274 | | 10/2012 |
| CN | 102751274 | A | 10/2012 |
| CN | 202719450 | U | 2/2013 |
| CN | 101968181 | B | 3/2013 |
| CN | 103123949 | | 5/2013 |
| CN | 103123949 | A | 5/2013 |
| CN | 203367275 | | 12/2013 |
| CN | 203367275 | U | 12/2013 |
| CN | 103560128 | | 2/2014 |
| CN | 103560128 | A | 2/2014 |
| CN | 103682042 | A | 3/2014 |
| CN | 103890481 | A | 6/2014 |
| CN | 203628391 | | 6/2014 |
| CN | 203628391 | U | 6/2014 |
| CN | 203656627 | U | 6/2014 |
| CN | 103939758 | | 7/2014 |
| CN | 103939758 | A | 7/2014 |
| CN | 103956421 | A | 7/2014 |
| CN | 103972364 | | 8/2014 |
| CN | 103972364 | A | 8/2014 |
| CN | 103994349 | | 8/2014 |
| CN | 103994349 | A | 8/2014 |
| CN | 203857313 | U | 10/2014 |
| CN | 203880468 | | 10/2014 |
| CN | 204062539 | U | 12/2014 |
| CN | 104295945 | A | 1/2015 |
| CN | 104319345 | | 1/2015 |
| CN | 104319345 | A | 1/2015 |
| CN | 204083941 | | 1/2015 |
| CN | 204083941 | U | 1/2015 |
| CN | 104456165 | | 3/2015 |
| CN | 104456165 | A | 3/2015 |
| CN | 204289439 | | 4/2015 |
| CN | 204289439 | U | 4/2015 |
| CN | 104600174 | | 5/2015 |
| CN | 104600174 | A | 5/2015 |
| CN | 104600181 | A | 5/2015 |
| CN | 204328550 | U | 5/2015 |
| CN | 204387765 | | 6/2015 |
| CN | 204387765 | U | 6/2015 |
| CN | 104913217 | A | 9/2015 |
| CN | 204678100 | | 9/2015 |
| CN | 105042354 | A | 11/2015 |
| CN | 105090789 | A | 11/2015 |
| CN | 105098032 | A | 11/2015 |
| CN | 105140381 | | 12/2015 |
| CN | 105140381 | A | 12/2015 |
| CN | 105161608 | | 12/2015 |
| CN | 105161608 | A | 12/2015 |

(56) References Cited

FOREIGN PATENT DOCUMENTS

| | | | |
|---|---|---|---|
| CN | 105371243 | | 3/2016 |
| CN | 105371243 | A | 3/2016 |
| CN | 105609621 | | 5/2016 |
| CN | 105609621 | A | 5/2016 |
| CN | 106468405 | A | 3/2017 |
| CN | 106898681 | A | 6/2017 |
| CN | 107123641 | A | 9/2017 |
| CN | 107170733 | A | 9/2017 |
| CN | 206563190 | U | 10/2017 |
| CN | 107314258 | A | 11/2017 |
| CN | 206973307 | U | 2/2018 |
| CN | 207034659 | U | 2/2018 |
| CN | 108039402 | A | 5/2018 |
| CN | 105090782 | B | 7/2018 |
| CN | 207849021 | U | 9/2018 |
| EP | 2535640 | A1 | 12/2012 |
| EP | 2567145 | A1 | 3/2013 |
| EP | 2760057 | | 7/2014 |
| EP | 2760057 | A1 | 7/2014 |
| GB | 2547085 | A | 8/2017 |
| JP | 3075689 | | 2/2001 |
| JP | 3075689 | U | 2/2001 |
| JP | 2001126510 | A | 5/2001 |
| JP | 2003037239 | A | 2/2003 |
| JP | 2013225587 | A | 10/2013 |
| WO | 2011137662 | | 11/2011 |
| WO | 2014012346 | A1 | 1/2014 |
| WO | 2014167458 | | 10/2014 |
| WO | 2014167458 | A1 | 10/2014 |
| WO | 2017037010 | | 3/2017 |
| WO | 2017037010 | A1 | 3/2017 |

* cited by examiner

LED BULB LAMP

CROSS-REFERENCE TO RELATED APPLICATIONS

This application is a continuation-in-part application of U.S. application Ser. No. 15/499,143 filed on 2017 Apr. 27, which claims priority to Chinese Patent Applications No. 201510502630.3 filed on 2015 Aug. 17; No. 201510966906.3 filed on 2015 Dec. 19; No. 201610041667.5 filed on 2016 Jan. 22; No. 201610272153.0 filed on 2016 Apr. 27; No. 201610394610.3 filed on 2016 Jun. 3; No. 201610586388.7 filed on 2016 Jul. 22; No. 201610544049.2 filed on 2016 Jul. 7; No. 201610936171.4 filed on 2016 Nov. 1; No. 201611108722.4 filed on 2016 Dec. 6; No. 201610281600.9 filed on 2016 Apr. 29; No. 201710024877.8 filed on 2017 Jan. 13; No. 201710079423.0 filed on 2017 Feb. 14; No. 201710138009.2 filed on 2017 Mar. 9; No. 201710180574.5 filed on 2017 Mar. 23; and No. 201710234618.8 filed on 2017 Apr. 11, each of which is incorporated herein by reference in its entirety.

This application is a continuation-in-part application of U.S. application Ser. No. 15/723,297 filed on 2017 Oct. 3, which claims priority to Chinese Patent Applications No. 201410510593.6 filed on 2014 Sep. 28; No. 201510053077.X filed on 2015 Feb. 2; No. 201510489363.0 filed on 2015 Aug. 7; No. 201510555889.4 filed on 2015 Sep. 2; No. 201710316641.1 filed on 2017 May 8; No. 201710839083.7 filed on 2017 Sep. 18; and No. 201710883625.0 filed on 2017 Sep. 26, which is hereby incorporated by reference in their entirety.

This application is a continuation-in-part application of U.S. application Ser. No. 29/619,287 filed on 2017 Sep. 28, which claims priority to Chinese Patent Applications No. 201730450712.8 filed on 2017 Sep. 21; No. 201730453239.9 filed on 2017 Sep. 22; No. 201730453237.X filed on 2017 Sep. 22, which is hereby incorporated by reference in their entirety.

This application is a continuation-in-part application of U.S. application Ser. No. 29/627,379 filed on 2017 Nov. 27, which claims priority to Chinese Patent Applications No. 201730537542.7 filed on 2017 Nov. 3; No. 201730537544.6 filed on 2017 Nov. 3; No. 201730520672.X filed on 2017 Oct. 30; No. 201730517887.6 filed on 2017 Oct. 27; No. 201730489929.X filed on 2017 Oct. 16, which is hereby incorporated by reference in their entirety.

This application claims priority to Chinese Patent Applications No. 201711434993.3 filed on 2017 Dec. 26, which is hereby incorporated by reference in its entirety.

FIELD OF THE INVENTION

The disclosure relates to a lighting field, in particular, to LED light bulbs.

BACKGROUND

For decades incandescent light bulbs were widely used in household and commercial lighting. However, incandescent light bulbs are generally inefficient in terms of energy use and are subject to frequent replacement due to their limited lifetime (about 1,000 hours). Approximately 90% of the energy input is emitted as heat. These lamps are gradually being replaced by other, more efficient types of electric light such as fluorescent lamps, high-intensity discharge lamps, light emitting diodes (LEDs), etc. LED lamp is one of the most spectacular illumination technologies among all of these electric light types. LED lamps have the advantages of long service life, small size and environmental protection, etc., so their applications are increasing more and more.

Recently, LED light bulbs each of which has an LED filament for emitting light are commercially available. The LED filament includes a substrate plate and several LEDs on the substrate plate. The effect of illumination of the LED light bulb has room for improvement. A traditional light bulb having a tungsten filament can create the effect of even illumination light because of the nature of the tungsten filament; however, the LED filament is hard to generate the effect of even illumination light. There are some reasons as to why the LED filament is hard to create the effect of even illumination light. One reason is that the substrate plate blocks light rays emitted from the LEDs. Another reason is that the LED generates point source of light, which leads to the concentration of light rays. Even distribution of light rays result in even light effect; on the other hand, concentration of light rays result in uneven, concentrated light effect.

SUMMARY OF THE INVENTION

As previously discussed, commercially available LED light bulbs have some drawbacks. LEDs on an LED filament generate point source of light, which leads to the concentration of light rays. Concentration of light rays result in uneven, concentrated light effect. In addition, a substrate plate in the LED filament on which the LEDs arranged would block light rays emitted from the LEDs. Under the circumstances that there is only one LED filament inside an LED light bulb, it is hard to create the effect of even illumination light.

According to an embodiment of the instant disclosure, an LED light bulb comprises a bulb shell, a bulb base, two conductive supports, a stem, and an LED filament. The bulb base is connected with the bulb shell. The two conductive supports are disposed in the bulb shell. The stem extends from the bulb base to inside of the bulb shell. The LED filament comprises a plurality of LED chips and two conductive electrodes. The LED chips are arranged in an array along an elongated direction of the LED filament. The two conductive electrodes are respectively disposed at two ends of the LED filament and connected to the LED chips. The two conductive electrodes are respectively connected to the two conductive supports. Wherein the LED filament is curled to satisfy symmetry characteristics in which: while a top view of the LED light bulb is presented in two dimensional coordinate system defining four quadrants with a X-axis crossing the stem, an Y-axis crossing the stem, and an origin, a brightness presented by a portion of the LED filament in the first quadrant in the top view is symmetric to a brightness presented by a portion of the LED filament in the second quadrant in the top view with respect to the Y-axis and/or is symmetric to a brightness presented by a portion of the LED filament in the third quadrant in the top view with respect to the origin; and while a side view of the LED light bulb is presented in two dimensional coordinate system defining four quadrants with a Y'-axis aligned with the stem, an X'-axis crossing the Y'-axis, and an origin, a brightness presented by a portion of the LED filament in the first quadrant in the side view is symmetric to a brightness presented by a portion of the LED filament in the second quadrant in the side view with respect to the Y'-axis.

It is noted that the terms of X'-axis and Y'-axis in the side view are for the distinction from the terms of the X-axis and the Y-axis in the top view and have the same meaning of the X-axis and the Y-axis in the coordinate system.

According to an embodiment of the instant disclosure, an LED light bulb comprises a bulb shell, a bulb base, two conductive supports, a stem, and an LED filament. The bulb base is connected with the bulb shell. The two conductive supports are disposed in the bulb shell. The stem extends from the bulb base to inside of the bulb shell. The LED filament comprises a plurality of LED chips and two conductive electrodes. The LED chips are arranged in an array along an elongated direction of the LED filament. The two conductive electrodes are respectively disposed at two ends of the LED filament and connected to the LED chips. The two conductive electrodes are respectively connected to the two conductive supports. Wherein the LED filament is curled to satisfy symmetry characteristics in which: while a top view of the LED light bulb is presented in two dimensional coordinate system defining four quadrants with a X-axis crossing the stem, an Y-axis crossing the stem, and an origin, a structure of a portion of the LED filament in the first quadrant in the top view is symmetric to a structure of a portion of the LED filament in the second quadrant in the top view with respect to the Y-axis and/or is symmetric to a structure of a portion of the LED filament in the third quadrant in the top view with respect to the origin; and while a side view of the LED light bulb is presented in two dimensional coordinate system defining four quadrants with a Y'-axis aligned with the stem, an X'-axis crossing the Y'-axis, and an origin, a structure of a portion of the LED filament in the first quadrant in the side view is symmetric to a structure of a portion of the LED filament in the second quadrant in the side view with respect to the Y'-axis.

According to an embodiment of the instant disclosure, an LED light bulb comprises a bulb shell, a bulb base, two conductive supports, a stem, and an LED filament. The bulb base is connected with the bulb shell. The two conductive supports are disposed in the bulb shell. The stem extends from the bulb base to inside of the bulb shell. The LED filament comprises a plurality of LED chips and two conductive electrodes. The LED chips are arranged in an array along an elongated direction of the LED filament. The two conductive electrodes are respectively disposed at two ends of the LED filament and connected to the LED chips. The two conductive electrodes are respectively connected to the two conductive supports. Wherein the LED filament is curled to satisfy symmetry characteristics in which: while a top view of the LED light bulb is presented in two dimensional coordinate system defining four quadrants with a X-axis crossing the stem, an Y-axis crossing the stem, and an origin, a length of a portion of the LED filament in the first quadrant in the top view is substantially equal to that of a portion of the LED filament in the second quadrant in the top view and/or is substantially equal to that of a portion of the LED filament in the third quadrant in the top view; and while a side view of the LED light bulb is presented in two dimensional coordinate system defining four quadrants with a Y'-axis aligned with the stem, an X'-axis crossing the Y'-axis, and an origin, a length of a portion of the LED filament in the first quadrant in the side view is substantially equal to that of a portion of the LED filament in the second quadrant in the side view.

Concisely, according the embodiments of the instant disclosure, an LED light bulb comprises only one LED filament which has symmetry characteristic. The symmetry characteristic is beneficial of creating an even, wide distribution of light rays, so that the LED light bulb is capable of generating an omnidirectional light effect.

DETAILED DESCRIPTION

In order to make the objects, technical solutions and advantages of the invention more apparent, the invention will be further illustrated in details in connection with accompanying figures and embodiments hereinafter. It should be understood that the embodiments described herein are just for explanation, but not intended to limit the invention.

Figure 1A:
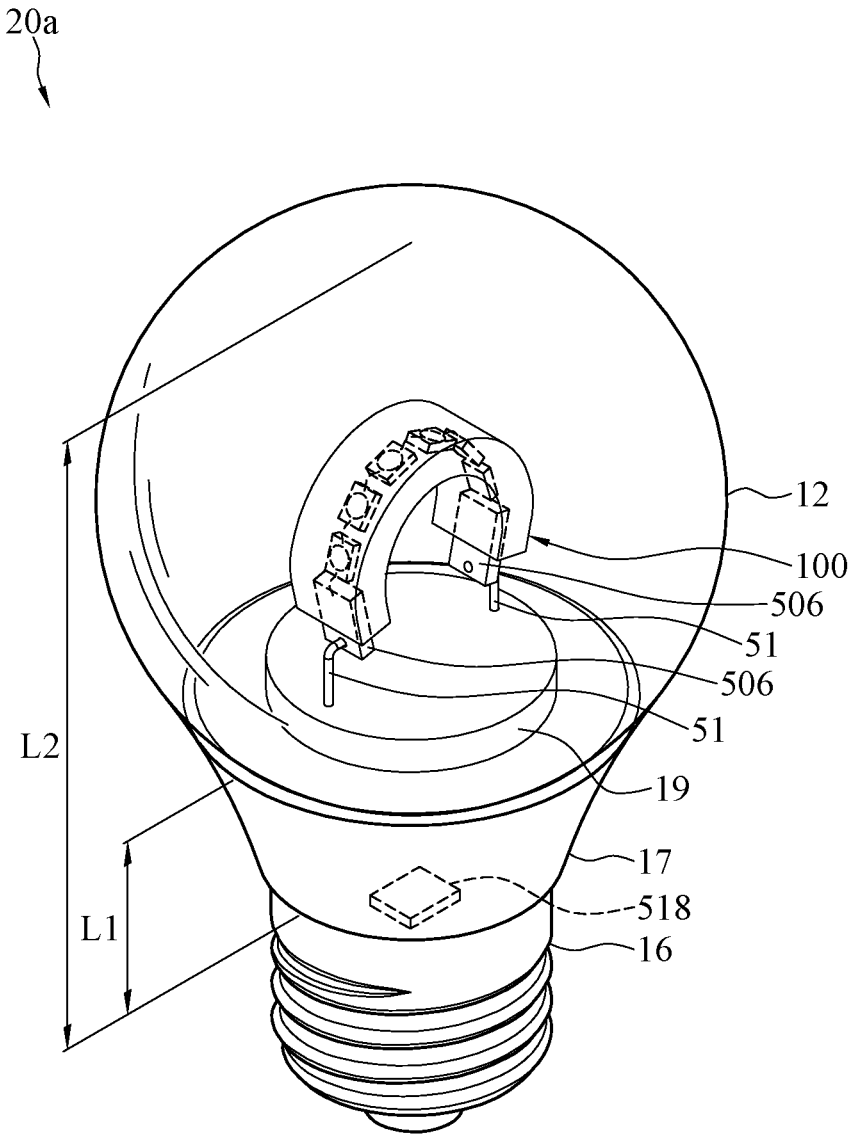
FIGS. 1A and 1B respectively illustrate a perspective view of LED light bulb applying the LED filaments according to the first embodiment and the second embodiment.
Figure 1B:
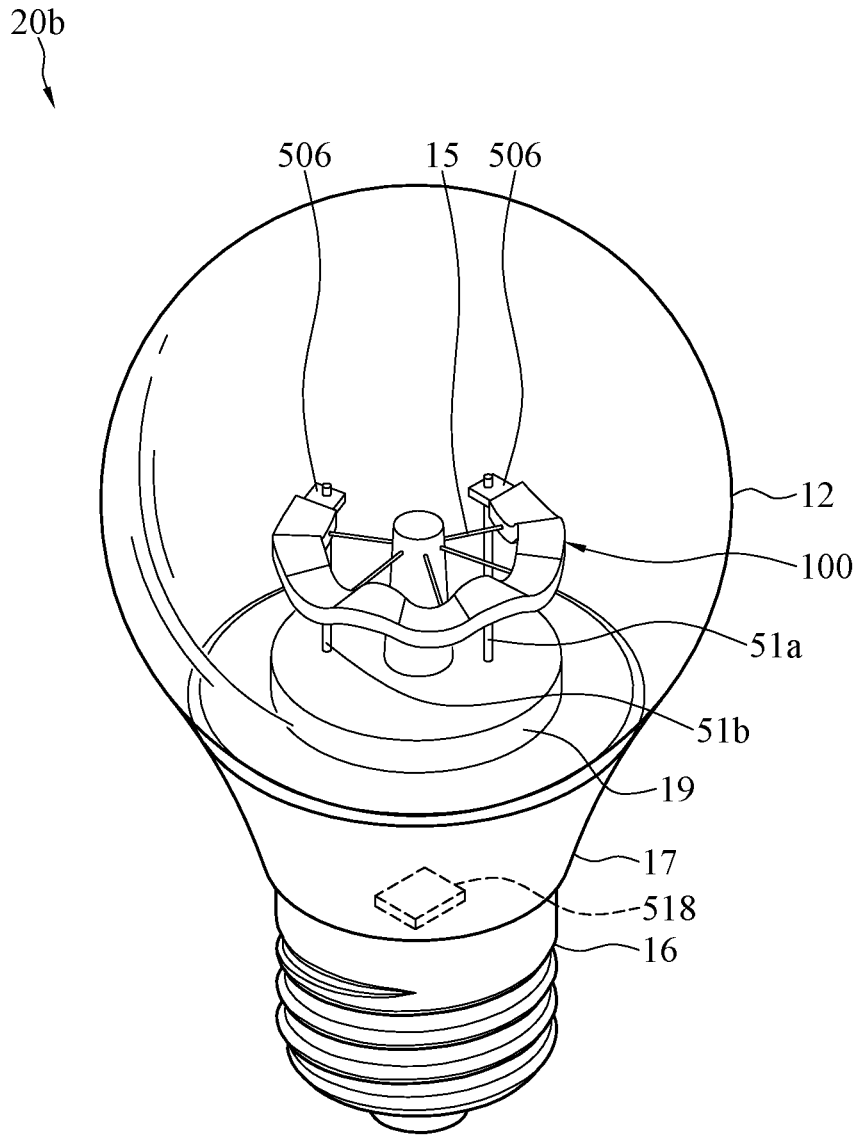

Please refer to FIGS. 1A and 1B which illustrate a perspective view of LED light bulb applying the LED filaments according to the first embodiment and the second embodiment. The LED light bulb 20*a*, 20*b* comprises a bulb shell 12, a bulb base 16 connected with the bulb shell 12, at least two conductive supports 51*a*, 51*b* disposed in the bulb shell 12, a driving circuit 518 electrically connected with both the conductive supports 51*a*, 51*b* and the bulb base 16, and a single LED filament 100 disposed in the bulb shell 12. The LED filament 100 comprises LED chips aligned along a line.

The conductive supports 51*a*, 51*b* are used for electrically connecting with the conductive electrodes 506 and for supporting the weight of the LED filament 100. The bulb base 16 is used to receive electrical power. The driving circuit 518 receives the power from the bulb base 16 and drives the LED filament 100 to emit light. Due to a symmetry characteristic with respect to structure, shape, contour, or curve of the LED filament 100 of the LED light bulb 20*a*, 20*b* or with respect to emitting direction (a direction towards which a lighting face of the LED filament 100 faces) of the LED filament 100, which would be discussed later, the LED light bulb 20*a*, 20*b* may emit omnidirectional light. In this embodiment, the driving circuit 518 is disposed inside the LED light bulb. However, in some embodiments, the driving circuit 518 may be disposed outside the LED bulb.

In the embodiment of FIG. 1A, the LED light bulb 20*a* comprises two conductive supports 51*a*, 51*b*. In an embodiment, the LED light bulb may comprise more than two conductive supports 51*a*, 51*b* depending upon the design.

The bulb shell 12 may have better light transmittance and thermal conductivity. The material of the bulb shell 12 may be, but not limited to, glass or plastic. Considering a requirement of low color temperature light bulb on the market, the interior of the bulb shell 12 may be appropriately doped with a golden yellow material or a surface inside the bulb shell 12 may be plated a golden yellow thin film for appropriately absorbing a trace of blue light emitted by a part of the LED chips, so as to downgrade the color temperature performance of the LED bulb 20*a*, 20*b*.

According to the embodiments of FIGS. 1A and 1B, each of the LED light bulbs 20*a*, 20*b* comprises a stem 19 in the bulb shell 12 and a heat dissipating element (i.e. heat sink) 17 between the bulb shell 12 and the bulb base 16. In the embodiment, the bulb base 16 is indirectly connected with the bulb shell 12 via the heat dissipating element 17. Alternatively, the bulb base 16 can be directly connected with the bulb shell 12 without the heat dissipating element 17. The LED filament 100 is connected with the stem 19 through the conductive supports 51*a*, 51*b*. The stem 19 may be used to swap the air inside the bulb shell 12 with nitrogen gas or a mixture of nitrogen gas and helium gas. The stem 19 may further provide heat conduction effect from the LED filament 100 to outside of the bulb shell 12. The heat dissipating element 17 may be a hollow cylinder surrounding the opening of the bulb shell 12, and the interior of the heat dissipating element 17 may be equipped with the driving circuit 518. The exterior of the heat dissipating element 17 contacts outside gas for thermal conduction. The material of the heat dissipating element 17 may be at least one selected from a metal, a ceramic, and a plastic with a good thermal conductivity effect. The heat dissipating element 17 and the stem 19 may be integrally formed in one piece to obtain better thermal conductivity in comparison with the traditional LED light bulb whose thermal resistance is increased due that the screw of the bulb base is glued with the heat dissipating element.

Please refer to FIG. 1B, the LED filament 100 is bent to form a portion of a contour and to form a wave shape having wave crests and wave troughs. In the embodiment, the outline of the LED filament 100 is a circle when being observed in a top view and the LED filament 100 has the wave shape when being observed in a side view. Alternatively, the outline of the LED filament 100 can be a wave shape or a petal shape when being observed in a top view and the LED filament 100 can have the wave shape or a line shape when being observed in a side view. In order to appropriately support the LED filament 100, the LED light bulb 20*b* further comprises a plurality of supporting arms 15 which are connected with and supports the LED filament 100. The supporting arms 15 may be connected with the wave crest and wave trough of the waved shaped LED filament 100. In this embodiment, the arc formed by the filament 100 is around 270 degrees. However, in other embodiment, the arc formed by the filament 100 may be approximately 360 degrees. Alternatively, one LED light bulb 20*b* may comprise two LED filaments 100 or more. For example, one LED light bulb 20*b* may comprise two LED filaments 100 and each of the LED filaments 100 is bent to form approximately 180 degrees arc (semicircle). Two semicircle LED filaments 100 are disposed together to form an approximately 360 circle. By the way of adjusting the arc formed by the LED filament 100, the LED filament 100 may provide with omnidirectional light. Further, the structure of one-piece filament simplifies the manufacturing and assembly procedures and reduces the overall cost.

The LED filament 100 has no any substrate plate that the conventional LED filament usually has; therefore, the LED filament 100 is easy to be bent to form elaborate curvatures and varied shapes, and structures of conductive electrodes 506 and wires connecting the conductive electrodes 506 with the LEDs inside the LED filament 100 are tough to prevent damages when the LED filament 100 is bent.

In some embodiment, the supporting arm 15 and the stem 19 may be coated with high reflective materials, for example, a material with white color. Taking heat dissipating characteristics into consideration, the high reflective materials may be a material having good absorption for heat radiation like graphene. Specifically, the supporting arm 15 and the stem 19 may be coated with a thin film of graphene.

Figure 2A:
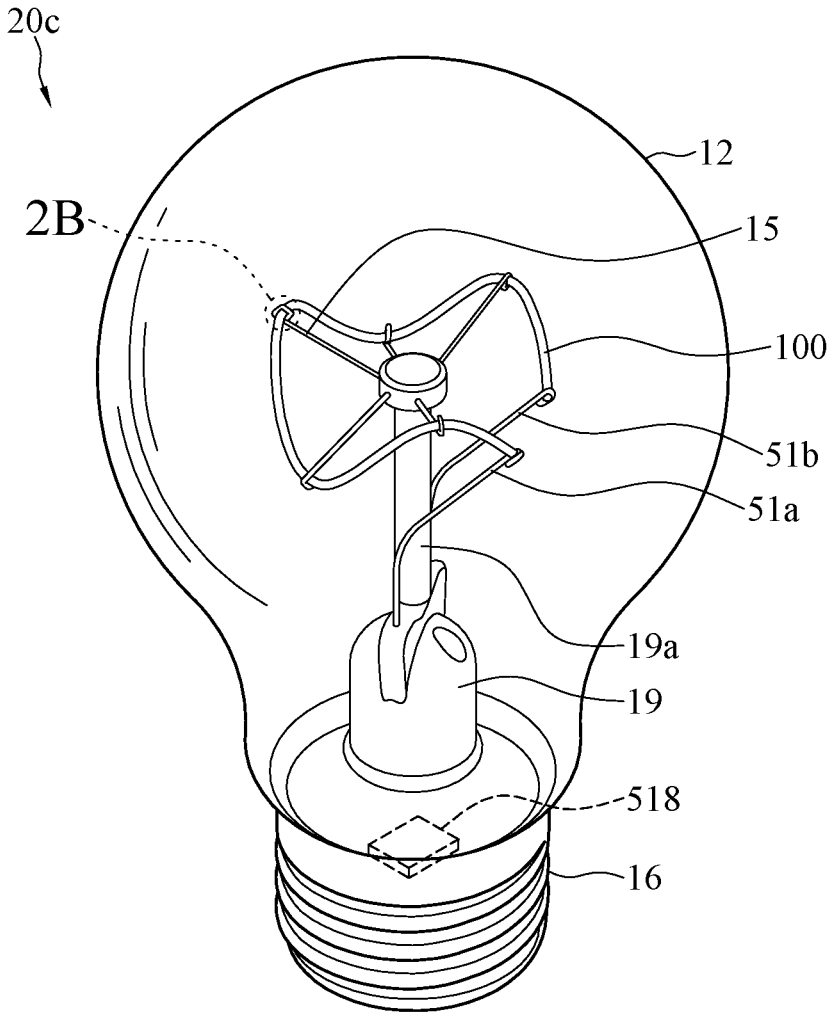
FIG. 2A illustrates a perspective view of an LED light bulb according to the third embodiment of the instant disclosure.

Please refer to FIG. 2A. FIG. 2A illustrates a perspective view of an LED light bulb according to the third embodiment of the instant disclosure. According to the third embodiment, the LED light bulb 20*c* comprises a bulb shell 12, a bulb base 16 connected with the bulb shell 12, two conductive supports 51*a*, 51*b* disposed in the bulb shell 12, a driving circuit 518 electrically connected with both the conductive supports 51*a*, 51*b* and the bulb base 16, a stem 19, supporting arms 15 and a single LED filament 100.

The cross-sectional size of the LED filaments 100 is small than that in the embodiments of FIGS. 1A and 1B. The conductive electrodes 506 of the LED filaments 100 are electrically connected with the conductive supports 51*a*, 51*b* to receive the electrical power from the driving circuit 518. The connection between the conductive supports 51*a*, 51*b* and the conductive electrodes 506 may be a mechanical pressed connection or soldering connection. The mechanical connection may be formed by firstly passing the conductive supports 51*a*, 51*b* through certain through holes (not shown) formed on the conductive electrodes 506 and secondly bending the free end of the conductive supports 51*a*, 51*b* to grip the conductive electrodes 506. The soldering connection may be done by a soldering process with a silver-based alloy, a silver solder, a tin solder.

Similar to the first and second embodiments shown in FIGS. 1A and 1B, the LED filament 100 shown in FIG. 2A is bent to form a contour resembling to a circle while being observed from the top view of FIG. 2A. According to the embodiment of FIG. 2A, the LED filament 100 is bent to form a wave shape from side view. The shape of the LED filament 100 is novel and makes the illumination more uniform. In comparison with a LED bulb having multiple LED filaments, single LED filament 100 has less connecting spots. In implementation, single LED filament 100 has only two connecting spots such that the probability of defect soldering or defect mechanical pressing is decreased.

The stem 19 has a stand 19*a* extending to the center of the bulb shell 12. The stand 19*a* supports the supporting arms 15. The first end of each of the supporting arms 15 is connected with the stand 19*a* while the second end of each of the supporting arms 15 is connected with the LED filament 100.

Figure 2B:
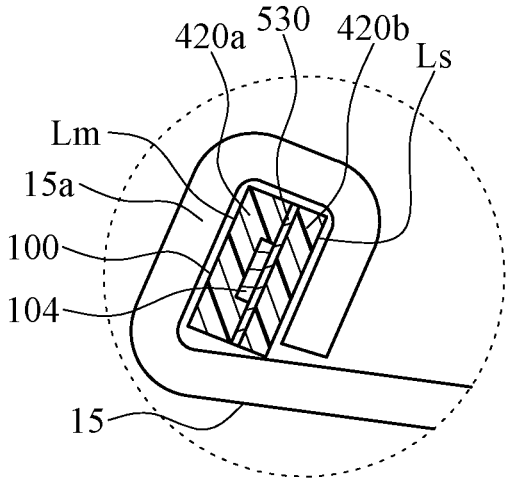
FIG. 2B illustrates an enlarged cross-sectional view of the dashed-line circle of FIG. 2A.

Please refer to FIG. 2B which illustrates an enlarged cross-sectional view of the dashed-line circle of FIG. 2A. The second end of each of the supporting arms 15 has a clamping portion 15*a* which clamps the body of the LED filament 100. The clamping portion 15*a* may, but not limited to, clamp at either the wave crest or the wave trough. Alternatively, the clamping portion 15*a* may clamp at the portion between the wave crest and the wave trough. The shape of the clamping portion 15*a* may be tightly fitted with the outer shape of the cross-section of the LED filament 100. The dimension of the inner shape (through hole) of the clamping portion 15*a* may be a little bit smaller than the outer shape of the cross-section of the LED filament 100. During manufacturing process, the LED filament 100 may be passed through the inner shape of the clamping portion 15*a* to form a tight fit. Alternatively, the clamping portion 15*a* may be formed by a bending process. Specifically, the LED filament 100 may be placed on the second end of the supporting arm 15 and a clamping tooling is used to bend the second end into the clamping portion to clamp the LED filament 100.

The supporting arms 15 may be, but not limited to, made of carbon steel spring to provide with adequate rigidity and flexibility so that the shock to the LED light bulb caused by external vibrations is absorbed and the LED filament 100 is not easily to be deformed. Since the stand 19*a* extending to the center of the bulb shell 12 and the supporting arms 15 are connected to a portion of the stand 19*a* near the top thereof, the position of the LED filaments 100 is at the level close to the center of the bulb shell 12. Accordingly, the illumination characteristics of the LED light bulb 20*c* are close to that of the traditional light bulb including illumination brightness. The illumination uniformity of LED light bulb 20*c* is better. In the embodiment, at least a half of the LED filaments 100 is around a center axle of the LED light bulb 20*c*. The center axle is coaxial with the axle of the stand 19*a*.

In the embodiment, the first end of the supporting arm 15 is connected with the stand 19*a* of the stem 19. The clamping portion of the second end of the supporting arm 15 is connected with the outer insulation surface of the LED filaments 100 such that the supporting arms 15 are not used as connections for electrical power transmission. In an embodiment where the stem 19 is made of glass, the stem 19 would not be cracked or exploded because of the thermal expansion of the supporting arms 15 of the LED light bulb 20*c*. Additionally, there may be no stand in an LED light bulb. The supporting arm 15 may be fixed to the stem or the bulb shell directly to eliminate the negative effect to illumination caused by the stand.

The supporting arm 15 is thus non-conductive to avoid a risk that the glass stem 19 may crack due to the thermal expansion and contraction of the metal filament in the supporting arm 15 under the circumstances that the supporting arm 15 is conductive and generates heat when current passes through the supporting arm 15.

In different embodiments, the second end of the supporting arm 15 may be directly inserted inside the LED filament 100 and become an auxiliary piece in the LED filament 100, which can enhance the mechanical strength of the LED filament 100. Relative embodiments are described later.

The inner shape (the hole shape) of the clamping portion 15*a* fits the outer shape of the cross section of the LED filament 100; therefore, based upon a proper design, the cross section of the LED filament 100 may be oriented to face towards a predetermined orientation. For example, as shown in FIG. 2B, the LED filament 100 comprises a top layer 420*a*, LED chips 104, and a base layer 420*b*. The LED chips 104 are aligned in line along the axial direction (or an elongated direction) of the LED filament 100 and are disposed between the top layer 420*a* and the base layer 420*b*. The top layer 420*a* of the LED filament 100 is oriented to face towards ten o'clock in FIG. 2B. A lighting face of the whole LED filament 100 may be oriented to face towards the same orientation substantially to ensure that the lighting face of the LED filament 100 is visually identical. The LED filament 100 comprises a main lighting face Lm and a subordinate lighting face Ls corresponding to the LED chips. If the LED chips in the LED filament 100 are wire bonded and are aligned in line, a face of the top layer 420*a* away from the base layer 420*b* is the main lighting face Lm, and a face of the base layer 420*b* away from the top layer 420*a* is the subordinate lighting face Ls. The main lighting face Lm and the subordinate lighting face Ls are opposite to each other. When the LED filament 100 emits light, the main lighting face Lm is the face through which the largest amount of light rays passes, and the subordinate lighting face Ls is the face through which the second largest amount of light rays passes. In the embodiment, there is, but is not limited to, a conductive foil 530 formed between the top layer 420*a* and the base layer 420*b*, which is utilized for electrical connection between the LED chips. In the embodiment, the LED filament 100 wriggles with twists and turns while the main lighting face Lm is always towards outside. That is to say, any portion of the main lighting face Lm is towards the bulb shell 12 or the bulb base 16 and is away from the stem 19 at any angle, and the subordinate lighting face Ls is always towards the stem 19 or towards the top of the stem 19 (the subordinate lighting face Ls is always towards inside).

The LED filament 100 shown in FIG. 2A is curved to form a circular shape in a top view while the LED filament is curved to form a wave shape in a side view. The wave shaped structure is not only novel in appearance but also guarantees that the LED filament 100 illuminates evenly. In the meantime, the single LED filament 100, comparing to multiple LED filaments, requires less joint points (e.g., pressing points, fusing points, or welding points) for being connected to the conductive supports Ma, 51*b*. In practice, the single LED filament 100 (as shown in FIG. 2A) requires only two joint points respectively formed on the two conductive electrodes, which effectively lowers the risk of fault welding and simplifies the process of connection comparing to the mechanically connection in the tightly pressing manner.

Figure 2C:
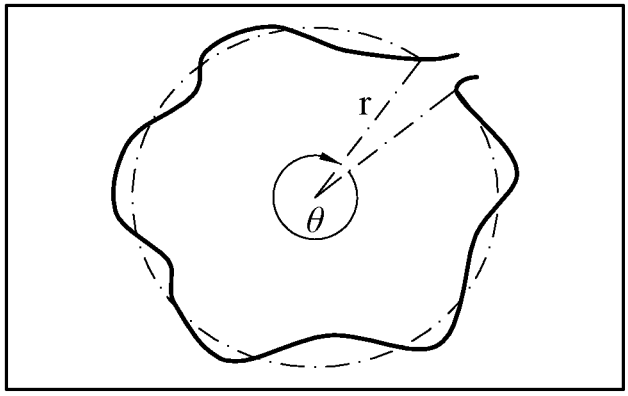
FIG. 2C is a projection of a top view of an LED filament of the LED light bulb of FIG. 2A.

Please refer to FIG. 2C. FIG. 2C is a projection of a top view of an LED filament of the LED light bulb 20*c* of FIG. 2A. As shown in FIG. 2C, in an embodiment, the LED filament may be curved to form a wave shape resembling to a circle observed in a top view to surround the center of the light bulb or the stem. In different embodiments, the LED filament observed in the top view can form a quasi-circle or a quasi U shape.

As shown in FIG. 2B and FIG. 2C, the LED filament 100 surrounds with the wave shape resembling to a circle and has a quasi-symmetric structure in the top view, and the lighting face of the LED filament 100 is also symmetric, e.g., the main lighting face Lm in the top view may faces outwardly; therefore, the LED filament 100 may generate an effect of an omnidirectional light due to a symmetry characteristic with respect to the quasi-symmetric structure of the LED filament 100 and the arrangement of the lighting face of the LED filament 100 in the top view. Whereby, the LED light bulb 20*c* as a whole may generate an effect of an omnidirectional light close to a 360 degrees illumination. Additionally, the two joint points may be close to each other such that the conductive supports 51*a*, 51*b* are substantially below the LED filament 100. Visually, the conductive supports 51*a*, 51*b* keeps a low profile and is integrated with the LED filament 100 to show an elegance curvature.

Figure 3A:
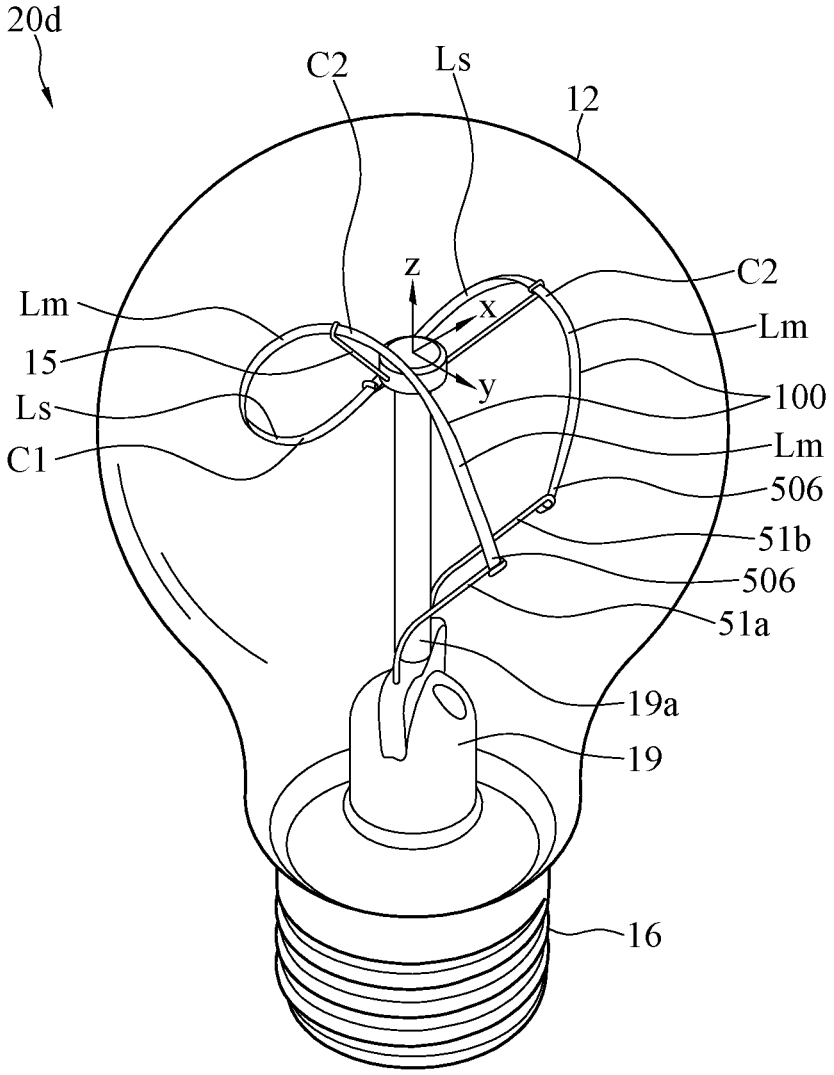
FIG. 3A is a perspective view of an LED light bulb according to an embodiment of the present invention.
Figure 3B:
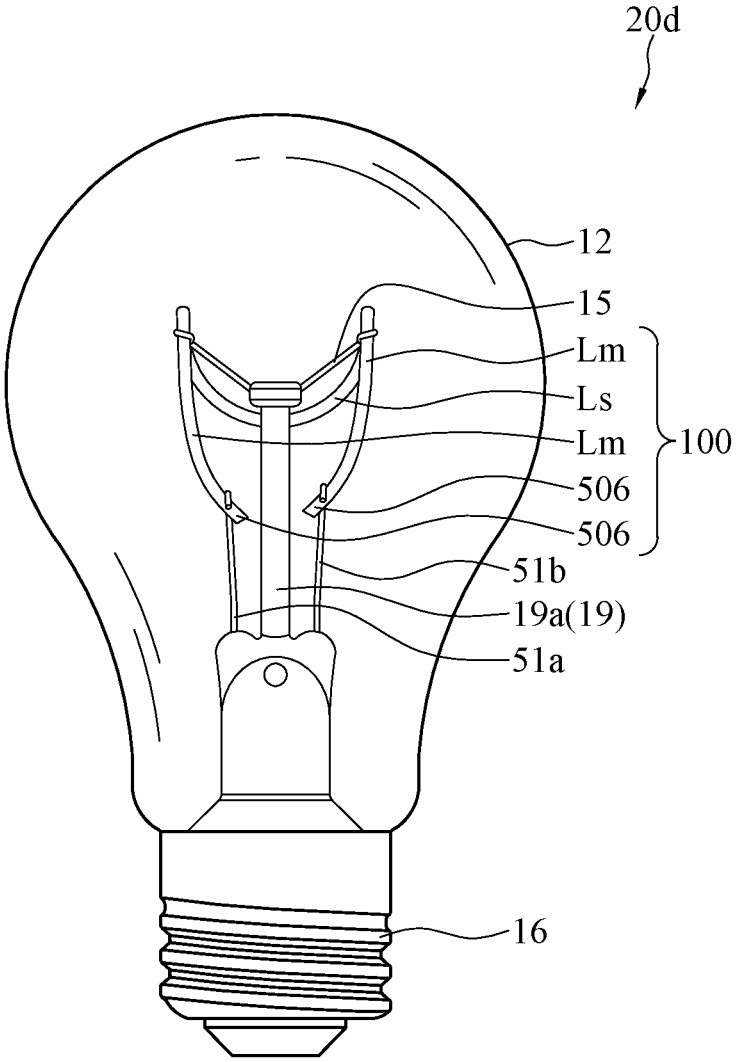
FIG. 3B is a front view of an LED light bulb of FIG. 3A.

Please refer to FIG. 3A and FIG. 3B. FIG. 3A is a perspective view of an LED light bulb according to an embodiment of the present invention. FIG. 3B is a front view (or a side view) of an LED light bulb of FIG. 3A. The LED light bulb 20*d* shown in FIG. 3A and FIG. 3B is analogous to the LED light bulb 20*c* shown in FIG. 2A. As shown in FIG. 3A and FIG. 3B, the LED light bulb 20*d* comprises a bulb shell 12, a bulb base 16 connected to the bulb shell 12, two conductive supports 51*a*, 51*b* disposed in the bulb shell 12, supporting arms 15, a stem 19, and one single LED filament 100. The stem 19 comprises a stem bottom and a stem top opposite to each other. The stem bottom is connected to the bulb base 16. The stem top extends to inside of the bulb shell 12 (e.g., extending to the center of the bulb shell 12) along an elongated direction of the stem 19. For example, the stem top may be substantially located at a center of the inside of the bulb shell 12. In the embodiment, the stem 19 comprises the stand 19*a*. Herein the stand 19*a* is deemed as a part of the whole stem 19 and thus the top of the stem 19 is the same as the top of the stand 19*a*. The two conductive supports Ma, 51*b* are connected to the stem 19. The LED filament 100 comprises a filament body and two conductive electrodes 506. The two conductive electrodes 506 are at two opposite ends of the filament body. The filament body is the part of the LED filament 100 without the conductive electrodes 506. The two conductive electrodes 506 are respectively connected to the two conductive supports 51*a*, 51*b*. The filament body is around the stem 19. An end of the supporting arm 15 is connected to the stem 19 and another end of the supporting arm 15 is connected to the filament body.

Figure 3C:
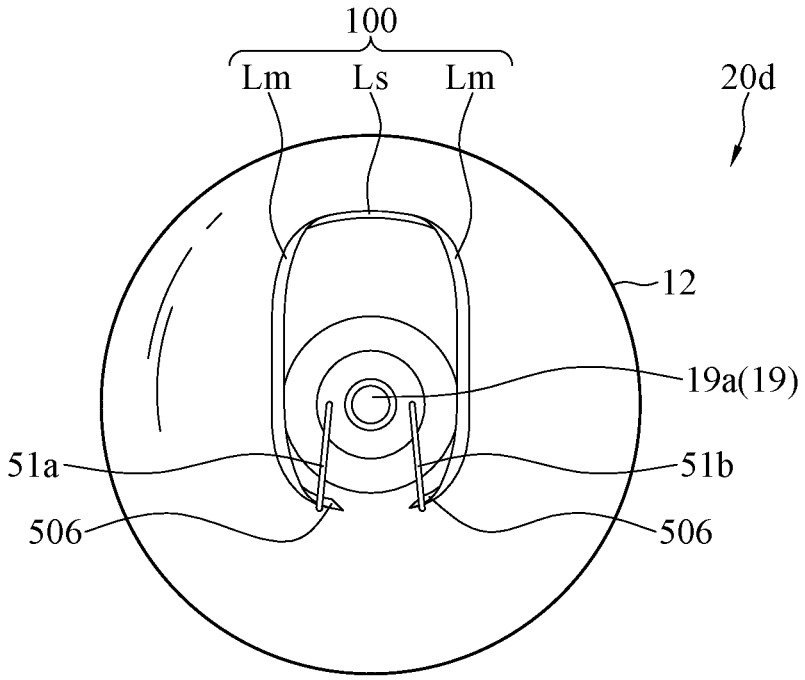
FIG. 3C is a top view of the LED light bulb of FIG. 3A.

Please refer to FIG. 3C. FIG. 3C is a top view of the LED light bulb 20*d* of FIG. 3A. As shown in FIG. 3B and FIG. 3C, the filament body comprises a main lighting face Lm and a subordinate lighting face Ls. Any portion of the main lighting face Lm is towards the bulb shell 12 or the bulb base 16 at any angle, and any portion of the subordinate lighting face Ls is towards the stem 19 or towards the top of the stem 19, i.e., the subordinate lighting face Ls is towards inside of the LED light bulb 20*d* or towards the center of the bulb shell 12. In other words, when a user observes the LED light bulb 20*d* from outside, the user would see the main lighting face Lm of the LED filament 100*d* at any angle. Based upon the configuration, the effect of illumination is better.

According to different embodiments, the LED filament 100 in different LED light bulbs (e.g., the LED light bulb 20*a*, 20*b*, 20*c*, or 20*d*) may be formed with different shapes or curves while all of the LED filaments 100 are configured to have symmetry characteristic. The symmetry characteristic is beneficial of creating an even, wide distribution of light rays, so that the LED light bulb is capable of generating an omnidirectional light effect. The symmetry characteristic of the LED filament 100 is discussed below.

The definition of the symmetry characteristic of the LED filament 100 may be based on four quadrants defined in a top view of an LED light bulb. The four quadrants may be defined in a top view of an LED light bulb (e.g., the LED light bulb 20*b* shown in FIG. 1B or the LED light bulb 20*c* shown in FIG. 2A), and the origin of the four quadrants may be defined as a center of a stem/stand of the LED light bulb in the top view (e.g., a center of the top of the stand of the stem 19 shown in FIG. 1B or a center of the top of the stand 19*a* shown in FIG. 2A). The LED filament of the LED light bulb (e.g., the LED filaments 100 shown in FIG. 1B and FIG. 2A) in the top view may be presented as an annular structure, shape or, contour. The LED filament presented in the four quadrants in the top view may be symmetric.

For example, the brightness presented by a portion of the LED filament in the first quadrant in the top view is symmetric with that presented by a portion of the LED filament in the second quadrant, in the third quadrant, or in the fourth quadrant in the top view while the LED filament operates. In some embodiments, the structure of a portion of the LED filament in the first quadrant in the top view is symmetric with that of a portion of the LED filament in the second quadrant, in the third quadrant, or in the fourth quadrant in the top view. In addition, an emitting direction of a portion of the LED filament in the first quadrant in the top view is symmetric with that of a portion of the LED filament in the second quadrant, in the third quadrant, or in the fourth quadrant in the top view.

In another embodiment, an arrangement of LED chips in a portion of the LED filament in the first quadrant (e.g., a density variation of the LED chips in the portion of the LED filament in the first quadrant) in the top view is symmetric with an arrangement of LED chips in a portion of the LED filament in the second quadrant, in the third quadrant, or in the fourth quadrant in the top view.

In another embodiment, a power configuration of LED chips with different power in a portion of the LED filament in the first quadrant in the top view is symmetric with a power configuration of LED chips with different power in a portion of the LED filament in the second quadrant, in the third quadrant, or in the fourth quadrant in the top view.

In another embodiment, refractive indexes of segments of a portion of the LED filament in the first quadrant in the top view are symmetric with refractive indexes of segments of a portion of the LED filament in the second quadrant, in the third quadrant, or in the fourth quadrant in the top view while the segments may be defined by distinct refractive indexes.

In another embodiment, surface roughness of segments of a portion of the LED filament in the first quadrant in the top view are symmetric with surface roughness of segments of a portion of the LED filament in the second quadrant, in the third quadrant, or in the fourth quadrant in the top view while the segments may be defined by distinct surface roughness.

The LED filament presented in the four quadrants in the top view may be in point symmetry (e.g., being symmetric with the origin of the four quadrants) or in line symmetry (e.g., being symmetric with one of the two axis the four quadrants).

A tolerance (a permissible error) of the symmetric structure of the LED filament in the four quadrants in the top view may be up to 20%-50%. For example, in a case that the structure of a portion of the LED filament in the first quadrant is symmetric with that of a portion of the LED filament in the second quadrant, a designated point on portion of the LED filament in the first quadrant is defined as a first position, a symmetric point to the designated point on portion of the LED filament in the second quadrant is defined as a second position, and the first position and the second position may be exactly symmetric or be symmetric with 20%-50% difference.

In addition, a length of a portion of the LED filament in one of the four quadrants in the top view is substantially equal to that of a portion of the LED filament in another one of the four quadrants in the top view. The lengths of portions of the LED filament in different quadrants in the top view may also have 20%-50% difference.

The definition of the symmetry characteristic of the LED filament 100 may be based on four quadrants defined in a side view, in a front view, or in a rear view of an LED light bulb. In the embodiments, the side view may include a front view or a rear view of the LED light bulb. The four quadrants may be defined in a side view of an LED light bulb (e.g., the LED light bulb 20*a* shown in FIG. 1A or the LED light bulb 20*c* shown in FIG. 2A). In such case, an elongated direction of a stand (or a stem) from the bulb base 16 towards a top of the bulb shell 12 away from the bulb base 16 may be defined as the Y-axis, and the X-axis may cross a middle of the stand (e.g., the stand 19*a* of the LED light bulb 20*c* shown in FIG. 2A) while the origin of the four quadrants may be defined as the middle of the stand. In different embodiment, the X-axis may cross the stand at any point, e.g., the X-axis may cross the stand at the top of the stand, at the bottom of the stand, or at a point with a certain height (e.g., ⅔ height) of the stand.

In addition, portions of the LED filament presented in the first quadrant and the second quadrant (the upper quadrants) in the side view may be symmetric (e.g., in line symmetry with the Y-axis) in brightness, and portions of the LED filament presented in the third quadrant and the fourth quadrant (the lower quadrants) in the side view may be symmetric (e.g., in line symmetry with the Y-axis) in brightness; however, the brightness of the portions of the LED filament presented in the upper quadrants in the side view may be asymmetric with that of the portions of the LED filament presented in the lower quadrants in the side view.

In some embodiments, portions of the LED filament presented in the first quadrant and the second quadrant (the upper quadrants) in the side view may be symmetric (e.g., in line symmetry with the Y-axis) in structure; portions of the LED filament presented in the third quadrant and the fourth quadrant (the lower quadrants) in the side view may be symmetric (e.g., in line symmetry with the Y-axis) in structure. In addition, an emitting direction of a portion of the LED filament in the first quadrant in the side view is symmetric with that of a portion of the LED filament in the second quadrant in the side view, and an emitting direction of a portion of the LED filament in the third quadrant in the side view is symmetric with that of a portion of the LED filament in the fourth quadrant in the side view.

In another embodiment, an arrangement of LED chips in a portion of the LED filament in the first quadrant in the side view is symmetric with an arrangement of LED chips in a portion of the LED filament in the second quadrant in the side view, and an arrangement of LED chips in a portion of the LED filament in the third quadrant in the side view is symmetric with an arrangement of LED chips in a portion of the LED filament in the fourth quadrant in the side view.

In another embodiment, a power configuration of LED chips with different power in a portion of the LED filament in the first quadrant in the side view is symmetric with a power configuration of LED chips with different power in a portion of the LED filament in the second quadrant in the side view, and a power configuration of LED chips with different power in a portion of the LED filament in the third quadrant in the side view is symmetric with a power configuration of LED chips with different power in a portion of the LED filament in the fourth quadrant in the side view.

In another embodiment, refractive indexes of segments of a portion of the LED filament in the first quadrant in the side view are symmetric with refractive indexes of segments of a portion of the LED filament in the second quadrant in the side view, and refractive indexes of segments of a portion of the LED filament in the third quadrant in the side view are symmetric with refractive indexes of segments of a portion of the LED filament in the fourth quadrant in the side view while the segments may be defined by distinct refractive indexes.

In another embodiment, surface roughness of segments of a portion of the LED filament in the first quadrant in the side view are symmetric with surface roughness of segments of a portion of the LED filament in the second quadrant in the side view, and surface roughness of segments of a portion of the LED filament in the third quadrant in the side view are symmetric with surface roughness of segments of a portion of the LED filament in the fourth quadrant in the side view while the segments may be defined by distinct surface roughness.

Additionally, the portions of the LED filament presented in the upper quadrants in the side view may be asymmetric with the portions of the LED filament presented in the lower quadrants in the side view in brightness. In some embodiments, the portion of the LED filament presented in the first quadrant and the fourth quadrant in the side view is asymmetric in structure, in length, in emitting direction, in arrangement of LED chips, in power configuration of LED chips with different power, in refractive index, or in surface roughness, and the portion of the LED filament presented in the second quadrant and the third quadrant in the side view is asymmetric in structure, in length, in emitting direction, in arrangement of LED chips, in power configuration of LED chips with different power, in refractive index, or in surface roughness. In order to fulfill the illumination purpose and the requirement of omnidirectional lamps, light rays emitted from the upper quadrants (the portion away from the bulb base 16) in the side view should be greater than those emitted from the lower quadrants (the portion close to the bulb base 16). Therefore, the asymmetric characteristic of the LED filament of the LED light bulb between the upper quadrants and the lower quadrants in the side view may contribute to the omnidirectional requirement by concentrating the light rays in the upper quadrants.

A tolerance (a permissible error) of the symmetric structure of the LED filament in the first quadrant and the second quadrant in the side view may be 20%-50%. For example, a designated point on portion of the LED filament in the first quadrant is defined as a first position, a symmetric point to the designated point on portion of the LED filament in the second quadrant is defined as a second position, and the first position and the second position may be exactly symmetric or be symmetric with 20%-50% difference.

In addition, a length of a portion of the LED filament in the first quadrant in the side view is substantially equal to that of a portion of the LED filament in the second quadrant in the side view. A length of a portion of the LED filament in the third quadrant in the side view is substantially equal to that of a portion of the LED filament in the fourth quadrant in the side view. However, the length of the portion of the LED filament in the first quadrant or the second quadrant in the side view is different from the length of the portion of the LED filament in the third quadrant or the fourth quadrant in the side view. In some embodiment, the length of the portion of the LED filament in the third quadrant or the fourth quadrant in the side view may be less than that of the portion of the LED filament in the first quadrant or the second quadrant in the side view. The lengths of portions of the LED filament in the first and the second quadrants or in the third and the fourth quadrants in the side view may also have 20%-50% difference.

Figure 3D:
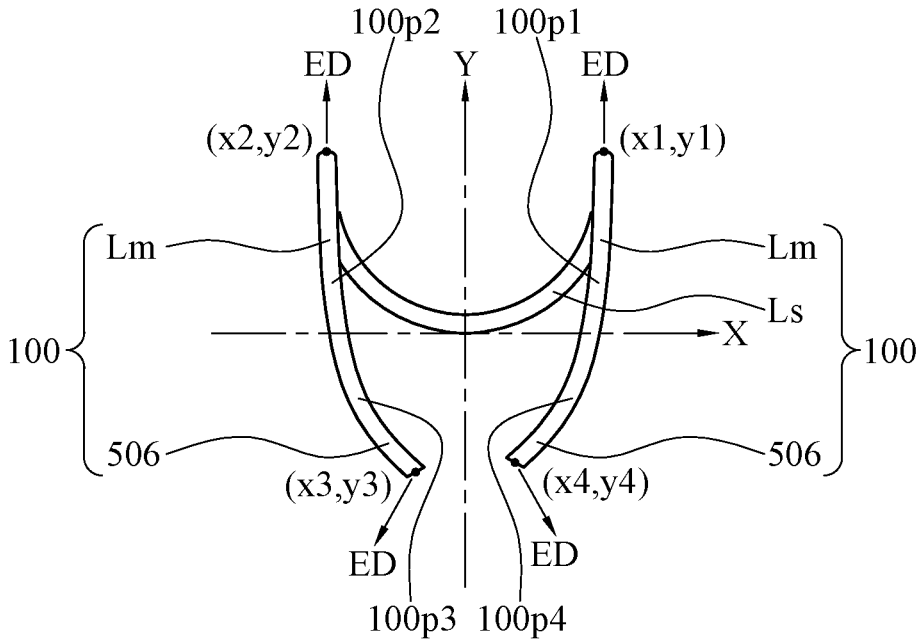
FIG. 3D is the LED filament shown in FIG. 3B presented in two dimensional coordinate system defining four quadrants.

Please refer to FIG. 3D. FIG. 3D is the LED filament 100 shown in FIG. 3B presented in two dimensional coordinate system defining four quadrants. The LED filament 100 in FIG. 3D is the same as that in FIG. 3B, which is a front view (or a side view) of the LED light bulb 20*d* shown in FIG. 3A. As shown in FIG. 3B and FIG. 3D, the Y-axis is aligned with the stand 19*a* of the stem (i.e., being along the elongated direction of the stand 19*a*), and the X-axis crosses the stand 19*a* (i.e., being perpendicular to the elongated direction of the stand 19*a*). As shown in FIG. 3D, the LED filament 100 in the side view can be divided into a first portion 100*p*1, a second portion 100*p*2, a third portion 100*p*3, and a fourth portion 100*p*4 by the X-axis and the Y-axis. The first portion 100*p*1 of the LED filament 100 is the portion presented in the first quadrant in the side view. The second portion 100*p*2 of the LED filament 100 is the portion presented in the second quadrant in the side view. The third portion 100*p*3 of the LED filament 100 is the portion presented in the third quadrant in the side view. The fourth portion 100*p*4 of the LED filament 100 is the portion presented in the fourth quadrant in the side view.

As shown in FIG. 3D, the LED filament 100 is in line symmetry. The LED filament 100 is symmetric with the Y-axis in the side view. That is to say, the geometric shape of the first portion 100*p*1 and the fourth portion 100*p*4 are symmetric with that of the second portion 100*p*2 and the third portion 100*p*3. Specifically, the first portion 100*p*1 is symmetric to the second portion 100*p*2 in the side view. Particularly, the first portion 100*p*1 and the second portion 100*p*2 are symmetric in structure in the side view with respect to the Y-axis. In addition, the third portion 100*p*3 is symmetric to the fourth portion 100*p*4 in the side view. Particularly, the third portion 100*p*3 and the fourth portion 100*p*4 are symmetric in structure in the side view with respect to the Y-axis.

In the embodiment, as shown in FIG. 3D, the first portion 100*p*1 and the second portion 100*p*2 presented in the upper quadrants (i.e., the first quadrant and the second quadrant) in the side view are asymmetric with the third portion 100*p*3 and the fourth portion 100*p*4 presented in the lower quadrants (i.e., the third quadrant and the fourth quadrant) in the side view. In particular, the first portion 100*p*1 and the fourth portion 100*p*4 in the side view are asymmetric, and the second portion 100*p*2 and the third portion 100*p*3 in the side view are asymmetric. According to an asymmetry characteristic of the structure of the filament 100 in the upper quadrants and the lower quadrants in FIG. 3D, light rays emitted from the upper quadrants to pass through the upper bulb shell 12 (the portion away from the bulb base 16) would be greater than those emitted from the lower quadrants to pass through the lower bulb shell 12 (the portion close to the bulb base 16) in order to fulfill the illumination purpose and the requirement of omnidirectional lamps.

Based upon symmetry characteristic of LED filament 100, the structures of the two symmetric portions of the LED filament 100 in the side view (the first portion 100*p*1 and the second portion 100*p*2 or the third portion 100*p*3 and the fourth portion 100*p*4) may be exactly symmetric or be symmetric with a tolerance in structure. The tolerance (or a permissible error) between the structures of the two symmetric portions of the LED filament 100 in the side view may be 20%-50% or less.

The tolerance can be defined as a difference in coordinates, i.e., x-coordinate or y-coordinate. For example, if there is a designated point on the first portion 100*p*1 of the LED filament 100 in the first quadrant and a symmetric point on the second portion 100*p*2 of the LED filament 100 in the second quadrant symmetric to the designated point with respect to the Y-axis, the absolute value of y-coordinate or the x-coordinate of the designated point may be equal to the absolute value of y-coordinate or the x-coordinate of the symmetric point or may have 20% difference comparing to the absolute value of y-coordinate or the x-coordinate of the symmetric point.

For example, as shown in FIG. 3D, a designated point (x1, y1) on the first portion 100*p*1 of the LED filament 100 in the first quadrant is defined as a first position, and a symmetric point (x2, y2) on the second portion 100*p*2 of the LED filament 100 in the second quadrant is defined as a second position. The second position of the symmetric point (x2, y2) is symmetric to the first position of the designated point (x1, y1) with respect to the Y-axis. The first position and the second position may be exactly symmetric or be symmetric with 20%-50% difference. In the embodiment, the first portion 100*p*1 and the second portion 100*p*2 are exactly symmetric in structure. In other words, x2 of the symmetric point (x2, y2) is equal to negative x1 of the designated point (x1, y1), and y2 of the symmetric point (x2, y2) is equal to y1 of the designated point (x1, y1).

For example, as shown in FIG. 3D, a designated point (x3, y3) on the third portion 100*p*3 of the LED filament 100 in the third quadrant is defined as a third position, and a symmetric point (x4, y4) on the fourth portion 100*p*4 of the LED filament 100 in the fourth quadrant is defined as a fourth position. The fourth position of the symmetric point (x4, y4) is symmetric to the third position of the designated point (x3, y3) with respect to the Y-axis. The third position and the fourth position may be exactly symmetric or be symmetric with 20%-50% difference. In the embodiment, the third portion 100*p*3 and the fourth portion 100*p*4 are symmetric with a tolerance (e.g., a difference in coordinates being less than 20%) in structure. In other words, the absolute value of x4 of the symmetric point (x4, y4) is unequal to the absolute value of x3 of the designated point (x3, y3), and the absolute value of y4 of the symmetric point (x4, y4) is unequal to the absolute value of y3 of the designated point (x3, y3). As shown in FIG. 3D, the level of the designated point (x3, y3) is slightly lower than that of the symmetric point (x4, y4), and the designated point (x3, y3) is slightly closer to the Y-axis than the symmetric point (x4, y4) is. Accordingly, the absolute value of y4 is slightly less than that of y3, and the absolute value of x4 is slightly greater than that of x3.

As shown in FIG. 3D, a length of the first portion 100*p*1 of the LED filament 100 in the first quadrant in the side view is substantially equal to a length of the second portion 100*p*2 of the LED filament 100 in the second quadrant in the side view. In the embodiment, the length is defined along an elongated direction of the LED filament 100 in a plane view (e.g., a side view, a front view, or a top view). For example, the first portion 100*p*1 elongates in the first quadrant in the side view shown in FIG. 3D to form a reversed "V" shape with two ends respectively contacting the X-axis and the Y-axis, and the length of the first portion 100*p*1 is defined along the reversed "V" shape between the X-axis and the Y-axis.

In addition, a length of the third portion 100*p*3 of the LED filament 100 in the third quadrant in the side view is substantially equal to a length of fourth portion 100*p*4 of the LED filament 100 in the fourth quadrant in the side view. Since the third portion 100*p*3 and the fourth portion 100*p*4 are symmetric with respect to the Y-axis with a tolerance in structure, there may be a slightly difference between the length of the third portion 100*p*3 and the length of fourth portion 100*p*4. The difference may be 20%-50% or less.

As shown in FIG. 3D, an emitting direction of a designated point of the first portion 100*p*1 and an emitting direction of a symmetric point of the second portion 100*p*2 symmetric to the designated point are symmetric in direction in the side view with respect to the Y-axis. In the embodiment, the emitting direction may be defined as a direction towards which the LED chips face. Since the LED chips face the main lighting face Lm, the emitting direction may also be defined as the normal direction of the main lighting face Lm. For example, the designated point (x1, y1) of the first portion 100*p*1 has an emitting direction ED which is upwardly in FIG. 3D, and the symmetric point (x2, y2) of the second portion 100*p*2 has an emitting direction ED which is upwardly in FIG. 3D. The emitting direction ED of the designated point (x1, y1) and the emitting direction ED of the symmetric point (x2, y2) are symmetric with respect to the Y-axis. In addition, the designated point (x3, y3) of the third portion 100*p*3 has an emitting direction ED towards a lower-left direction in FIG. 3D, and the symmetric point (x4, y4) of the fourth portion 100*p*4 has an emitting direction ED towards a lower-right direction in FIG. 3D. The emitting direction ED of the designated point (x3, y3) and the emitting direction ED of the symmetric point (x4, y4) are symmetric with respect to the Y-axis.

Figure 3E:
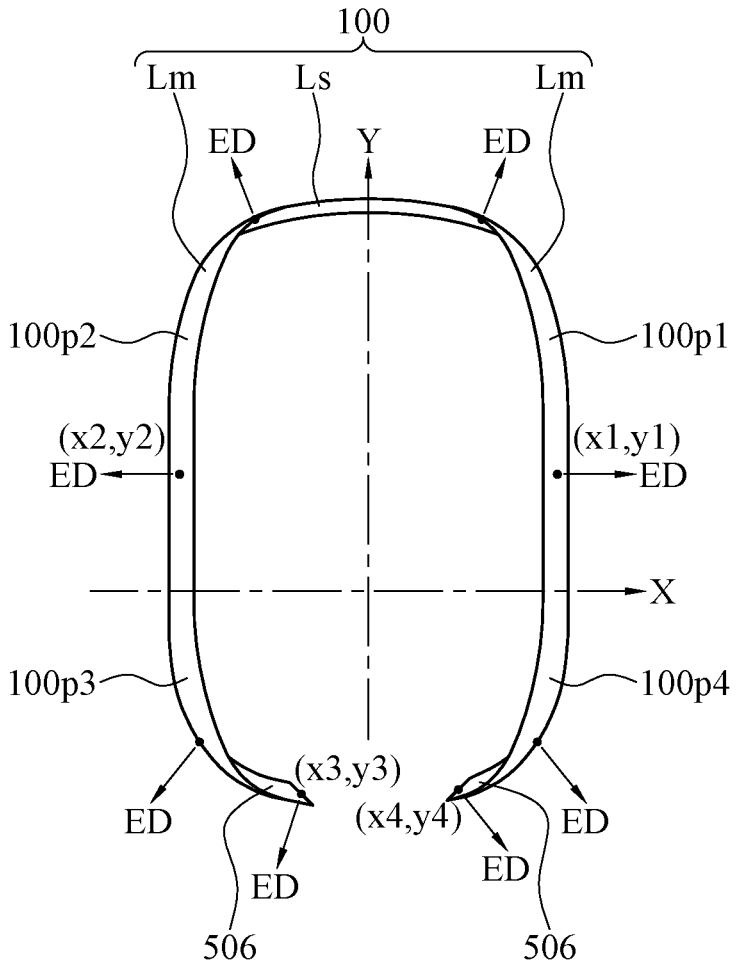
FIG. 3E is the LED filament shown in FIG. 3C presented in two dimensional coordinate system defining four quadrants.

Please refer to FIG. 3E. FIG. 3E is the LED filament 100 shown in FIG. 3C presented in two dimensional coordinate system defining four quadrants. The LED filament 100 in FIG. 3E is the same as that in FIG. 3C, which is a top view of the LED light bulb 20*d* shown in FIG. 3A. As shown in FIG. 3C and FIG. 3E, the origin of the four quadrants is defined as a center of a stand 19*a* of the LED light bulb 20*d* in the top view (e.g., a center of the top of the stand 19*a* shown in FIG. 3A). In the embodiment, the Y-axis is vertical, and the X-axis is horizontal in FIG. 3E. As shown in FIG. 3E, the LED filament 100 in the top view can be divided into a first portion 100*p*1, a second portion 100*p*2, a third portion 100*p*3, and a fourth portion 100*p*4 by the X-axis and the Y-axis. The first portion 100*p*1 of the LED filament 100 is the portion presented in the first quadrant in the top view. The second portion 100*p*2 of the LED filament 100 is the portion presented in the second quadrant in the top view. The third portion 100*p*3 of the LED filament 100 is the portion presented in the third quadrant in the top view. The fourth portion 100*p*4 of the LED filament 100 is the portion presented in the fourth quadrant in the top view.

In some embodiments, the LED filament 100 in the top view may be symmetric in point symmetry (being symmetric with the origin of the four quadrants) or in line symmetry (being symmetric with one of the two axis the four quadrants). In the embodiment, as shown in FIG. 3E, the LED filament 100 in the top view is in line symmetry. In particular, the LED filament 100 in the top view is symmetric with the Y-axis. That is to say, the geometric shape of the first portion 100*p*1 and the fourth portion 100*p*4 are symmetric with that of the second portion 100*p*2 and the third portion 100*p*3. Specifically, the first portion 100*p*1 is symmetric to the second portion 100*p*2 in the top view. Particularly, the first portion 100*p*1 and the second portion 100*p*2 are symmetric in structure in the top view with respect to the Y-axis. In addition, the third portion 100*p*3 is symmetric to the fourth portion 100*p*4 in the top view. Particularly, the third portion 100*p*3 and the fourth portion 100*p*4 are symmetric in structure in the top view with respect to the Y-axis.

Based upon symmetry characteristic of LED filament 100, the structures of the two symmetric portions of the LED filament 100 in the top view (the first portion 100*p*1 and the second portion 100*p*2 or the third portion 100*p*3 and the fourth portion 100*p*4) may be exactly symmetric or be symmetric with a tolerance in structure. The tolerance (or a permissible error) between the structures of the two symmetric portions of the LED filament 100 in the top view may be 20%-50% or less.

For example, as shown in FIG. 3E, a designated point (x1, y1) on the first portion 100*p*1 of the LED filament 100 in the first quadrant is defined as a first position, and a symmetric point (x2, y2) on the second portion 100*p*2 of the LED filament 100 in the second quadrant is defined as a second position. The second position of the symmetric point (x2, y2) is symmetric to the first position of the designated point (x1, y1) with respect to the Y-axis. The first position and the second position may be exactly symmetric or be symmetric with 20%-50% difference. In the embodiment, the first portion 100*p*1 and the second portion 100*p*2 are exactly symmetric in structure. In other words, x2 of the symmetric point (x2, y2) is equal to negative x1 of the designated point (x1, y1), and y2 of the symmetric point (x2, y2) is equal to y1 of the designated point (x1, y1).

For example, as shown in FIG. 3E, a designated point (x3, y3) on the third portion 100*p*3 of the LED filament 100 in the third quadrant is defined as a third position, and a symmetric point (x4, y4) on the fourth portion 100*p*4 of the LED filament 100 in the fourth quadrant is defined as a fourth position. The fourth position of the symmetric point (x4, y4) is symmetric to the third position of the designated point (x3, y3) with respect to the Y-axis. The third position and the fourth position may be exactly symmetric or be symmetric with 20%-50% difference. In the embodiment, the third portion 100*p*3 and the fourth portion 100*p*4 are symmetric with a tolerance (e.g., a difference in coordinates being less than 20%) in structure. In other words, x4 of the symmetric point (x4, y4) is unequal to negative x3 of the designated point (x3, y3), and y4 of the symmetric point (x4, y4) is unequal to y3 of the designated point (x3, y3). As shown in FIG. 3E, the level of the designated point (x3, y3) is slightly lower than that of the symmetric point (x4, y4), and the designated point (x3, y3) is slightly closer to the Y-axis than the symmetric point (x4, y4) is. Accordingly, the absolute value of y4 is slightly less than that of y3, and the absolute value of x4 is slightly greater than that of x3.

As shown in FIG. 3E, a length of the first portion 100*p*1 of the LED filament 100 in the first quadrant in the top view is substantially equal to a length of the second portion 100*p*2 of the LED filament 100 in the second quadrant in the top view. In the embodiment, the length is defined along an elongated direction of the LED filament 100 in a plane view (e.g., a top view, a front view, or a top view). For example, the second portion 100*p*2 elongates in the second quadrant in the top view shown in FIG. 3E to form a reversed "L" shape with two ends respectively contacting the X-axis and the Y-axis, and the length of the second portion 100*p*2 is defined along the reversed "L" shape.

In addition, a length of the third portion 100*p*3 of the LED filament 100 in the third quadrant in the top view is substantially equal to a length of fourth portion 100*p*4 of the LED filament 100 in the fourth quadrant in the top view. Since the third portion 100*p*3 and the fourth portion 100*p*4 are symmetric with respect to the Y-axis with a tolerance in structure, there may be a slightly difference between the length of the third portion 100*p*3 and the length of fourth portion 100*p*4. The difference may be 20%-50% or less.

As shown in FIG. 3E, an emitting direction of a designated point of the first portion 100*p*1 and an emitting direction of a symmetric point of the second portion 100*p*2 symmetric to the designated point are symmetric in direction in the top view with respect to the Y-axis. In the embodiment, the emitting direction may be defined as a direction towards which the LED chips face. Since the LED chips face the main lighting face Lm, the emitting direction may also be defined as the normal direction of the main lighting face Lm. For example, the designated point (x1, y1) of the first portion 100*p*1 has an emitting direction ED towards right in FIG. 3E, and the symmetric point (x2, y2) of the second portion 100*p*2 has an emitting direction ED towards left in FIG. 3E. The emitting direction ED of the designated point (x1, y1) and the emitting direction ED of the symmetric point (x2, y2) are symmetric with respect to the Y-axis. In addition, the designated point (x3, y3) of the third portion 100*p*3 has an emitting direction ED towards a lower-left direction in FIG. 3E, and the symmetric point (x4, y4) of the fourth portion 100*p*4 has an emitting direction ED towards a lower-right direction in FIG. 3E. The emitting direction ED of the designated point (x3, y3) and the emitting direction ED of the symmetric point (x4, y4) are symmetric with respect to the Y-axis. In addition, an emitting direction ED of any designated point of the first portion 100*p*1 and an emitting direction ED of a corresponding symmetric point of the second portion 100*p*2 symmetric to the designated point are symmetric in direction in the top view with respect to the Y-axis. An emitting direction ED of any designated point of the third portion 100*p*3 and an emitting direction ED of a corresponding symmetric point of the fourth portion 100*p*4 symmetric to the designated point are symmetric in direction in the top view with respect to the Y-axis.

Figure 3F:
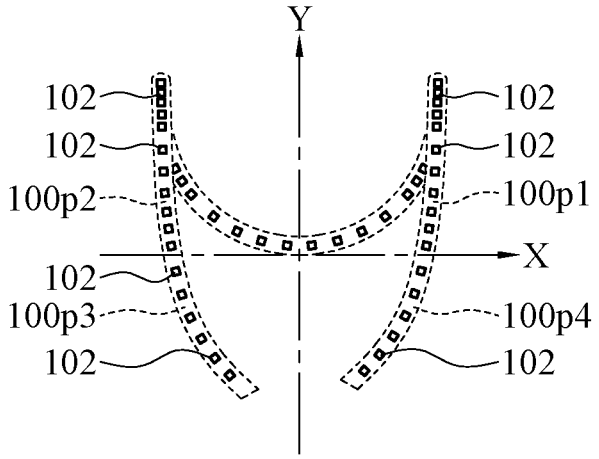
FIG. 3F is the LED filament shown in FIG. 3B presented in two dimensional coordinate system defining four quadrants showing arrangements of LED chips according to an embodiment of the present invention.

Please refer to FIG. 3F. FIG. 3F is the LED filament 100 shown in FIG. 3B presented in two dimensional coordinate system defining four quadrants showing arrangements of LED chips 102 according to an embodiment of the present invention. As shown in FIG. 3F, an arrangement of the LED chips 102 in the first portion 100*p*1 in the first quadrant in the side view is symmetric with an arrangement of LED chips 102 in the second portion 100*p*2 in the second quadrant in the side view, and an arrangement of the LED chips 102 in the third portion 100*p*3 in the third quadrant in the side view is symmetric with an arrangement of LED chips 102 in the fourth portion 100*p*4 in the fourth quadrant in the side view.

In the embodiment, the arrangement of the LED chips 102 may be referred to a density variation (or a concentration variation) of the LED chips 102 on the axial direction of the LED filament 100. As shown in FIG. 3F, the density of the LED chips 102 in the first portion 100*p*1 and the second portion 100*p*2 gradually increase from a side close to the X-axis to a side away from the X-axis, and the density of the LED chips 102 in the third portion 100*p*3 and the fourth portion 100*p*4 gradually decrease from a side close to the X-axis to a side away from the X-axis. Based upon the symmetric characteristic of the arrangement of LED chips 102, the illumination of the LED light bulb (as shown in FIG. 3A) along a direction from the LED filament 100 towards the top of the LED light bulb would be brighter than other directions while the effect of the illumination is still even due to the symmetry characteristics.

In some embodiments, the density of the LED chips 102 of the LED filament 100 may increase from the middle of the LED filament 100 towards the conductive electrodes 506. The conductive electrode 506 is a relative large metal component larger than the LED chip 102 and is with higher thermal conductivity. Moreover, a part of the conductive electrode 506 is exposed from the enclosure of the LED filament 100 and is connected to another metal support outside the LED filament 100, e.g., the conductive supports 51*a*, 51*b*. While the density of the LED chips 102 in the portion of the LED filament 100 closer to the conductive electrode 506 is higher than that of the LED chips 102 in another portion of the LED filament 100, the portion of the LED filament 100 closer to the conductive electrode 506 may generate more heat accordingly. In such case, the conductive electrodes 506 are benefit to dissipate heat generated by the LED chips 102 with higher density.

In some embodiments, whether the density of the LED chips 102 of the LED filament 100 on the axial direction of the LED filament 100 is identically arranged (with the same density all over the LED filament 100) or is in not identically arranged (as shown in FIG. 3F), the LED chips 102 may have different power, and a power configuration of the LED chips 102 may be symmetric in the side view.

For example, as shown in FIG. 3D, the LED chip 102 located at (x1, y1) may have a first power, and the LED chip 102 located at (x2, y2) may have a second power. The first power may be equal to the second power (e.g., 0.5 W). The LED chip 102 located at (x3, y3) may have a third power, and the LED chip 102 located at (x4, y4) may have a fourth power. The third power may be equal to the fourth power (e.g., 0.25 W). The power configuration of the LED chips 102 of the first portion 100*p*1 is symmetric with the power configuration of the LED chips 102 of the second portion 100*p*2, which means that the power of the LED chips 102 in the first portion 100*p*1 or in the second portion 100*p*2 may be not identical, but the power of the LED chip 102 at a designated point in the first portion 100*p*1 would be equal to that of the LED chip 102 at a corresponding symmetric point in the second portion 100*p*2. Analogously, the power configuration of the LED chips 102 of the third portion 100*p*3 is symmetric with the power configuration of the LED chips 102 of the fourth portion 100*p*4.

In some embodiments, the LED chips 102 with higher power may be configured to be close to the conductive electrodes 506 for better heat dissipation since the high power LED chips 102 would generate considerable heat.

Figure 3G:
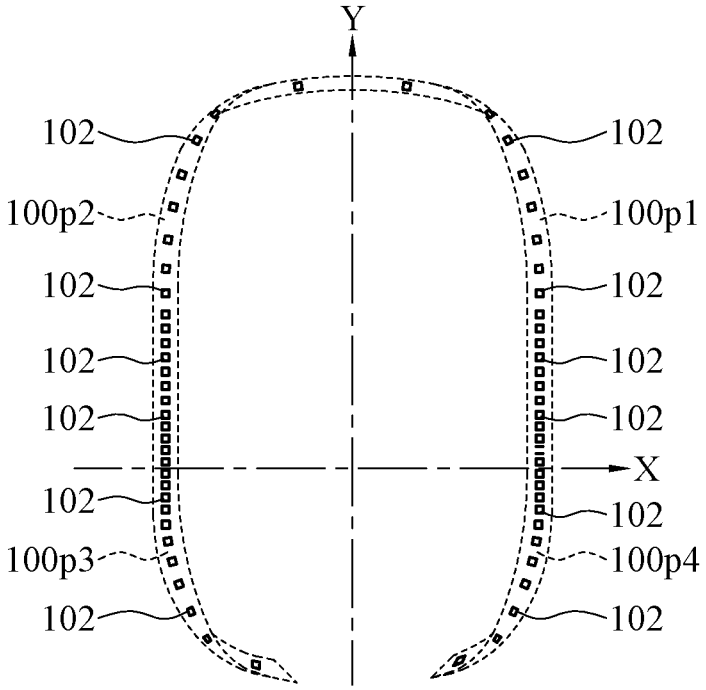
FIG. 3G is the LED filament shown in FIG. 3C presented in two dimensional coordinate system defining four quadrants showing arrangements of LED chips according to an embodiment of the present invention.

Please refer to FIG. 3G FIG. 3G is the LED filament shown in FIG. 3C presented in two dimensional coordinate system defining four quadrants showing arrangements of LED chips according to an embodiment of the present invention. As shown in FIG. 3G, an arrangement of LED chips 102 in the first portion 100*p*1 of the LED filament 100 in the first quadrant (e.g., a density variation of the LED chips in the portion of the LED filament 100 in the first quadrant) in the top view is symmetric with an arrangement of LED chips 102 in the second portion 100*p*2 of the LED filament 100 in the second quadrant, and an arrangement of LED chips 102 in the third portion 100*p*3 of the LED filament 100 in the third quadrant in the top view is symmetric with an arrangement of LED chips 102 in the fourth portion 100*p*4 of the LED filament 100 in the fourth quadrant.

In some embodiments, as the above discussion, whether the density of the LED chips 102 of the LED filament 100 on the axial direction of the LED filament 100 is identically arranged (with the same density all over the LED filament 100) or is in not identically arranged (as shown in FIG. 3G), the LED chips 102 may have different power, and a power configuration of the LED chips 102 may be symmetric in the top view.

Figure 3H:
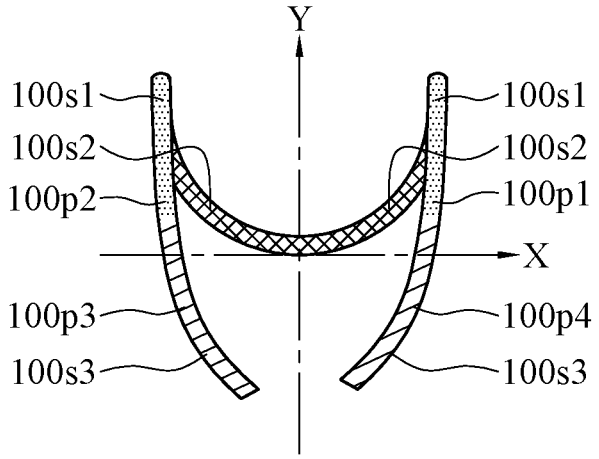
FIG. 3H is the LED filament shown in FIG. 3B presented in two dimensional coordinate system defining four quadrants showing segments of the LED filament according to an embodiment of the present invention.

Please refer to FIG. 3H. FIG. 3H is the LED filament shown in FIG. 3B presented in two dimensional coordinate system defining four quadrants showing segments of the LED filament according to an embodiment of the present invention. The LED filament 100 may be divided into segments by distinct refractive indexes. In other words, the segments of the LED filament 100 are defined by their distinct refractive indexes. In the embodiment, the LED filament 100 is divided into two first segments 100*s*1, a second segment 100*s*2, and two third segments 100*s*3. The second segment 100*s*2 is in the middle of the LED filament 100, the two third segments 100*s*3 are respectively at two ends of the LED filament 100, and the two first segments 100*s*1 are respectively between the second segment 100*s*2 and the two third segments 100*s*3. In particular, the enclosures (e.g., phosphor glue layers) of the first segment 100*s*1, the second segment 100*s*2, and the third segment 100*s*3 may be different from one another in composition and may have distinct refractive indexes, respectively.

For example, the enclosures of the first segments 100*s*1 have a first refractive index, the enclosure of the second segment 100*s*2 has a second refractive index, and the enclosures of the third segments 100*s*3 have a third refractive index. The first refractive index, the second refractive index, and the third refractive index are different from one another; therefore, the amount and the emitting direction of light rays from the first segment 100*s*1, the second segment 100*s*2, and the third segment 100*s*3 are accordingly different from one another. Consequently, the brightness of presented by the first segment 100*s*1, the second segment 100*s*2, and the third segment 100*s*3 of the LED filament 100 are different from one another while the LED filament operates.

As shown in FIG. 3H, in the embodiment, the refractive indexes of the segments of the first portion 100*p*1 (including one of the first segments 100*s*1, half of the second segment 100*s*2, and a part of one of the third segments 100*s*3) of the LED filament 100 in the first quadrant in the side view are symmetric with the refractive indexes of the segments of second portion 100*p*2 (including the other one of the first segments 100*s*1, the other half of the second segment 100*s*2, and a part of the other one of the third segments 100*s*3) of the LED filament 100 in the second quadrant in the side view, and the refractive indexes of the segments of the third portion 100*p*3 (including a part of one of the third segments 100*s*3) of the LED filament 100 in the third quadrant in the side view are symmetric with the refractive indexes of the segments of the fourth portion 100*p*4 (including a part of the other one of the third segments 100s3) of the LED filament 100 in the fourth quadrant in the side view.

As shown in FIG. 3H, in another embodiment, the LED filament 100 may be divided into segments by distinct surface roughness. In other words, the segments of the LED filament 100 are defined by their distinct surface roughness of the outer surface of the enclosure (e.g., phosphor glue layers) of the LED filament 100. In particular, the enclosures of the first segment 100s1, the second segment 100s2, and the third segment 100s3 respectively have distinct surface roughness.

For example, the outer surfaces of the enclosures of the first segments 100s1 have a first surface roughness, the outer surface of the enclosure of the second segment 100s2 has a second surface roughness, and the outer surfaces of the enclosures of the third segments 100s3 have a third surface roughness. The first surface roughness, the second surface roughness, and the third surface roughness are different from one another; therefore, the distribution and the emitting direction of light rays from the first segment 100s1, the second segment 100s2, and the third segment 100s3 are accordingly different from one another. Consequently, the brightness of presented by the first segment 100s1, the second segment 100s2, and the third segment 100s3 of the LED filament 100 are different from one another while the LED filament operates.

As shown in FIG. 3H, in another embodiment, the surface roughness of the segments of the first portion 100p1 (including one of the first segments 100s1, half of the second segment 100s2, and a part of one of the third segments 100s3) of the LED filament 100 in the first quadrant in the side view are symmetric with the surface roughness of the segments of second portion 100p2 (including the other one of the first segments 100s1, the other half of the second segment 100s2, and a part of the other one of the third segments 100s3) of the LED filament 100 in the second quadrant in the side view, and the surface roughness of the segments of the third portion 100p3 (including a part of one of the third segments 100s3) of the LED filament 100 in the third quadrant in the side view are symmetric with the surface roughness of the segments of the fourth portion 100p4 (including a part of the other one of the third segments 100s3) of the LED filament 100 in the fourth quadrant in the side view.

Figure 3I:
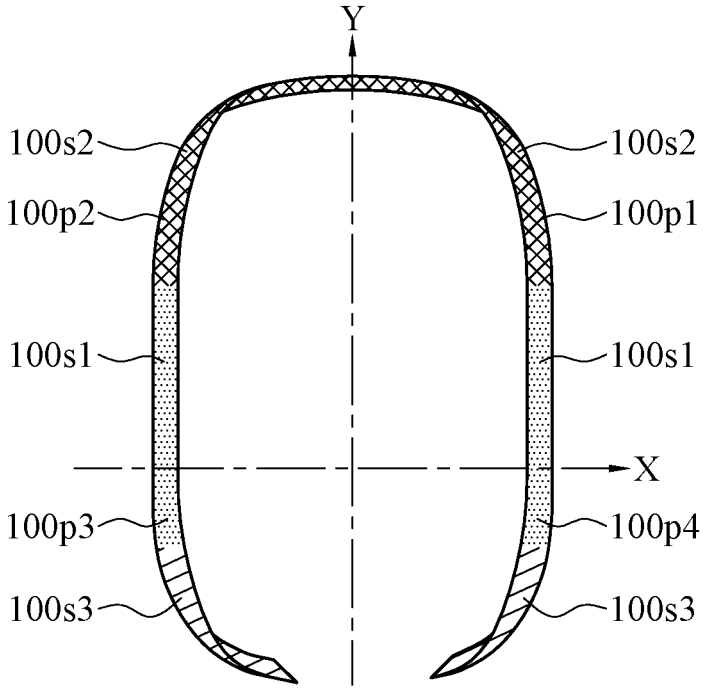
FIG. 3I is the LED filament shown in FIG. 3C presented in two dimensional coordinate system defining four quadrants showing segments of the LED filament according to an embodiment of the present invention.

Please refer to FIG. 3I. FIG. 3I is the LED filament shown in FIG. 3C presented in two dimensional coordinate system defining four quadrants showing segments of the LED filament according to an embodiment of the present invention. As shown in FIG. 3I, in the embodiment, the refractive indexes of the segments of the first portion 100p1 (including a part of one of the first segments 100s1 and half of the second segment 100s2) of the LED filament 100 in the first quadrant in the top view are symmetric with the refractive indexes of the segments of second portion 100p2 (including a part of the other one of the first segments 100s1 and the other half of second segment 100s2) of the LED filament 100 in the second quadrant in the top view, and the refractive indexes of the segments of the third portion 100p3 (including a part of one of the first segments 100s1 and one of the third segments 100s3) of the LED filament 100 in the third quadrant in the top view are symmetric with the refractive indexes of the segments of the fourth portion 100p4 (including a part of the other one of the first segments 100s1 and the other one of the third segments 100s3) of the LED filament 100 in the fourth quadrant in the top view.

As shown in FIG. 3I, in another embodiment, the surface roughness of the segments of the first portion 100p1 (including a part of one of the first segments 100s1 and half of the second segment 100s2) of the LED filament 100 in the first quadrant in the top view are symmetric with the surface roughness of the segments of second portion 100p2 (including a part of the other one of the first segments 100s1 and the other half of second segment 100s2) of the LED filament 100 in the second quadrant in the top view, and the surface roughness of the segments of the third portion 100p3 (including a part of one of the first segments 100s1 and one of the third segments 100s3) of the LED filament 100 in the third quadrant in the top view are symmetric with the surface roughness of the segments of the fourth portion 100p4 (including a part of the other one of the first segments 100s1 and the other one of the third segments 100s3) of the LED filament 100 in the fourth quadrant in the top view.

As above discussion of the embodiments, the symmetry characteristic regarding the symmetric structure, the symmetric emitting direction, the symmetric arrangement of the LED chips 102, the symmetric power configuration of the LED chips 102, the symmetric refractive indexes, and/or the symmetric surface roughness of the LED filament 100 in the side view (including the front view or the rear view) and/or the top view is benefit to create an evenly distributed light rays, such that the LED light bulb with the LED filament 100 is capable of generating an omnidirectional light.

Figure 4A:
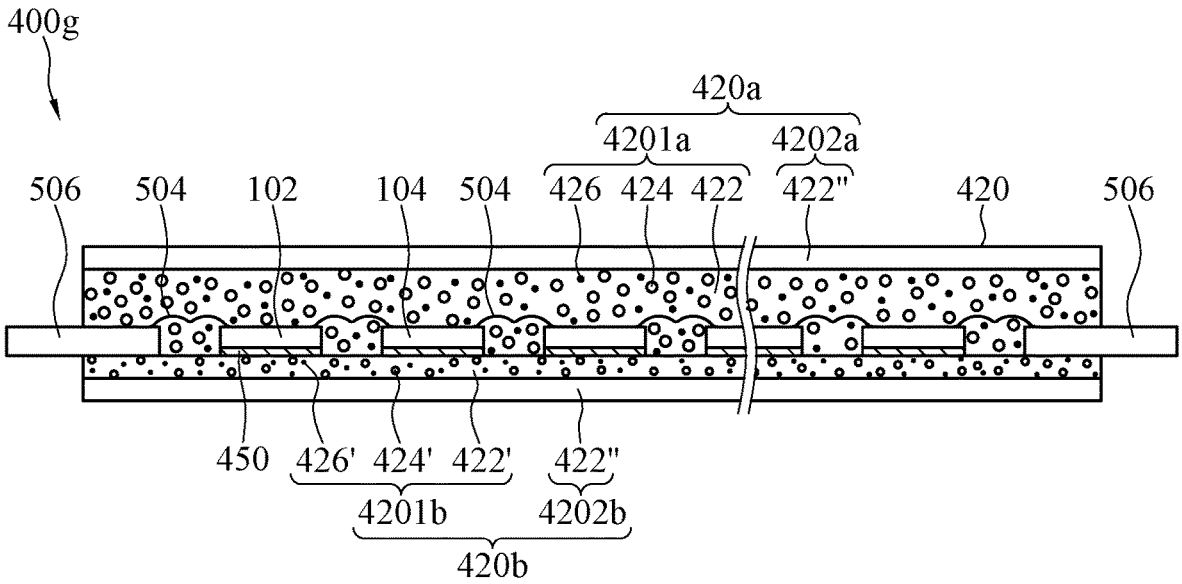
FIG. 4A is a cross-sectional view of an LED filament according to an embodiment of the present disclosure
Figure 4B:
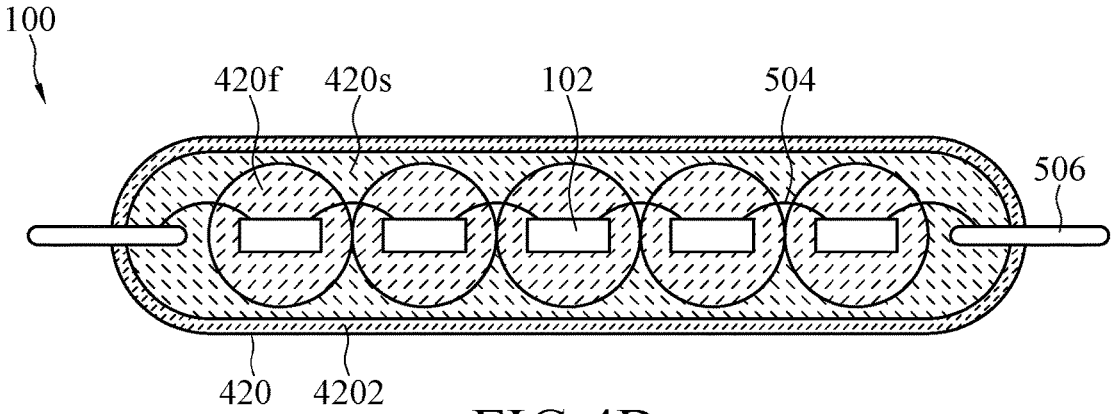
FIG. 4B is a cross sectional view of an LED filament according to an embodiment of the present enclosure.

Please refer to FIG. 4A and FIG. 4B. FIG. 4A illustrates a cross-sectional view of an LED filament 400g according to an embodiment of the present disclosure. FIG. 4B is a cross-sectional view of an LED filament 100 according to an embodiment of the present disclosure. As above description, the refractive indexes or the surface roughness of segments of the LED filaments may be different from one another and can be defined by the enclosures of the segments. That is to say, the compositions of the enclosures or the surface roughness of the outer surface of the enclosures of the segments may be different from one another. In other embodiments, the enclosures of the segments may be identical, and there is an external transparent layer enclosing the entire enclosure of the LED filament to define segments with distinct refractive indexes or surface roughness on the axial direction of the LED filament. The external transparent layer has different refractive indexes or different surface roughness on different portion thereof. The external transparent layer can be referred to the following illustration of FIG. 4A and FIG. 4B.

As shown in FIG. 4A, in the embodiment, the LED filament 400g is analogous to and can be referred to the LED filament 100 comprising the top layer 420a and the base layer 420b. A difference between the LED filament 400g and 100 is that the top layer 420a of the LED filament 400g is further divided into two layers, a phosphor glue layer 4201a and a transparent layer 4202a. The phosphor glue layer 4201a may be the same as the top layer 420a and comprises an adhesive 422, phosphors 424, and inorganic oxide nanoparticles 426. The transparent layer 4202a comprises an adhesive 422" only. The transparent layer 4202a may be of highest transmittance than other layers and can protect the phosphor glue layer 4201a. In some embodiments (not shown), the transparent layer 4202a encloses the phosphor glue layer 4201a, i.e., all sides of the phosphor glue layer 4201a except the one adjacent to the phosphor film layer 4201b are covered by the transparent layer 4202a.

In addition, the base layer 420b of the LED filament 400g is further divided into two layers, a phosphor glue layer 4201b and a transparent layer 4202b. The phosphor glue layer 4201b may be the same as the base layer 420b and comprises an adhesive 422', phosphors 424', and inorganic oxide nanoparticles 426'. The transparent layer 4202*b* comprises an adhesive 422" only. The transparent layer 4202*b* may be of highest transmittance than other layers and can protect the phosphor glue layer 4201*b*. In some embodiments (not shown), the transparent layer 4202*b* encloses the phosphor glue layer 4201*b*, i.e., all sides of the phosphor glue layer 4201*b* except the one adjacent to the phosphor film layer 4201*a* are covered by the transparent layer 4202*b*.

The transparent layers 4202*a*, 4202*b* not only protect the phosphor glue layer 4201*a* and the phosphor film layer 4201*b* but also strengthen the whole structure of the LED filament. Preferably, the transparent layers 4202*a*, 4202*b* may be thermal shrink film with high transmittance.

In some embodiments, the transparent layers 4202*a*, 4202*b* may be analogous to the aforementioned external transparent layer enclosing the entire enclosure (e.g., the phosphor film layers 4201*a*, 4201*b*) of the LED filament 400*g* and defines segments by distinct refractive indexes on the axial direction of the LED filament 400*g*. That is to say, the transparent layers 4202*a*, 4202*b* may have different compositions with different refractive indexes on different portions on the axial direction of the LED filament 400*g*.

As shown in FIG. 4B, in the embodiment, the LED filament 100 configured for emitting omnidirectional light comprises a linear array of LED chips 102 operably interconnected to emit light upon energization; a conductive electrode 506; a plurality of conductive wires 504 for electrically connecting the linear array of LED chips 102 and the conductive electrode 506; and a light conversion coating 420 enclosing the linear array of LED chips 102 and the conductive electrode 506. The light conversion layer 420 includes a first phosphor glue layer 420*f*, a second phosphor glue layer 420*s*, and a transparent layer 4202. The first phosphor glue layer 420*f* includes a linear series of pairwise tangent globular structures. The LED chip 102 is enclosed in a central portion of the first phosphor glue layer 420*f*. The transparent layer 4202 forms an external transparent layer of the LED filament 100. The second phosphor glue layer 420*s* fills the gap between the transparent layer 4202 and the first phosphor glue layer 420*f*. In the embodiment, the second phosphor glue layer 420*s* is made by applying glue and waiting the applied glue solidifying naturally; therefore, an edge of a surface of the second phosphor glue layer 420*s* is declined naturally.

In some embodiments, the transparent layer 4202 may be analogous to the aforementioned external transparent layer enclosing the entire enclosure (the first phosphor glue layer 420*f* and the second phosphor glue layer 420*s*) of the LED filament 100 and defines segments by distinct refractive indexes on the axial direction of the LED filament 100. That is to say, the transparent layer 4202 may have different compositions with different refractive indexes on different portions on the axial direction of the LED filament 100.

In another embodiment, the aforementioned external transparent layer (e.g., the transparent layers 4202*a*, 4202*b* of FIG. 4A and the transparent layer 4202 of FIG. 4B) may be divided into segments on the axial direction of the LED filament by their thickness. The thickness of the external transparent layers of the segments of the LED filaments on the axial direction of the LED filament may be different from one another. The thickness of the external transparent layers of the segments of the LED filaments may be symmetric in the top view or in the side view. The symmetric thickness can be referred to the above discussion regarding the symmetric refractive indexes and the symmetric surface roughness.

Figure 5A:
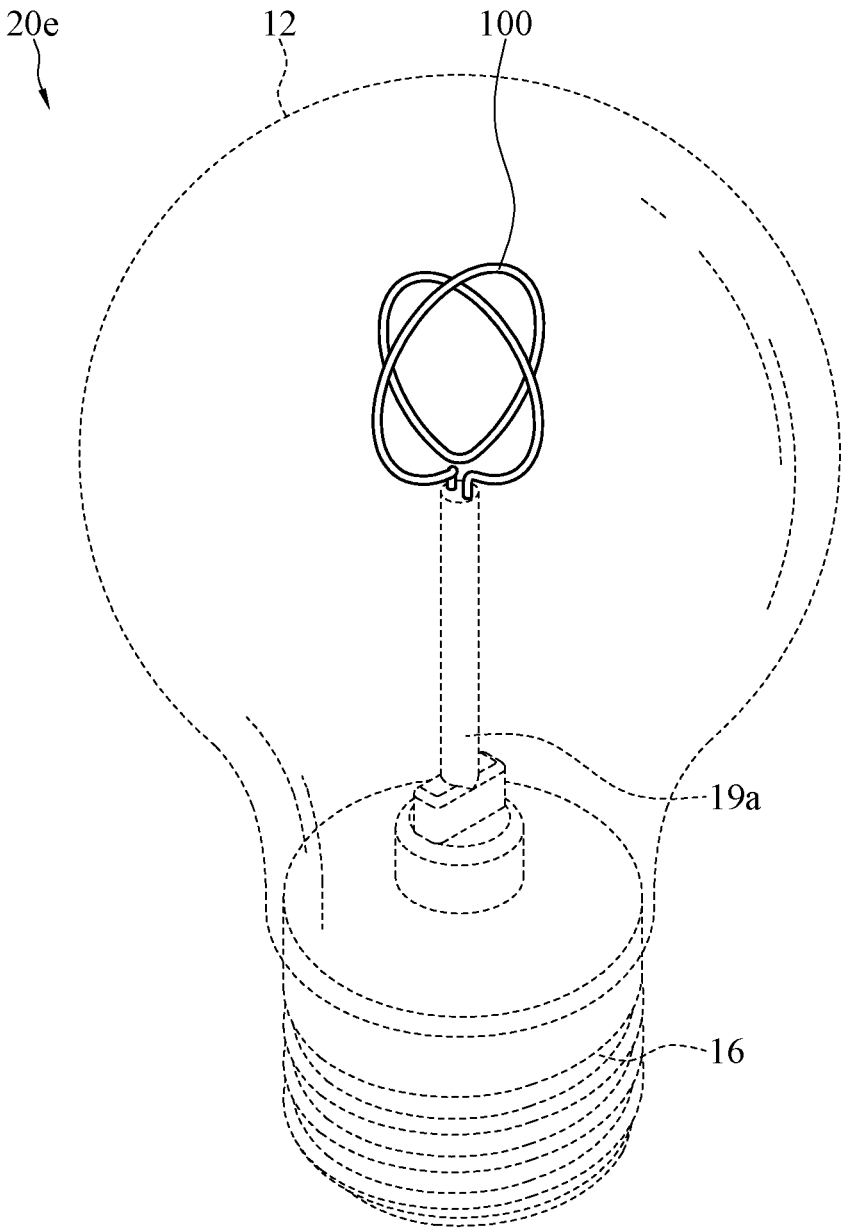
FIG. 5A is a perspective view of an LED light bulb according to an embodiment of the present invention.
Figure 5B:
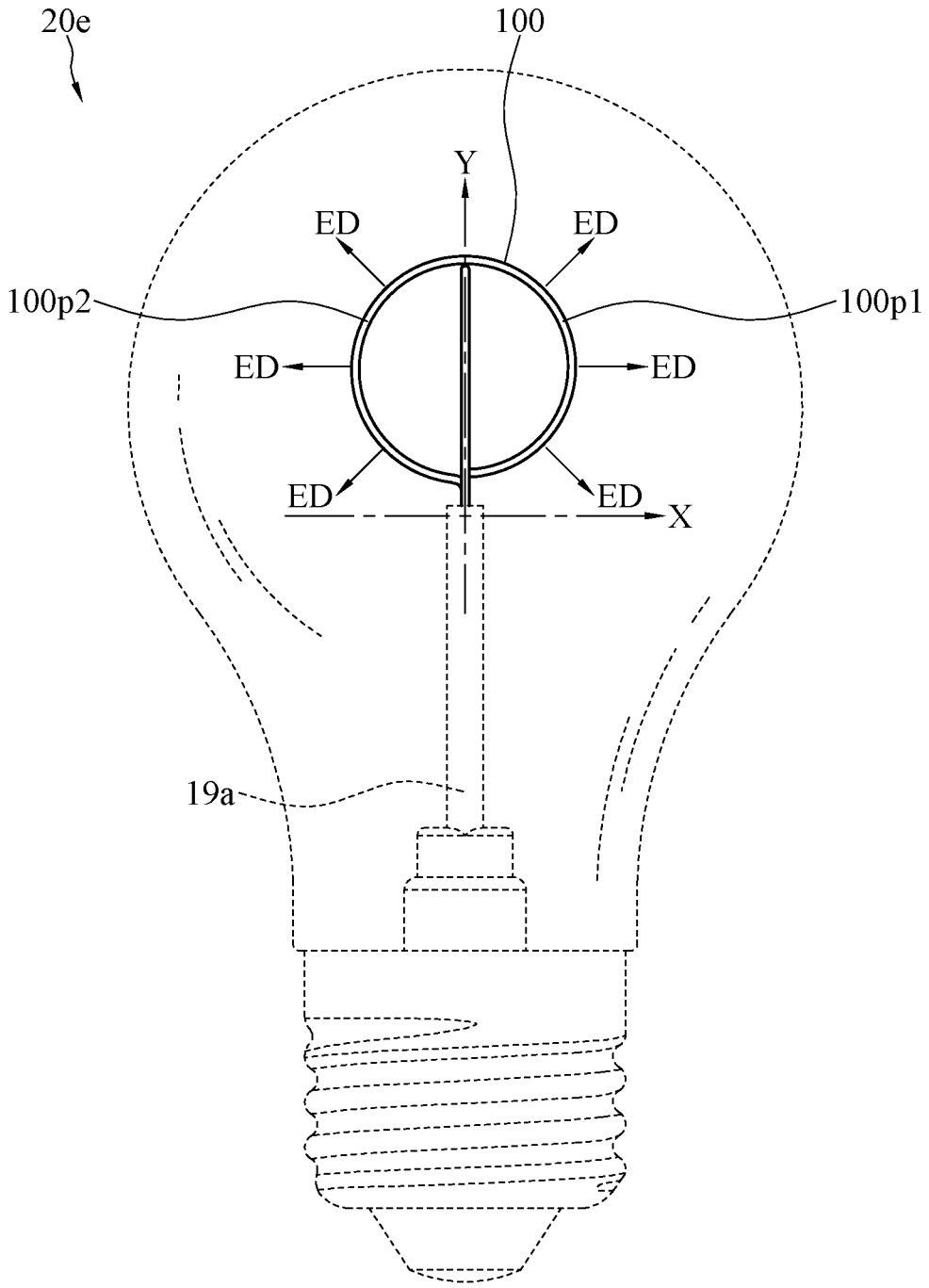
FIG. 5B is a side view of the LED light bulb of FIG. 5A.

Please refer to FIG. 5A and FIG. 5B. FIG. 5A is a perspective view of an LED light bulb 20*e* according to an embodiment of the present invention. FIG. 5B is a side view of the LED light bulb 20*e* of FIG. 5A. The LED light bulb 20*e* shown in FIG. 5A and FIG. 5B is analogous to the LED light bulb 20*d* shown in FIG. 3A. The main difference between the LED light bulb 20*e* and the LED light bulb 20*d* is the LED filament 100. As shown in FIG. 5A, the LED filament 100 of the LED light bulb 20*e* is connected to the top of the stand 19*a* and elongates to form two circles perpendicular to each other. In the embodiment, the LED filament 100 is above the stand 19*a*, and the stand 19*a* (i.e., the stem) is between the bulb base 16 and the LED filament 100.

As shown in FIG. 5B, the LED filament 100 is presented in two dimensional coordinate system defining four quadrants. In the embodiment, the Y-axis is aligned with the stand 19*a*, and the X-axis crosses the stand 19*a*. As shown in FIG. 5B, the LED filament 100 in the side view can be divided into a first portion 100*p*1 and a second portion 100*p*2 by the Y-axis while the LED filament is entirely in the upper quadrants in FIG. 5B. The first portion 100*p*1 of the LED filament 100 is the portion presented in the first quadrant in the side view. The second portion 100*p*2 of the LED filament 100 is the portion presented in the second quadrant in the side view. The LED filament 100 is in line symmetry. The LED filament 100 is symmetric with the Y-axis in the side view. The first portion 100*p*1 and the second portion 100*p*2 are symmetric in structure in the side view with respect to the Y-axis. The first portion 100*p*1 in the side view forms a semicircle shape, and the second portion 100*p*2 in the side view forms a semicircle shape. The first portion 100*p*1 and the second portion 100*p*2 in the side view jointly form a circle shape. In addition, emitting directions ED of the first portion 100*p*1 and emitting directions ED of the second portion 100*p*2 are symmetric in direction in the side view with respect to the Y-axis.

Figure 5C:
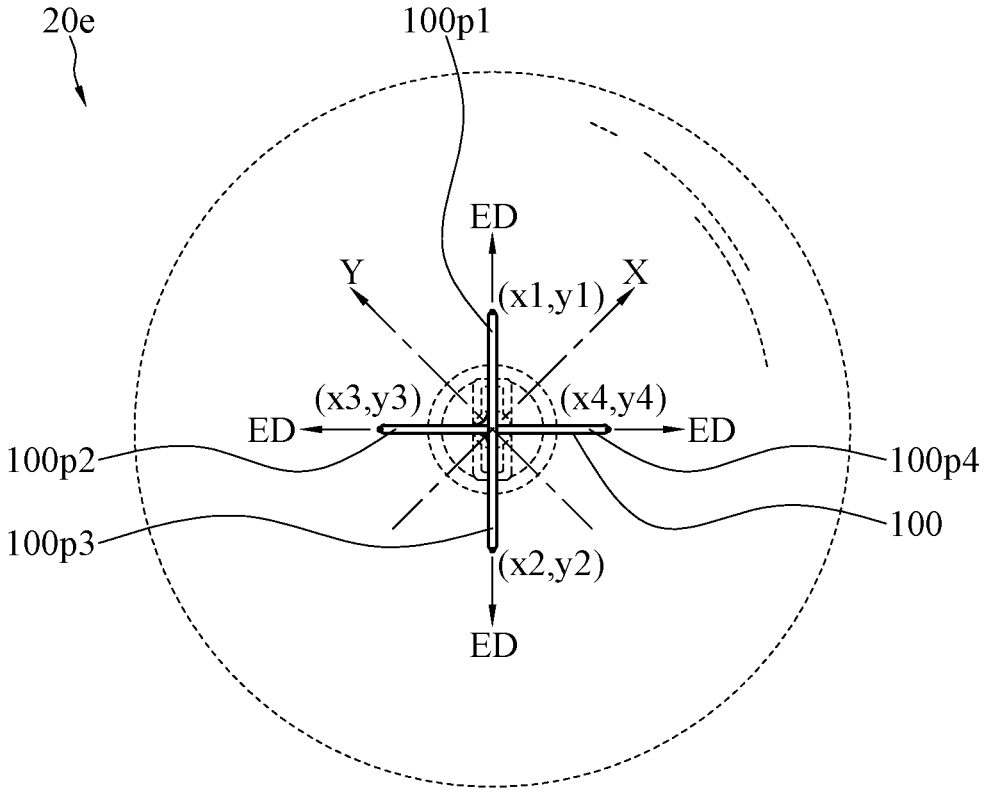
FIG. 5C is a top view of the LED light bulb of FIG. 5A.

Please refer to FIG. 5C. FIG. 5C is a top view of the LED light bulb 20*e* of FIG. 5A. The LED filament 100 shown in FIG. 5C is presented in two dimensional coordinate system defining four quadrants. The origin of the four quadrants is defined as a center of the stand 19*a* of the LED light bulb 20*e* in the top view (e.g., a center of the top of the stand 19*a* shown in FIG. 5A). In the embodiment, the Y-axis is inclined in FIG. 5C, and the X-axis is also inclined in FIG. 5C. As shown in FIG. 5C, the LED filament 100 in the top view can be divided into a first portion 100*p*1, a second portion 100*p*2, a third portion 100*p*3, and a fourth portion 100*p*4 by the X-axis and the Y-axis. The first portion 100*p*1 of the LED filament 100 is the portion presented in the first quadrant in the top view. The second portion 100*p*2 of the LED filament 100 is the portion presented in the second quadrant in the top view. The third portion 100*p*3 of the LED filament 100 is the portion presented in the third quadrant in the top view. The fourth portion 100*p*4 of the LED filament 100 is the portion presented in the fourth quadrant in the top view. In the embodiment, the LED filament 100 in the top view is in point symmetry. In particular, the LED filament 100 in the top view is symmetric with the origin of the four quadrants. In other words, the structure of the LED filament 100 in the top view would be the same as the structure of the LED filament 100 in the top view being rotated about the origin to 180 degrees.

For example, as shown in FIG. 5C, a designated point (x1, y1) on the first portion 100*p*1 of the LED filament 100 in the first quadrant is defined as a first position, and a symmetric point (x2, y2) on the third portion 100*p*3 of the LED filament 100 in the third quadrant is defined as a second position. The second position of the symmetric point (x2, y2) is symmetric to the first position of the designated point (x1, y1) with respect to the origin. In other words, the designated point (x1, y1) on the first portion 100*p*1 of the LED filament 100 in the top view would overlap the symmetric point (x2, y2) on the third portion 100*p*3 of the LED filament 100 in the top view while the LED filament 100 is rotated about the origin to 180 degrees.

For example, as shown in FIG. 5C, a designated point (x3, y3) on the second portion 100*p*2 of the LED filament 100 in the second quadrant is defined as a third position, and a symmetric point (x4, y4) on the fourth portion 100*p*4 of the LED filament 100 in the fourth quadrant is defined as a fourth position. The fourth position of the symmetric point (x4, y4) is symmetric to the third position of the designated point (x3, y3) with respect to the origin. In other words, the designated point (x3, y3) on the second portion 100*p*2 of the LED filament 100 in the top view would overlap the symmetric point (x4, y4) on the fourth portion 100*p*4 of the LED filament 100 in the top view while the LED filament 100 is rotated about the origin to 180 degrees.

In the embodiment, the LED filament 100 in the top view is also symmetric in line symmetry. In particular, the LED filament 100 in the top view is symmetric with the X-axis or the Y-axis. In other words, the first portion 100*p*1 and the second portion 100*p*2 are symmetric with the Y-axis, and the third portion 100*p*3 and the fourth portion 100*p*4 are symmetric with the Y-axis. In addition, the first portion 100*p*1 and the fourth portion 100*p*4 are symmetric with the X-axis, and the second portion 100*p*2 and the third portion 100*p*3 are symmetric with the X-axis. The first portion 100*p*1, the second portion 100*p*2, the third portion 100*p*3, and the fourth portion 100*p*4 jointly form an "X" shape in the top view.

In addition, an emitting direction ED of the designated point (x1, y1) of the first portion 100*p*1 and an emitting direction ED of the symmetric point (x2, y2) of the third portion 100*p*3 are symmetric in direction in the top view with respect to the origin, and an emitting direction ED of the designated point (x3, y3) of the second portion 100*p*2 and an emitting direction ED of the symmetric point (x4, y4) of the fourth portion 100*p*4 are symmetric in direction in the top view with respect to the origin. Further, the emitting direction ED of the first portion 100*p*1 and the emitting direction ED of the second portion 100*p*2 are symmetric in direction in the top view with respect to the Y-axis, and the emitting direction ED of the third portion 100*p*3 and the emitting direction ED of the fourth portion 100*p*4 are symmetric in direction in the top view with respect to the Y-axis. Additionally, the emitting direction ED of the first portion 100*p*1 and the emitting direction ED of the fourth portion 100*p*4 are symmetric in direction in the top view with respect to the X-axis, and the emitting direction ED of the third portion 100*p*3 and the emitting direction ED of the second portion 100*p*2 are symmetric in direction in the top view with respect to the X-axis.

Figure 6A:
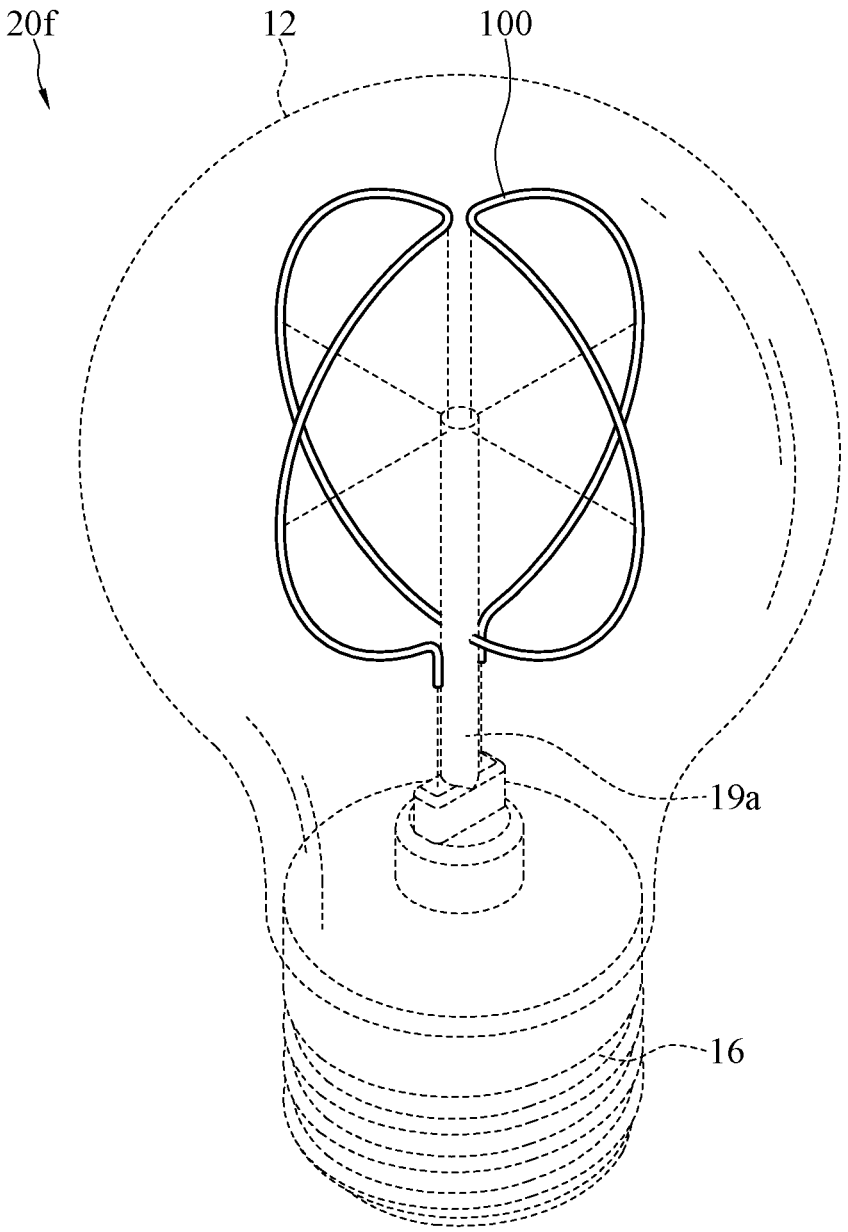
FIG. 6A is a perspective view of an LED light bulb according to an embodiment of the present invention.
Figure 6B:
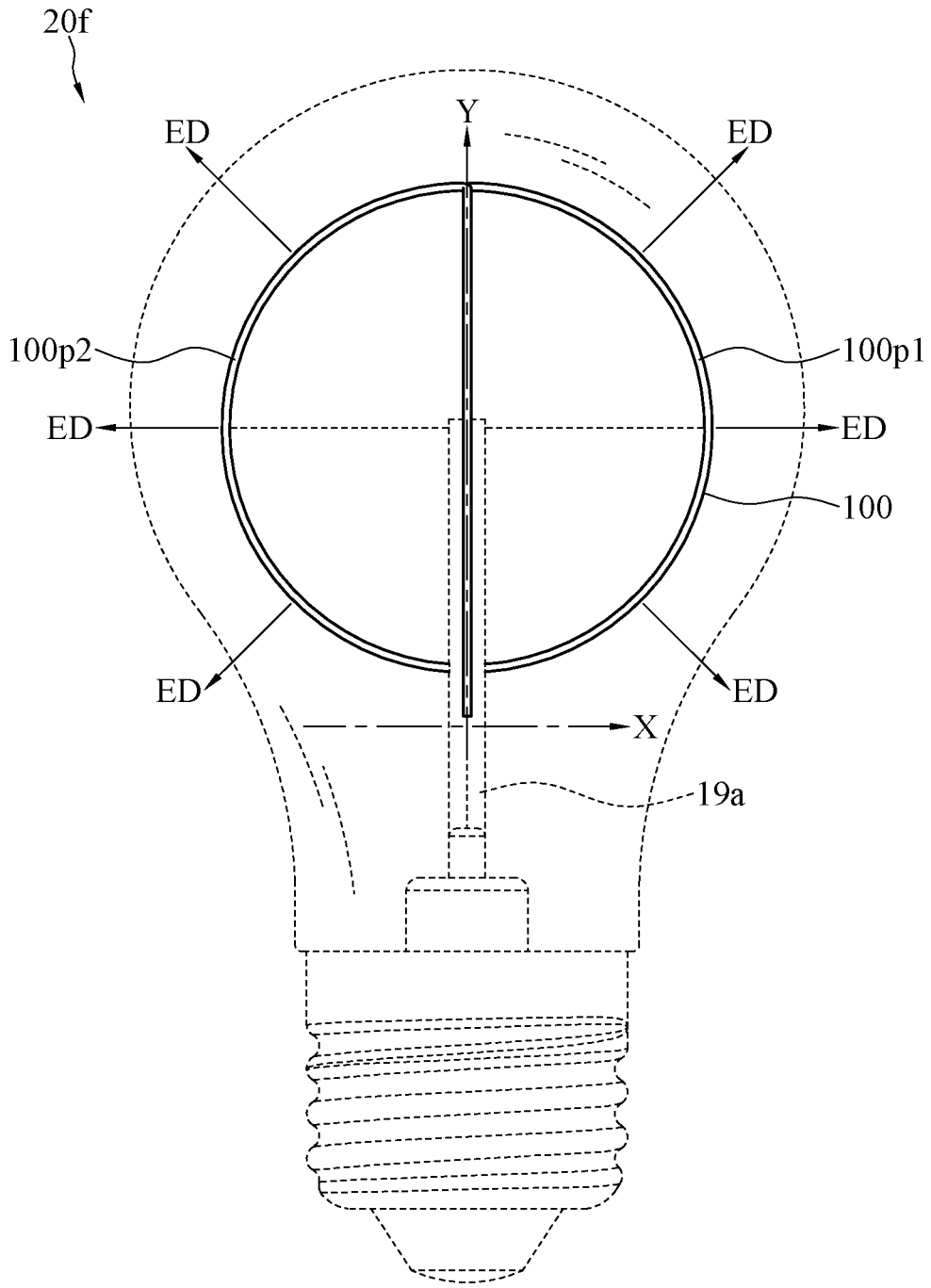
FIG. 6B is a side view of the LED light bulb of FIG. 6A.

Please refer to FIG. 6A and FIG. 6B. FIG. 6A is a perspective view of an LED light bulb 20*f* according to an embodiment of the present invention. FIG. 6B is a side view of the LED light bulb 20*f* of FIG. 6A. The LED light bulb 20*f* shown in FIG. 6A and FIG. 6B is analogous to the LED light bulb 20*d* shown in FIG. 3A. The main difference between the LED light bulb 20*f* and the LED light bulb 20*d* is the LED filament 100. As shown in FIG. 6A, the LED filament 100 of the LED light bulb 20*f* is connected to the stand 19*a* and elongates to form two circles perpendicular to each other (or four semi-circles perpendicular to one another). The LED filament 100 penetrates through the stand 19*a*.

As shown in FIG. 6B, the LED filament 100 is presented in two dimensional coordinate system defining four quadrants. In the embodiment, the Y-axis is aligned with the stand 19*a*, and the X-axis crosses the stand 19*a*. As shown in FIG. 6B, the LED filament 100 in the side view can be divided into a first portion 100*p*1 and a second portion 100*p*2 by the Y-axis. The first portion 100*p*1 of the LED filament 100 is the portion presented in the first quadrant in the side view. The second portion 100*p*2 of the LED filament 100 is the portion presented in the second quadrant in the side view. The LED filament 100 is in line symmetry. The LED filament 100 is symmetric with the Y-axis in the side view. The first portion 100*p*1 and the second portion 100*p*2 are symmetric in structure in the side view with respect to the Y-axis. In addition, emitting directions ED of the first portion 100*p*1 and emitting directions ED of the second portion 100*p*2 are symmetric in direction in the side view with respect to the Y-axis.

Figure 6C:
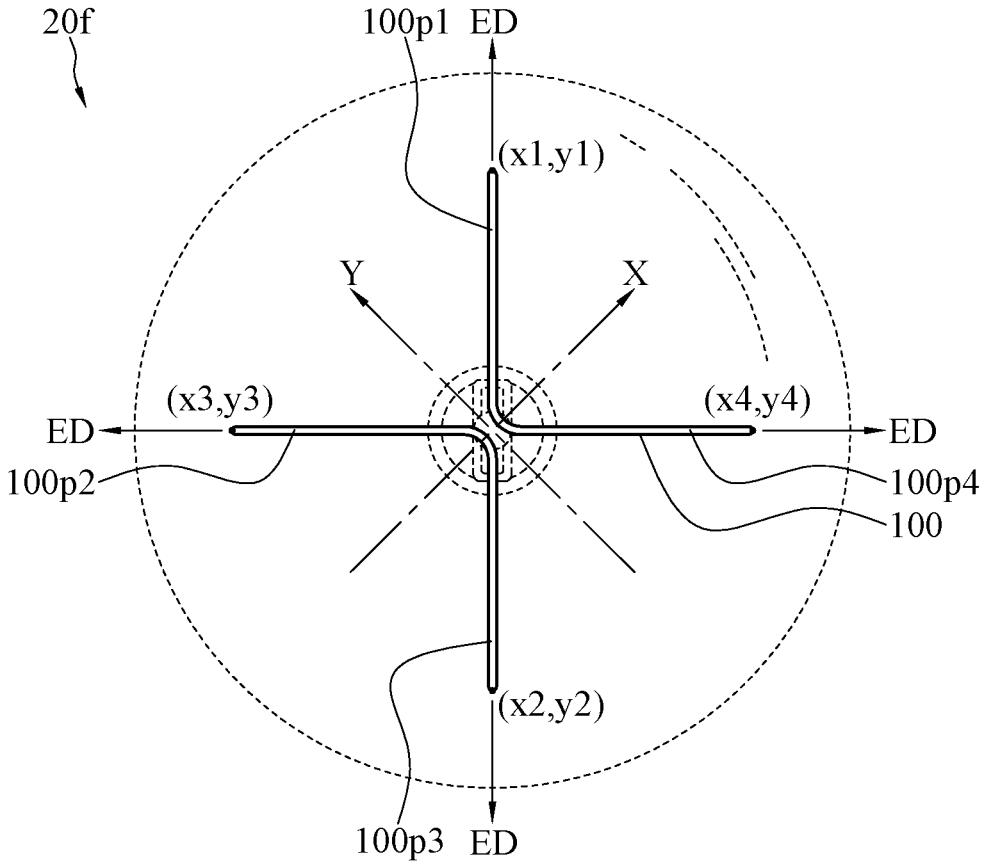
FIG. 6C is a top view of the LED light bulb of FIG. 6A.

Please refer to FIG. 6C. FIG. 6C is a top view of the LED light bulb of FIG. 6A. The LED filament 100 shown in FIG. 6C is presented in two dimensional coordinate system defining four quadrants. The origin of the four quadrants is defined as a center of the stand 19*a* of the LED light bulb 20*f* in the top view (e.g., a center of the top of the stand 19*a* shown in FIG. 6A). In the embodiment, the Y-axis is inclined in FIG. 6C, and the X-axis is also inclined in FIG. 6C. As shown in FIG. 6C, the LED filament 100 in the top view can be divided into a first portion 100*p*1, a second portion 100*p*2, a third portion 100*p*3, and a fourth portion 100*p*4 by the X-axis and the Y-axis. The first portion 100*p*1 of the LED filament 100 is the portion presented in the first quadrant in the top view. The second portion 100*p*2 of the LED filament 100 is the portion presented in the second quadrant in the top view. The third portion 100*p*3 of the LED filament 100 is the portion presented in the third quadrant in the top view. The fourth portion 100*p*4 of the LED filament 100 is the portion presented in the fourth quadrant in the top view. In the embodiment, the LED filament 100 in the top view is in point symmetry. In particular, the LED filament 100 in the top view is symmetric with the origin of the four quadrants. In other words, the structure of the LED filament 100 in the top view would be the same as the structure of the LED filament 100 in the top view being rotated about the origin to 180 degrees.

For example, as shown in FIG. 6C, a designated point (x1, y1) on the first portion 100*p*1 of the LED filament 100 in the first quadrant is defined as a first position, and a symmetric point (x2, y2) on the third portion 100*p*3 of the LED filament 100 in the third quadrant is defined as a second position. The second position of the symmetric point (x2, y2) is symmetric to the first position of the designated point (x1, y1) with respect to the origin. In other words, the designated point (x1, y1) on the first portion 100*p*1 of the LED filament 100 in the top view would overlap the symmetric point (x2, y2) on the third portion 100*p*3 of the LED filament 100 in the top view while the LED filament 100 is rotated about the origin to 180 degrees.

For example, as shown in FIG. 6C, a designated point (x3, y3) on the second portion 100*p*2 of the LED filament 100 in the second quadrant is defined as a third position, and a symmetric point (x4, y4) on the fourth portion 100*p*4 of the LED filament 100 in the fourth quadrant is defined as a fourth position. The fourth position of the symmetric point (x4, y4) is symmetric to the third position of the designated point (x3, y3) with respect to the origin. In other words, the designated point (x3, y3) on the second portion 100*p*2 of the LED filament 100 in the top view would overlap the symmetric point (x4, y4) on the fourth portion 100*p*4 of the LED filament 100 in the top view while the LED filament 100 is rotated about the origin to 180 degrees.

In the embodiment, the LED filament 100 in the top view is also symmetric in line symmetry. In particular, the LED filament 100 in the top view is symmetric with the X-axis or the Y-axis. In other words, the first portion 100*p*1 and the second portion 100*p*2 are symmetric with the Y-axis, and the third portion 100*p*3 and the fourth portion 100*p*4 are symmetric with the Y-axis. In addition, the first portion 100*p*1 and the fourth portion 100*p*4 are symmetric with the X-axis, and the second portion 100*p*2 and the third portion 100*p*3 are symmetric with the X-axis. The first portion 100*p*1 and the fourth portion 100*p*4 jointly form an "L" shape in the top view, and the second portion 100*p*2 and the third portion 100*p*3 jointly form a reversed "L" shape in the top view.

In addition, an emitting direction ED of the designated point (x1, y1) of the first portion 100*p*1 and an emitting direction ED of the symmetric point (x2, y2) of the third portion 100*p*3 are symmetric in direction in the top view with respect to the origin, and an emitting direction ED of the designated point (x3, y3) of the second portion 100*p*2 and an emitting direction ED of the symmetric point (x4, y4) of the fourth portion 100*p*4 are symmetric in direction in the top view with respect to the origin. Further, the emitting direction ED of the first portion 100*p*1 and the emitting direction ED of the second portion 100*p*2 are symmetric in direction in the top view with respect to the Y-axis, and the emitting direction ED of the third portion 100*p*3 and the emitting direction ED of the fourth portion 100*p*4 are symmetric in direction in the top view with respect to the Y-axis. Additionally, the emitting direction ED of the first portion 100*p*1 and the emitting direction ED of the fourth portion 100*p*4 are symmetric in direction in the top view with respect to the X-axis, and the emitting direction ED of the third portion 100*p*3 and the emitting direction ED of the second portion 100*p*2 are symmetric in direction in the top view with respect to the X-axis.

Figure 7A:
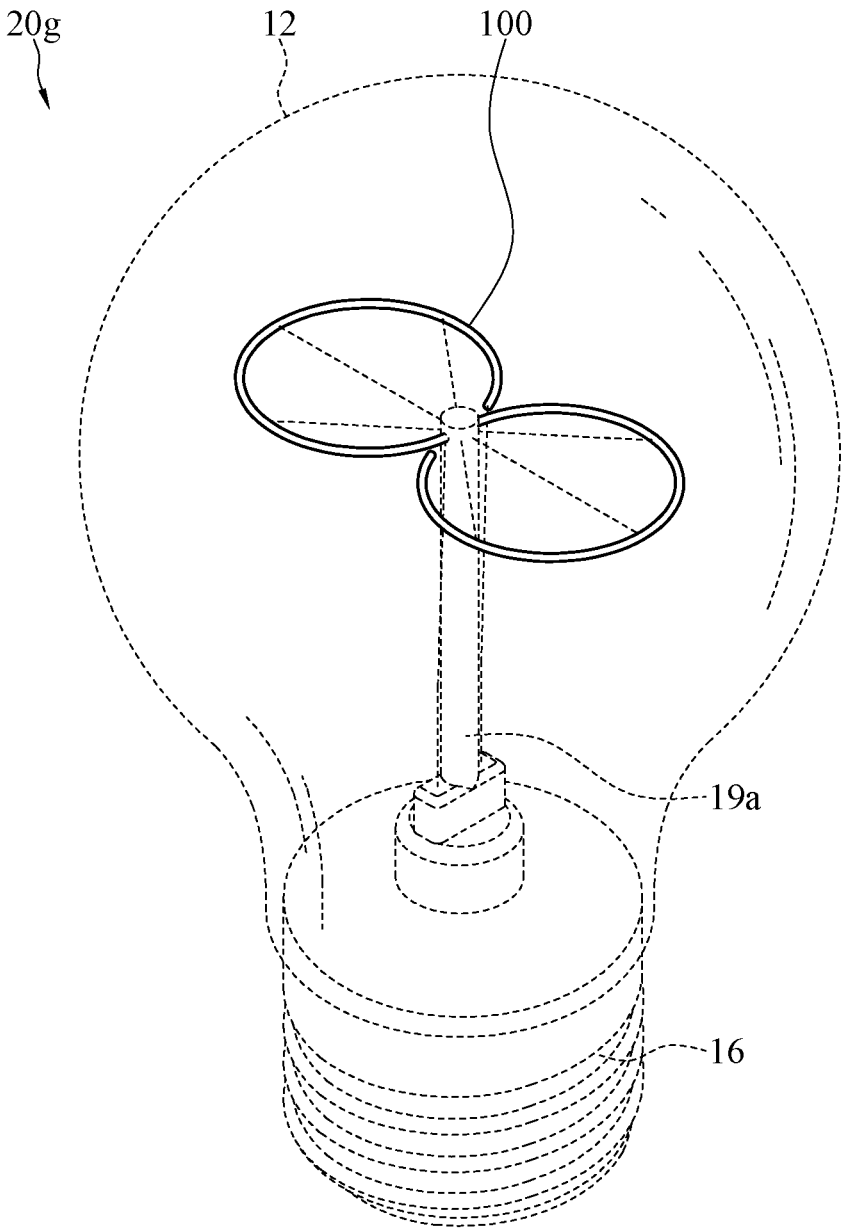
FIG. 7A is a perspective view of an LED light bulb according to an embodiment of the present invention.
Figure 7B:
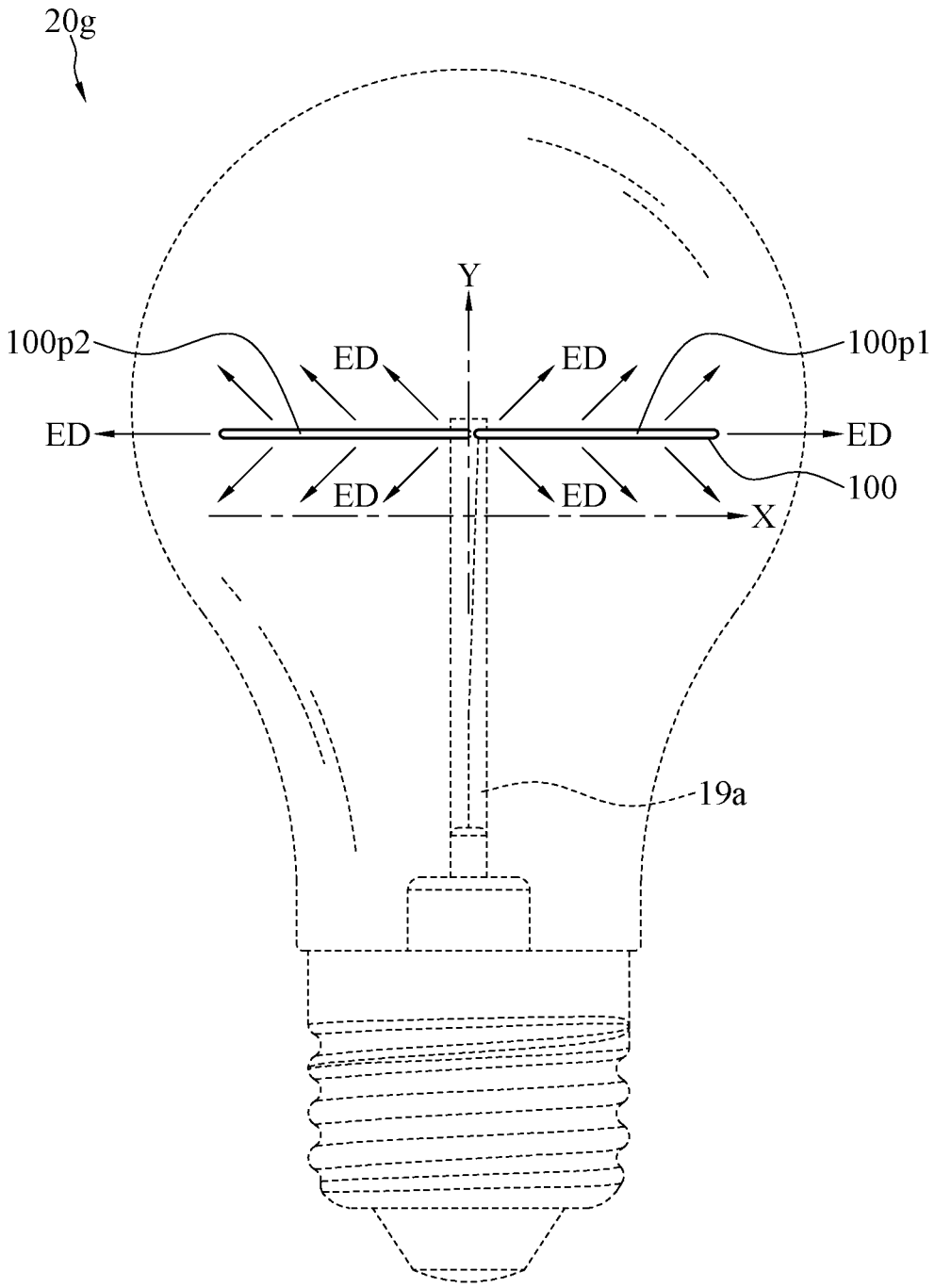
FIG. 7B is a side view of the LED light bulb of FIG. 7A.

Please refer to FIG. 7A and FIG. 7B. FIG. 7A is a perspective view of an LED light bulb 20*g* according to an embodiment of the present invention. FIG. 7B is a side view of the LED light bulb 20*g* of FIG. 7A. The LED light bulb 20*g* shown in FIG. 7A and FIG. 7B is analogous to the LED light bulb 20*d* shown in FIG. 3A. The main difference between the LED light bulb 20*g* and the LED light bulb 20*d* is the LED filament 100. As shown in FIG. 7A, the LED filament 100 of the LED light bulb 20*g* is connected to a top portion of the stand 19*a* and elongates to form two circles in a plane. The two circles formed by the LED filament 100 are arranged side by side in the plane and have a shape resembling to an infinity symbol. The LED filament 100 penetrates through the top portion of the stand 19*a*.

As shown in FIG. 7B, the LED filament 100 is presented in two dimensional coordinate system defining four quadrants. In the embodiment, the Y-axis is aligned with the stand 19*a*, and the X-axis crosses the stand 19*a*. As shown in FIG. 7B, the LED filament 100 in the side view can be divided into a first portion 100*p*1 and a second portion 100*p*2 by the Y-axis. The first portion 100*p*1 of the LED filament 100 is the portion presented in the first quadrant in the side view. The second portion 100*p*2 of the LED filament 100 is the portion presented in the second quadrant in the side view. The LED filament 100 is in line symmetry. The LED filament 100 is symmetric with the Y-axis in the side view. The first portion 100*p*1 and the second portion 100*p*2 are symmetric in structure in the side view with respect to the Y-axis. In addition, emitting directions ED of the first portion 100*p*1 and emitting directions ED of the second portion 100*p*2 are symmetric in direction in the side view with respect to the Y-axis.

In addition, the LED filament 100 is also in point symmetry if the X-axis crosses the stand 19*a* and overlaps the LED filament 100 in the side view shown in FIG. 7B.

Figure 7C:
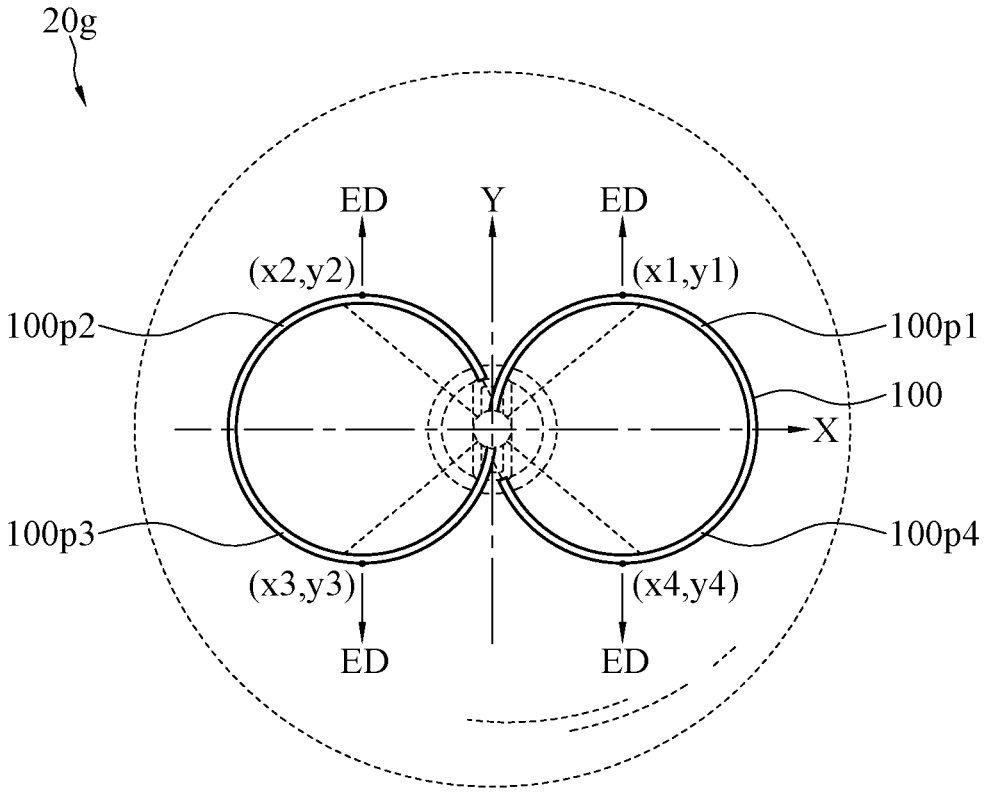
FIG. 7C is a top view of the LED light bulb of FIG. 7A.

Please refer to FIG. 7C. FIG. 7C is a top view of the LED light bulb of FIG. 7A. The LED filament 100 shown in FIG. 7C is presented in two dimensional coordinate system defining four quadrants. The origin of the four quadrants is defined as a center of the stand 19*a* of the LED light bulb 20*g* in the top view (e.g., a center of the top of the stand 19*a* shown in FIG. 7A). In the embodiment, the Y-axis is vertical in FIG. 7C, and the X-axis is horizontal in FIG. 7C. As shown in FIG. 7C, the LED filament 100 in the top view can be divided into a first portion 100*p*1, a second portion 100*p*2, a third portion 100*p*3, and a fourth portion 100*p*4 by the X-axis and the Y-axis. The first portion 100*p*1 of the LED filament 100 is the portion presented in the first quadrant in the top view. The second portion 100*p*2 of the LED filament 100 is the portion presented in the second quadrant in the top view. The third portion 100*p*3 of the LED filament 100 is the portion presented in the third quadrant in the top view. The fourth portion 100*p*4 of the LED filament 100 is the portion presented in the fourth quadrant in the top view.

As shown in FIG. 7C, in the embodiment, the LED filament 100 in the top view is in point symmetry. In particular, the LED filament 100 in the top view is symmetric with the origin of the four quadrants. In other words, the structure of the LED filament 100 in the top view would be the same as the structure of the LED filament 100 in the top view being rotated about the origin to 180 degrees. In particular, the first portion 100*p*1 and the third portion 100*p*3 of the LED filament 100 are symmetric with respect to the origin, and the second portion 100*p*2 and the fourth portion 100*p*4 of the LED filament 100 are symmetric with respect to the origin.

For example, as shown in FIG. 7C, a designated point (x1, y1) on the first portion 100*p*1 of the LED filament 100 in the first quadrant is defined as a first position, and a symmetric point (x3, y3) on the third portion 100*p*3 of the LED filament 100 in the third quadrant symmetric to the designated point (x1, y1) is defined as a second position. The second position of the symmetric point (x3, y3) is symmetric to the first position of the designated point (x1, y1) with respect to the origin. In other words, the designated point (x1, y1) on the first portion 100*p*1 of the LED filament 100 in the top view would overlap the symmetric point (x3, y3) on the third portion 100*p*3 of the LED filament 100 in the third quadrant while the LED filament 100 is rotated about the origin to 180 degrees. In addition, a designated point (x2, y2) on the second portion 100*p*2 of the LED filament 100 in the second quadrant is defined as a third position, and a symmetric point (x4, y4) on the fourth portion 100*p*4 of the LED filament 100 in the fourth quadrant symmetric to the designated point (x2, y2) is defined as a fourth position. The fourth position of the symmetric point (x4, y4) is symmetric to the third position of the designated point (x2, y2) with respect to the origin. In other words, the designated point (x2, y2) on the second portion 100*p*2 of the LED filament 100 in the top view would overlap the symmetric point (x4, y4) on the fourth portion 100*p*4 of the LED filament 100 in the fourth quadrant while the LED filament 100 is rotated about the origin to 180 degrees.

In addition, an emitting direction ED of the designated point (x1, y1) of the first portion 100*p*1 and an emitting direction ED of the symmetric point (x3, y3) of the third portion 100*p*3 are symmetric in direction in the top view with respect to the origin. Further, an emitting direction ED of the designated point (x2, y2) of the second portion 100*p*2 and an emitting direction ED of the symmetric point (x4, y4) of the fourth portion 100*p*4 are symmetric in direction in the top view with respect to the origin.

Figure 8A:
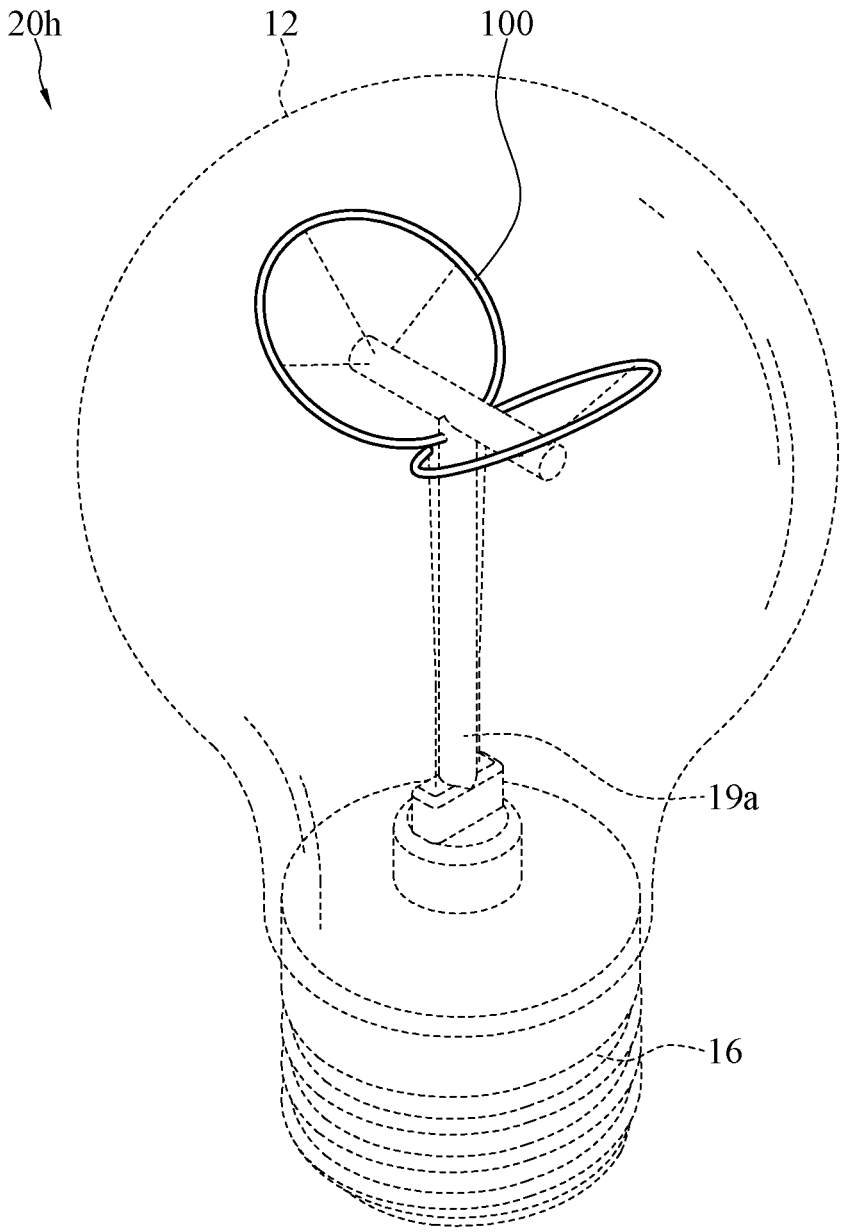
FIG. 8A is a perspective view of an LED light bulb according to an embodiment of the present invention.
Figure 8B:
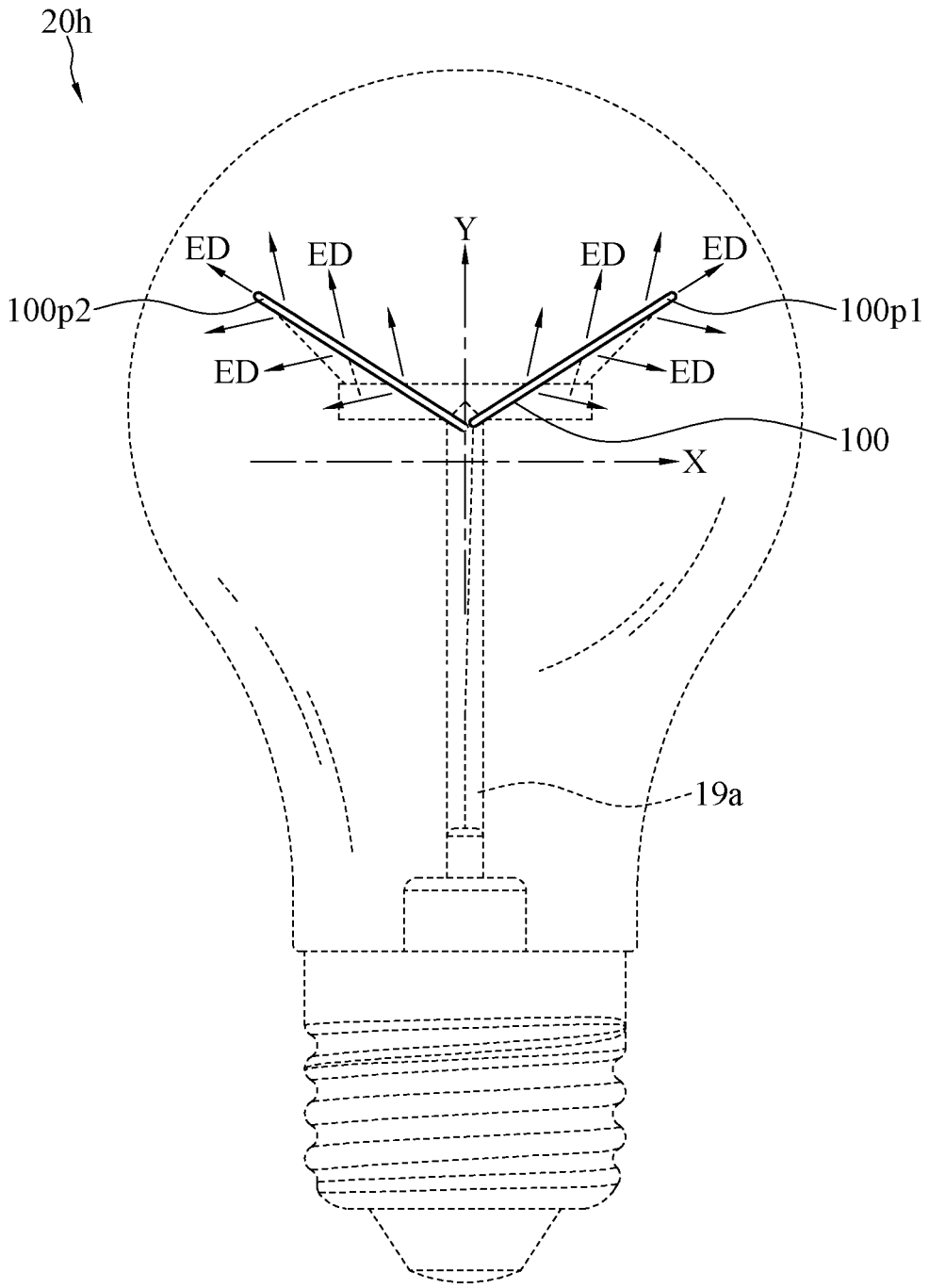
FIG. 8B is a side view of the LED light bulb of FIG. 8A.

Please refer to FIG. 8A and FIG. 8B. FIG. 8A is a perspective view of an LED light bulb 20*h* according to an embodiment of the present invention. FIG. 8B is a side view of the LED light bulb 20*h* of FIG. 8A. The LED light bulb 20*h* shown in FIG. 8A and FIG. 8B is analogous to the LED light bulb 20*d* shown in FIG. 3A. The main difference between the LED light bulb 20*h* and the LED light bulb 20*d* is the LED filament 100. As shown in FIG. 8A, the LED filament 100 of the LED light bulb 20*h* is connected to a top portion of the stand 19*a* and elongates to form two circles. The two circles formed by the LED filament 100 are arranged side by side and have a shape resembling to an infinity symbol. As shown in FIG. 8B, the two circles formed by the LED filament 100 present a "V" shape in the side view. The LED filament 100 penetrates through the top portion of the stand 19*a*.

As shown in FIG. 8B, the LED filament 100 is presented in two dimensional coordinate system defining four quadrants. In the embodiment, the Y-axis is aligned with the stand 19*a*, and the X-axis crosses the stand 19*a*. As shown in FIG. 8B, the LED filament 100 in the side view can be divided into a first portion 100*p*1 and a second portion 100*p*2 by the Y-axis. The first portion 100*p*1 of the LED filament 100 is the portion presented in the first quadrant in the side view. The second portion 100*p*2 of the LED filament 100 is the portion presented in the second quadrant in the side view. The LED filament 100 is in line symmetry. The LED filament 100 is symmetric with the Y-axis in the side view. The first portion 100*p*1 and the second portion 100*p*2 are symmetric in structure in the side view with respect to the Y-axis. In addition, emitting directions ED of the first portion 100*p*1 and emitting directions ED of the second portion 100*p*2 are symmetric in direction in the side view with respect to the Y-axis.

Figure 8C:
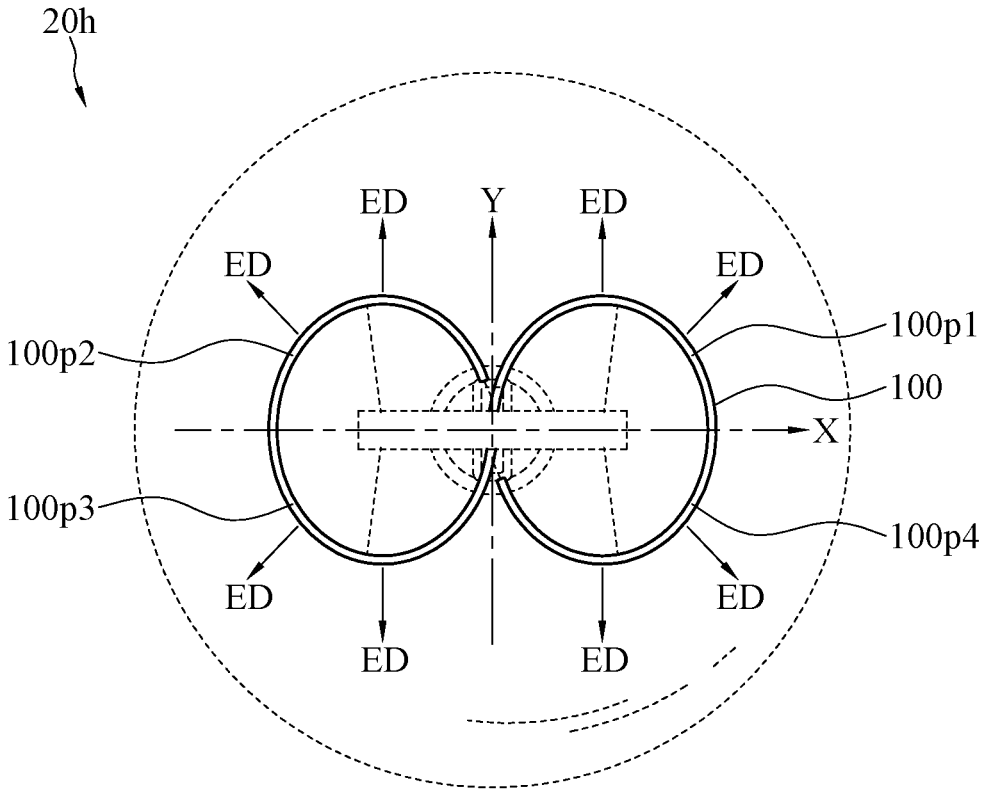
FIG. 8C is a top view of the LED light bulb of FIG. 8A.

Please refer to FIG. 8C. FIG. 8C is a top view of the LED light bulb of FIG. 8A. The LED filament 100 shown in FIG. 8C is presented in two dimensional coordinate system defining four quadrants. The origin of the four quadrants is defined as a center of the stand 19*a* of the LED light bulb 20*h* in the top view (e.g., a center of the top of the stand 19*a* shown in FIG. 8A). In the embodiment, the Y-axis is vertical in FIG. 8C, and the X-axis is horizontal in FIG. 8C. As shown in FIG. 8C, the LED filament 100 in the top view can be divided into a first portion 100*p*1, a second portion 100*p*2, a third portion 100*p*3, and a fourth portion 100*p*4 by the X-axis and the Y-axis. The first portion 100*p*1 of the LED filament 100 is the portion presented in the first quadrant in the top view. The second portion 100*p*2 of the LED filament 100 is the portion presented in the second quadrant in the top view. The third portion 100*p*3 of the LED filament 100 is the portion presented in the third quadrant in the top view. The fourth portion 100*p*4 of the LED filament 100 is the portion presented in the fourth quadrant in the top view.

As shown in FIG. 8C, in the embodiment, the LED filament 100 in the top view is in point symmetry. In particular, the LED filament 100 in the top view is symmetric with the origin of the four quadrants. In other words, the structure of the LED filament 100 in the top view would be the same as the structure of the LED filament 100 in the top view being rotated about the origin to 180 degrees. The first portion 100*p*1 and the third portion 100*p*3 of the LED filament 100 are symmetric with respect to the origin, and the second portion 100*p*2 and the fourth portion 100*p*4 of the LED filament 100 are symmetric with respect to the origin. In addition, emitting directions ED of the first portion 100*p*1 and emitting directions ED of the third portion 100*p*3 are symmetric in direction in the top view with respect to the origin, and emitting directions ED of the second portion 100*p*2 and emitting directions ED of the fourth portion 100*p*4 are symmetric in direction in the top view with respect to the origin.

Figure 9A:
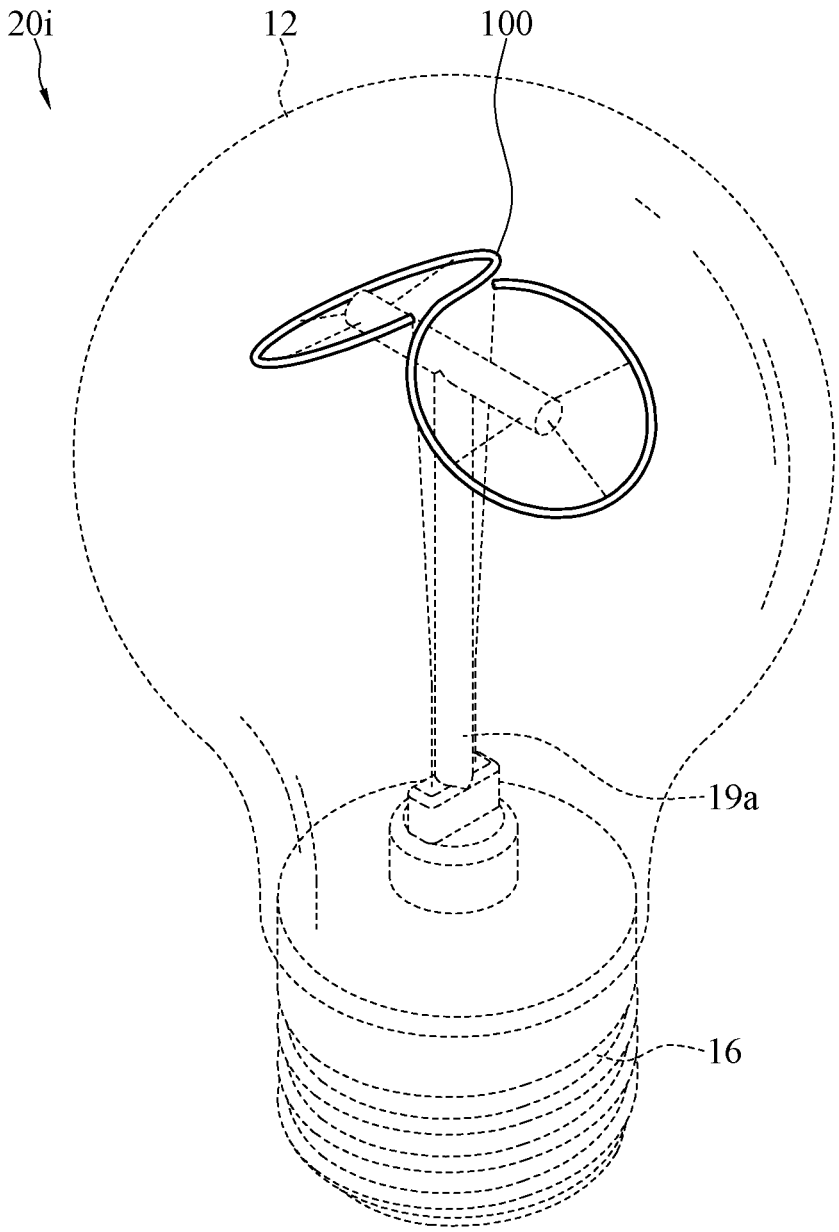
FIG. 9A is a perspective view of an LED light bulb according to an embodiment of the present invention.
Figure 9B:
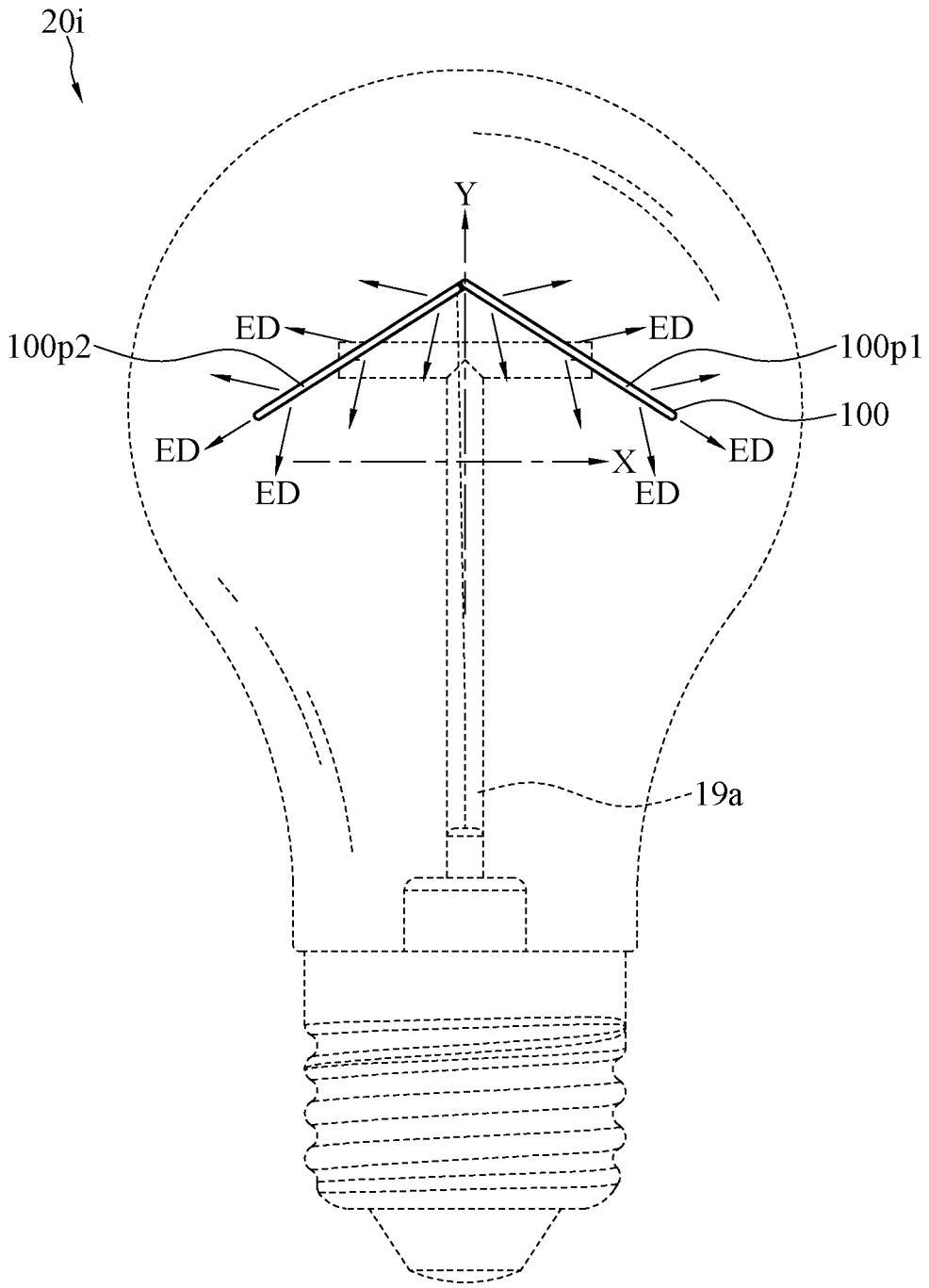
FIG. 9B is a side view of the LED light bulb of FIG. 9A.

Please refer to FIG. 9A and FIG. 9B. FIG. 9A is a perspective view of an LED light bulb 20*i* according to an embodiment of the present invention. FIG. 9B is a side view of the LED light bulb 20*i* of FIG. 9A. The LED light bulb 20*i* shown in FIG. 9A and FIG. 9B is analogous to the LED light bulb 20*d* shown in FIG. 3A. The main difference between the LED light bulb 20*i* and the LED light bulb 20*d* is the LED filament 100. As shown in FIG. 9A, the LED filament 100 of the LED light bulb 20*i* is connected to a top portion of the stand 19*a* and elongates to form two circles. The two circles formed by the LED filament 100 are arranged side by side and have a shape resembling to an infinity symbol. As shown in FIG. 9B, the two circles formed by the LED filament 100 present a reversed "V" shape in the side view as shown in FIG. 9B. In the embodiment, the LED filament 100 does not penetrate through the top portion of the stand 19*a* and is supported by the supporting arms.

As shown in FIG. 9B, the LED filament 100 is presented in two dimensional coordinate system defining four quadrants. In the embodiment, the Y-axis is aligned with the stand 19*a*, and the X-axis crosses the stand 19*a*. As shown in FIG. 9B, the LED filament 100 in the side view can be divided into a first portion 100*p*1 and a second portion 100*p*2 by the Y-axis. The first portion 100*p*1 of the LED filament 100 is the portion presented in the first quadrant in the side view. The second portion 100*p*2 of the LED filament 100 is the portion presented in the second quadrant in the side view. The LED filament 100 is in line symmetry. The LED filament 100 is symmetric with the Y-axis in the side view. The first portion 100*p*1 and the second portion 100*p*2 are symmetric in structure in the side view with respect to the Y-axis. In addition, emitting directions ED of the first portion 100*p*1 and emitting directions ED of the second portion 100*p*2 are symmetric in direction in the side view with respect to the Y-axis.

Figure 9C:
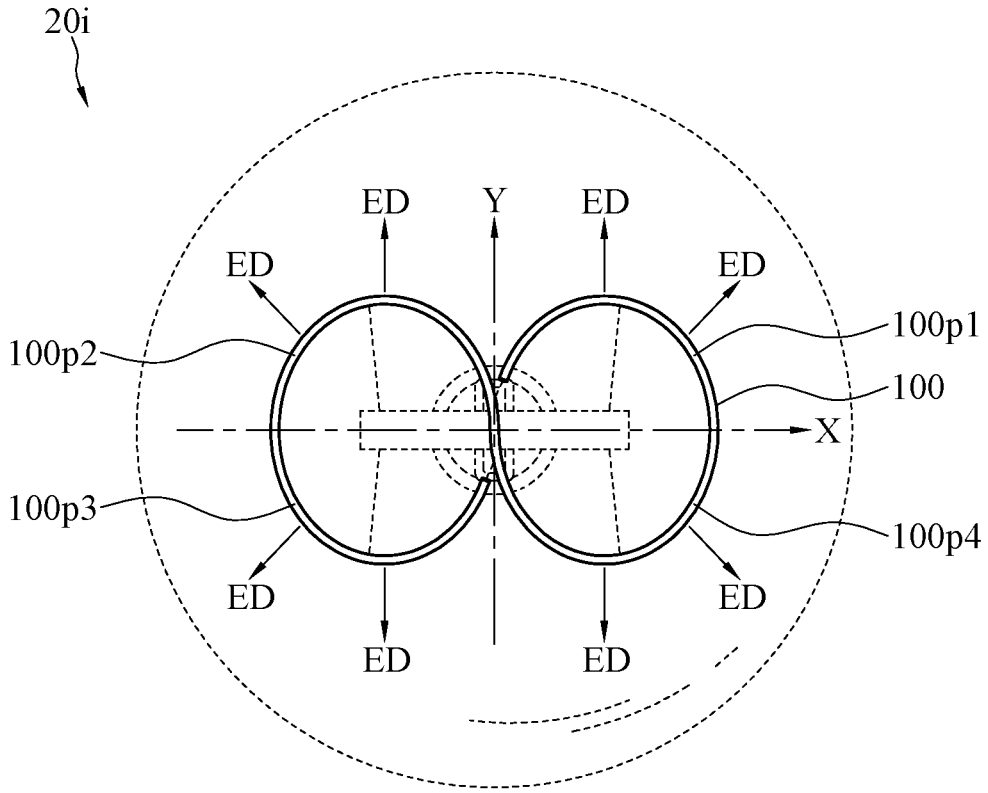
FIG. 9C is a top view of the LED light bulb of FIG. 9A.

Please refer to FIG. 9C. FIG. 9C is a top view of the LED light bulb of FIG. 9A. The LED filament 100 shown in FIG. 9C is presented in two dimensional coordinate system defining four quadrants. The origin of the four quadrants is defined as a center of the stand 19*a* of the LED light bulb 20*i* in the top view (e.g., a center of the top of the stand 19*a* shown in FIG. 9A). In the embodiment, the Y-axis is vertical in FIG. 9C, and the X-axis is horizontal in FIG. 9C. As shown in FIG. 9C, the LED filament 100 in the top view can be divided into a first portion 100*p*1, a second portion 100*p*2, a third portion 100*p*3, and a fourth portion 100*p*4 by the X-axis and the Y-axis. The first portion 100*p*1 of the LED filament 100 is the portion presented in the first quadrant in the top view. The second portion 100*p*2 of the LED filament 100 is the portion presented in the second quadrant in the top view. The third portion 100*p*3 of the LED filament 100 is the portion presented in the third quadrant in the top view. The fourth portion 100*p*4 of the LED filament 100 is the portion presented in the fourth quadrant in the top view.

As shown in FIG. 9C, in the embodiment, the LED filament 100 in the top view is in point symmetry. In particular, the LED filament 100 in the top view is symmetric with the origin of the four quadrants. In other words, the structure of the LED filament 100 in the top view would be the same as the structure of the LED filament 100 in the top view being rotated about the origin to 180 degrees. The first portion 100*p*1 and the third portion 100*p*3 of the LED filament 100 are symmetric with respect to the origin, and the second portion 100*p*2 and the fourth portion 100*p*4 of the LED filament 100 are symmetric with respect to the origin. In addition, emitting directions ED of the first portion 100*p*1 and emitting directions ED of the third portion 100*p*3 are symmetric in direction in the top view with respect to the origin, and emitting directions ED of the second portion 100*p*2 and emitting directions ED of the fourth portion 100*p*4 are symmetric in direction in the top view with respect to the origin.

Figure 10A:
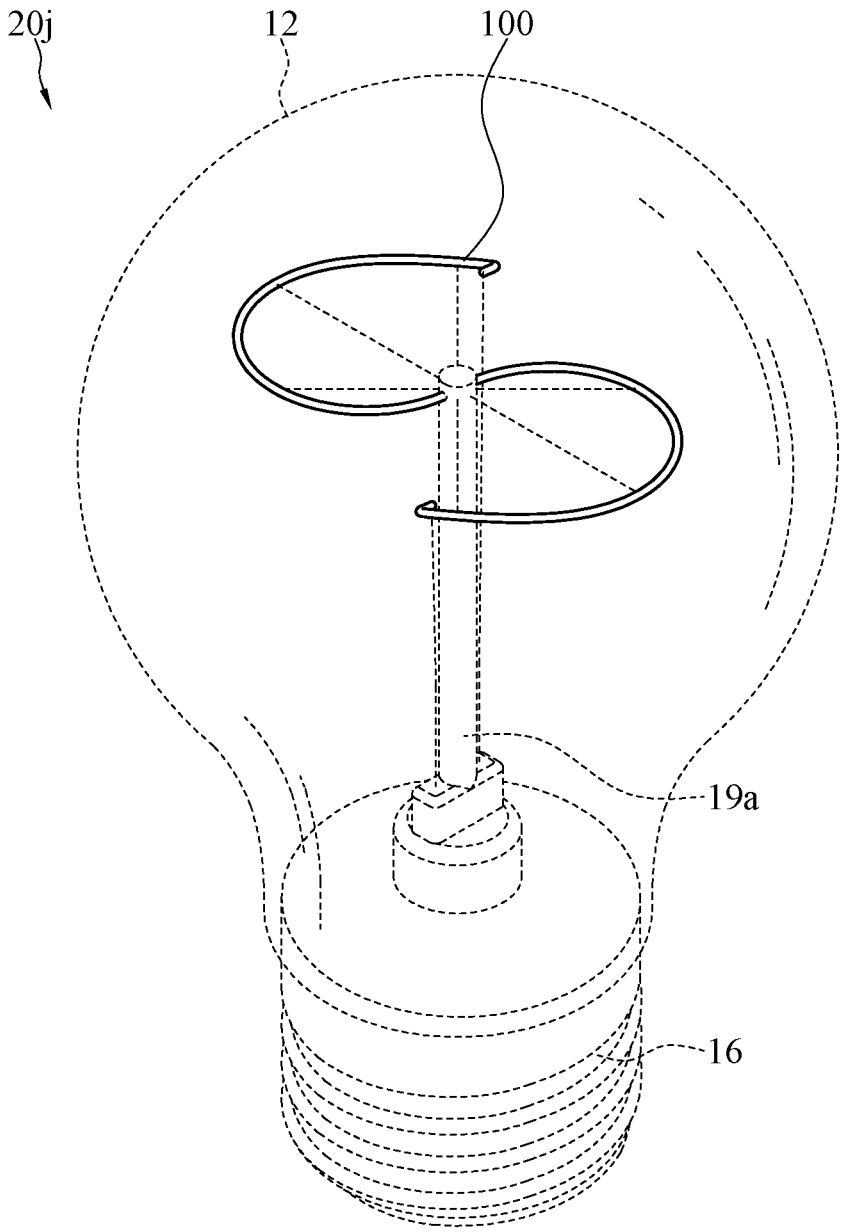
FIG. 10A is a perspective view of an LED light bulb according to an embodiment of the present invention.
Figure 10B:
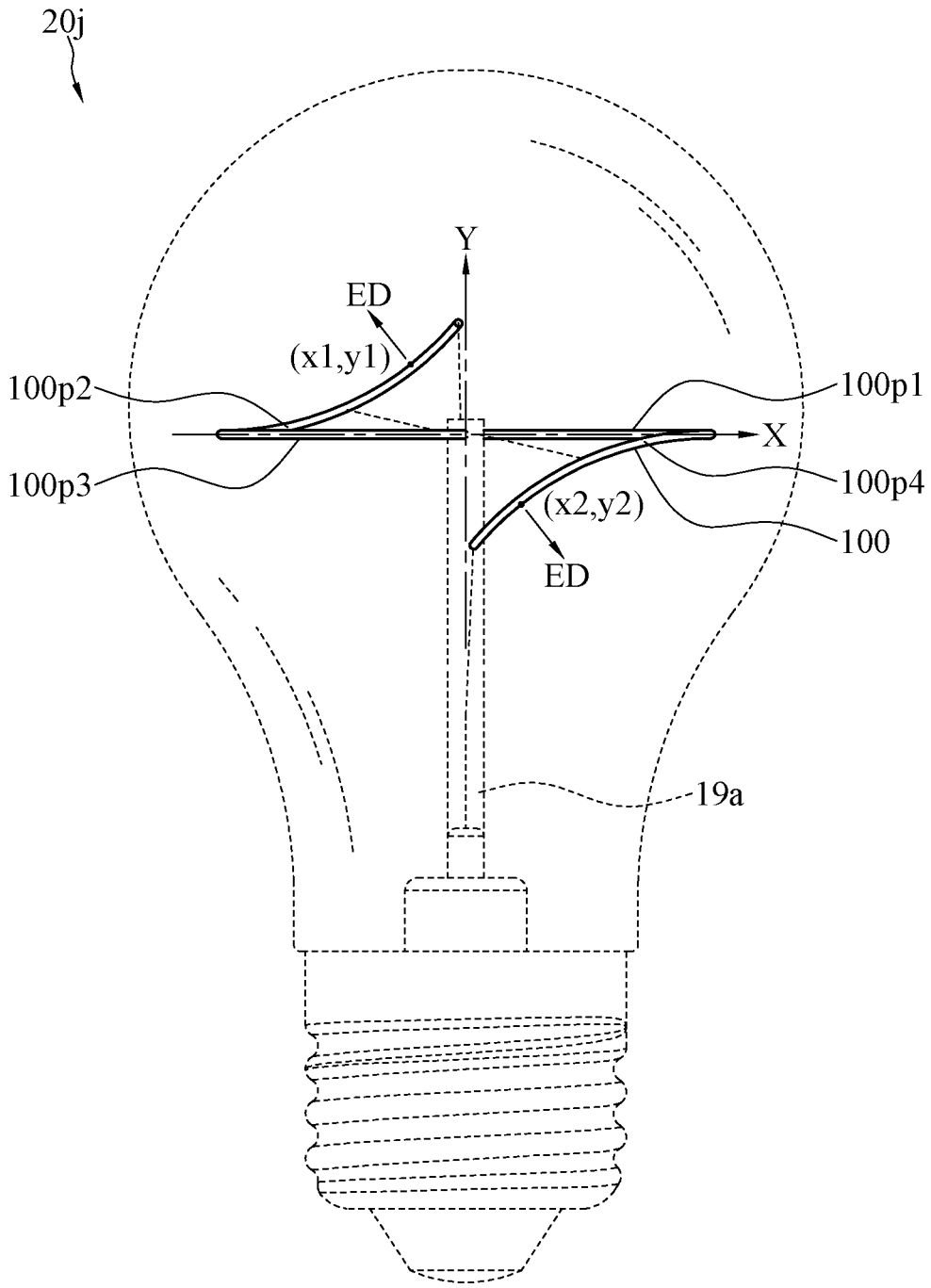
FIG. 10B is a side view of the LED light bulb of FIG. 10A.

Please refer to FIG. 10A and FIG. 10B. FIG. 10A is a perspective view of an LED light bulb 20*j* according to an embodiment of the present invention. FIG. 10B is a side view of the LED light bulb 20*j* of FIG. 10A. The LED light bulb 20*j* shown in FIG. 10A and FIG. 10B is analogous to the LED light bulb 20*d* shown in FIG. 3A. The main difference between the LED light bulb 20*j* and the LED light bulb 20*d* is the LED filament 100. As shown in FIG. 10A, the LED filament 100 of the LED light bulb 20*j* is connected to a top portion of the stand 19*a* and elongates to form two helixes. The two helixes formed by the LED filament 100 are arranged side by side and have a shape resembling to an "S" shape while being observed at certain angle, as shown in FIG. 10A. As shown in FIG. 10B, one of the two helixes extends upwardly, and the other one of the two helixes extends downwardly. The LED filament 100 penetrates through the top portion of the stand 19*a*.

As shown in FIG. 10B, the LED filament 100 is presented in two dimensional coordinate system defining four quadrants. In the embodiment, the Y-axis is aligned with the stand 19*a*, and the X-axis crosses the stand 19*a*. As shown in FIG. 10B, the LED filament 100 in the side view can be divided into a first portion 100*p*1, a second portion 100*p*2, a third portion 100*p*3, and a fourth portion 100*p*4 by the X-axis and the Y-axis. The first portion 100*p*1 of the LED filament 100 is the portion presented in the first quadrant in the side view. The second portion 100*p*2 of the LED filament 100 is the portion presented in the second quadrant in the side view. The third portion 100*p*3 of the LED filament 100 is the portion presented in the third quadrant in the side view. The fourth portion 100*p*4 of the LED filament 100 is the portion presented in the fourth quadrant in the side view. In the embodiment, the LED filament 100 in the side view is in point symmetry. The LED filament 100 is symmetric with the origin in the side view. The first portion 100*p*1 and the third portion 100*p*3 are symmetric in structure in the side view with respect to the origin, and the second portion 100*p*2 and the fourth portion 100*p*4 are symmetric in structure in the side view with respect to the origin. In other words, as shown in FIG. 10B, the structure of the LED filament 100 in the side view would be the same as the structure of the LED filament 100 in the side view being rotated about the origin to 180 degrees.

For example, as shown in FIG. 10B, a designated point (x1, y1) on the second portion 100*p*2 of the LED filament 100 in the second quadrant is defined as a first position, and a symmetric point (x2, y2) on the fourth portion 100*p*4 of the LED filament 100 in the fourth quadrant symmetric to the designated point (x1, y1) is defined as a second position. The second position of the symmetric point (x2, y2) is symmetric to the first position of the designated point (x1, y1) with respect to the origin. In other words, the designated point (x1, y1) on the second portion 100*p*2 of the LED filament 100 in the side view would overlap the symmetric point (x2, y2) on the fourth portion 100*p*4 of the LED filament 100 in the side view while the LED filament 100 is rotated about the origin to 180 degrees. In addition, an emitting direction ED of the designated point (x1, y1) on the second portion 100*p*2 and an emitting direction ED of the symmetric point (x2, y2) on the fourth portion 100*p*4 are symmetric in direction in the side view with respect to the origin.

Figure 10C:
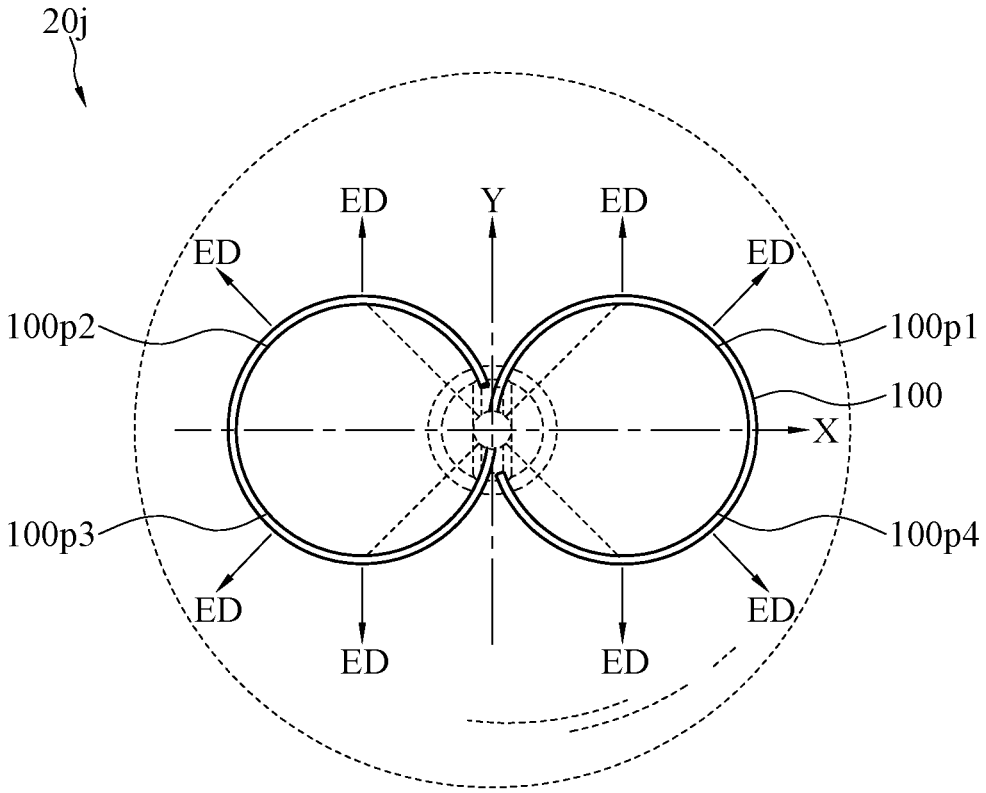
FIG. 10C is a top view of the LED light bulb of FIG. 10A.

Please refer to FIG. 10C. FIG. 10C is a top view of the LED light bulb of FIG. 10A. The LED filament 100 shown in FIG. 10C is presented in two dimensional coordinate system defining four quadrants. The origin of the four quadrants is defined as a center of the stand 19*a* of the LED light bulb 20*j* in the top view (e.g., a center of the top of the stand 19*a* shown in FIG. 10A). In the embodiment, the Y-axis is vertical in FIG. 10C, and the X-axis is horizontal in FIG. 10C. As shown in FIG. 10C, the LED filament 100 in the top view can be divided into a first portion 100*p*1, a second portion 100*p*2, a third portion 100*p*3, and a fourth portion 100*p*4 by the X-axis and the Y-axis. The first portion 100*p*1 of the LED filament 100 is the portion presented in the first quadrant in the top view. The second portion 100*p*2 of the LED filament 100 is the portion presented in the second quadrant in the top view. The third portion 100*p*3 of the LED filament 100 is the portion presented in the third quadrant in the top view. The fourth portion 100*p*4 of the LED filament 100 is the portion presented in the fourth quadrant in the top view.

As shown in FIG. 10C, in the embodiment, the LED filament 100 in the top view is in point symmetry. In particular, the LED filament 100 in the top view is symmetric with the origin of the four quadrants. In other words, the structure of the LED filament 100 in the top view would be the same as the structure of the LED filament 100 in the top view being rotated about the origin to 180 degrees. The first portion 100*p*1 and the third portion 100*p*3 of the LED filament 100 are symmetric with respect to the origin, and the second portion 100*p*2 and the fourth portion 100*p*4 of the LED filament 100 are symmetric with respect to the origin. In addition, emitting directions ED of the first portion 100*p*1 and emitting directions ED of the third portion 100*p*3 are symmetric in direction in the top view with respect to the origin, and emitting directions ED of the second portion 100*p*2 and emitting directions ED of the fourth portion 100*p*4 are symmetric in direction in the top view with respect to the origin.

Figure 11A:
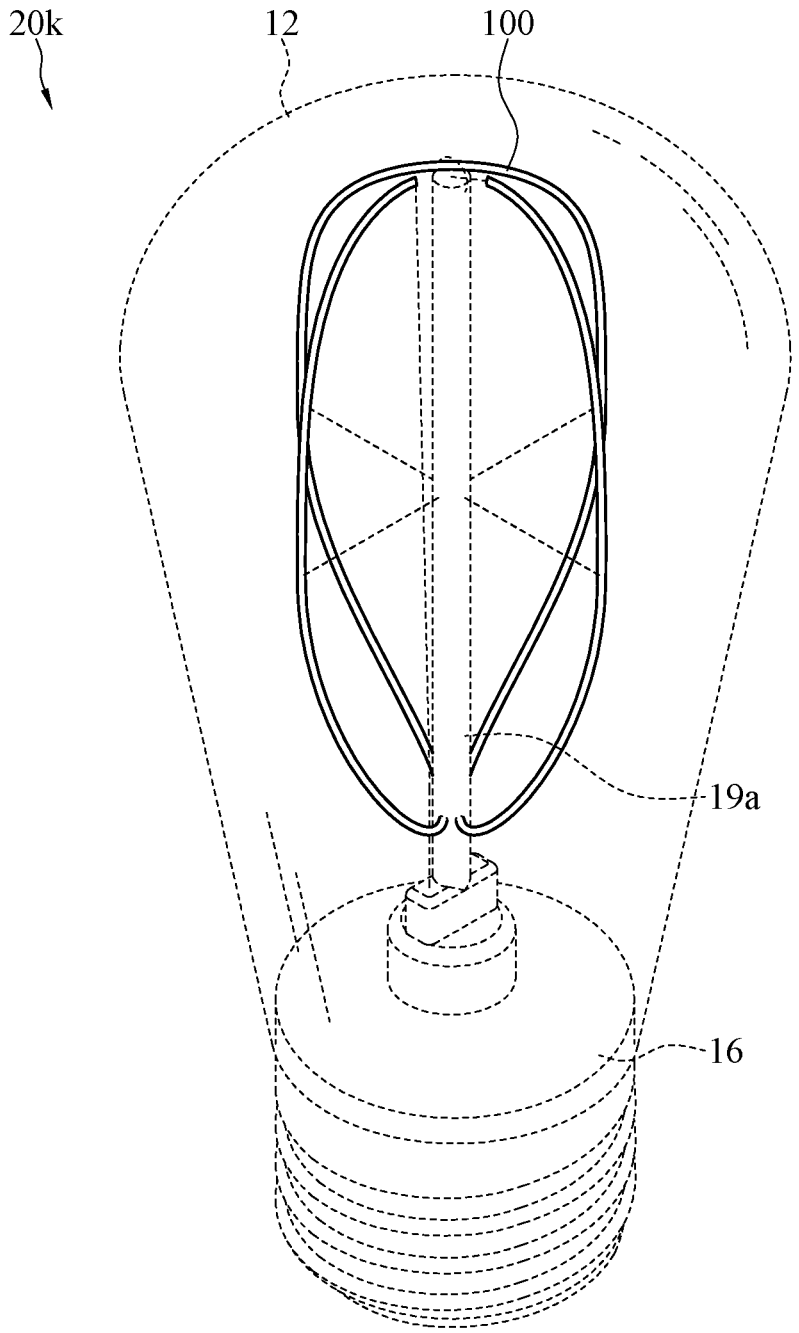
FIG. 11A is a perspective view of an LED light bulb according to an embodiment of the present invention.
Figure 11B:
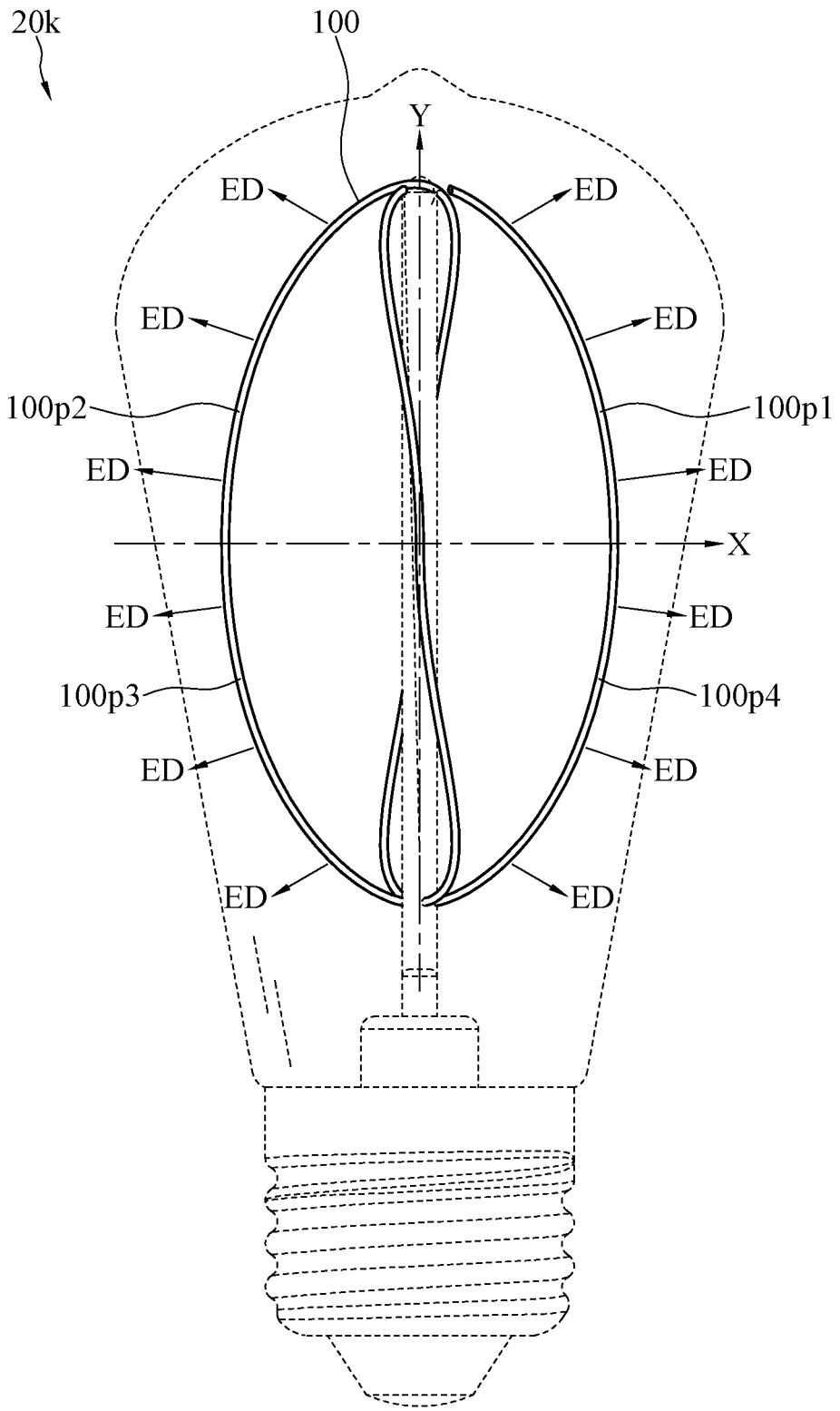
FIG. 11B is a side view of the LED light bulb of FIG. 11A.

Please refer to FIG. 11A and FIG. 11B. FIG. 11A is a perspective view of an LED light bulb 20*k* according to an embodiment of the present invention. FIG. 11B is a side view of the LED light bulb 20*k* of FIG. 11A. The LED light bulb 20*k* shown in FIG. 11A and FIG. 11B is analogous to the LED light bulb 20*d* shown in FIG. 3A. The main difference between the LED light bulb 20*k* and the LED light bulb 20*d* is the LED filament 100. As shown in FIG. 11A, the LED filament 100 of the LED light bulb 20*k* is connected to the stand 19*a* and elongates to form four semi-circles perpendicular to one another. The LED filament 100 penetrates through a bottom portion of the stand 19*a* and crosses over a top portion of the stand 19*a*.

As shown in FIG. 11B, the LED filament 100 is presented in two dimensional coordinate system defining four quadrants. In the embodiment, the Y-axis is aligned with the stand 19*a*, and the X-axis crosses the stand 19*a*. As shown in FIG. 11B, the LED filament 100 in the side view can be divided into a first portion 100*p*1, a second portion 100*p*2, a third portion 100*p*3, and a fourth portion 100*p*4 by the X-axis and the Y-axis. The first portion 100*p*1 of the LED filament 100 is the portion presented in the first quadrant in the side view. The second portion 100*p*2 of the LED filament 100 is the portion presented in the second quadrant in the side view. The third portion 100*p*3 of the LED filament 100 is the portion presented in the third quadrant in the side view. The fourth portion 100*p*4 of the LED filament 100 is the portion presented in the fourth quadrant in the side view. In the embodiment, the LED filament 100 in the side view is in point symmetry. The LED filament 100 is symmetric with the origin in the side view. The first portion 100*p*1 and the third portion 100*p*3 are symmetric in structure in the side view with respect to the origin, and the second portion 100*p*2 and the fourth portion 100*p*4 are symmetric in structure in the side view with respect to the origin. In other words, as shown in FIG. 11B, the structure of the LED filament 100 in the side view would be the same as the structure of the LED filament 100 in the side view being rotated about the origin to 180 degrees.

Figure 11C:
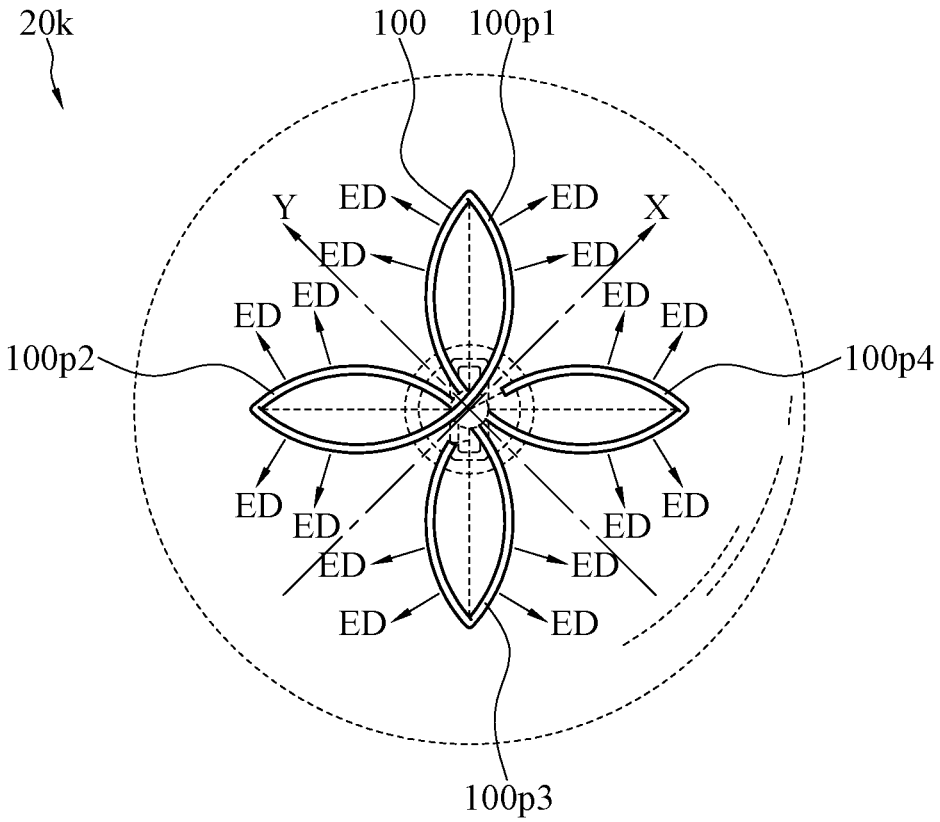
FIG. 11C is a top view of the LED light bulb of FIG. 11A

Please refer to FIG. 11C. FIG. 11C is a top view of the LED light bulb of FIG. 11A. The LED filament 100 shown in FIG. 11C is presented in two dimensional coordinate system defining four quadrants. The origin of the four quadrants is defined as a center of the stand 19*a* of the LED light bulb 20*k* in the top view (e.g., a center of the top of the stand 19*a* shown in FIG. 11A). In the embodiment, the Y-axis is inclined in FIG. 11C, and the X-axis is inclined in FIG. 11C. As shown in FIG. 11C, the LED filament 100 in the top view can be divided into a first portion 100*p*1, a second portion 100*p*2, a third portion 100*p*3, and a fourth portion 100*p*4 by the X-axis and the Y-axis. The first portion 100*p*1 of the LED filament 100 is the portion presented in the first quadrant in the top view. The second portion 100*p*2 of the LED filament 100 is the portion presented in the second quadrant in the top view. The third portion 100*p*3 of the LED filament 100 is the portion presented in the third quadrant in the top view. The fourth portion 100*p*4 of the LED filament 100 is the portion presented in the fourth quadrant in the top view.

As shown in FIG. 11C, in the embodiment, the LED filament 100 in the top view is in line symmetry. In particular, the LED filament 100 in the top view is symmetric with the Y-axis. The first portion 100*p*1 and the second portion 100*p*2 of the LED filament 100 are symmetric with respect to the Y-axis, and the third portion 100*p*3 and the fourth portion 100*p*4 of the LED filament 100 are symmetric with respect to the Y-axis. Each of the first portion 100*p*1, the second portion 100*p*2, the third portion 100*p*3, and the fourth portion 100*p*4 in the top view forms a leaf shape, and the first portion 100*p*1, the second portion 100*p*2, the third portion 100*p*3, and the fourth portion 100*p*4 in the top view jointly form a four-leaf clover shape. In addition, emitting directions ED of the first portion 100*p*1 and emitting directions ED of the second portion 100*p*2 are symmetric in direction in the top view with respect to the Y-axis, and emitting directions ED of the third portion 100*p*3 and emitting directions ED of the fourth portion 100*p*4 are symmetric in direction in the top view with respect to the Y-axis.

Figure 12A:
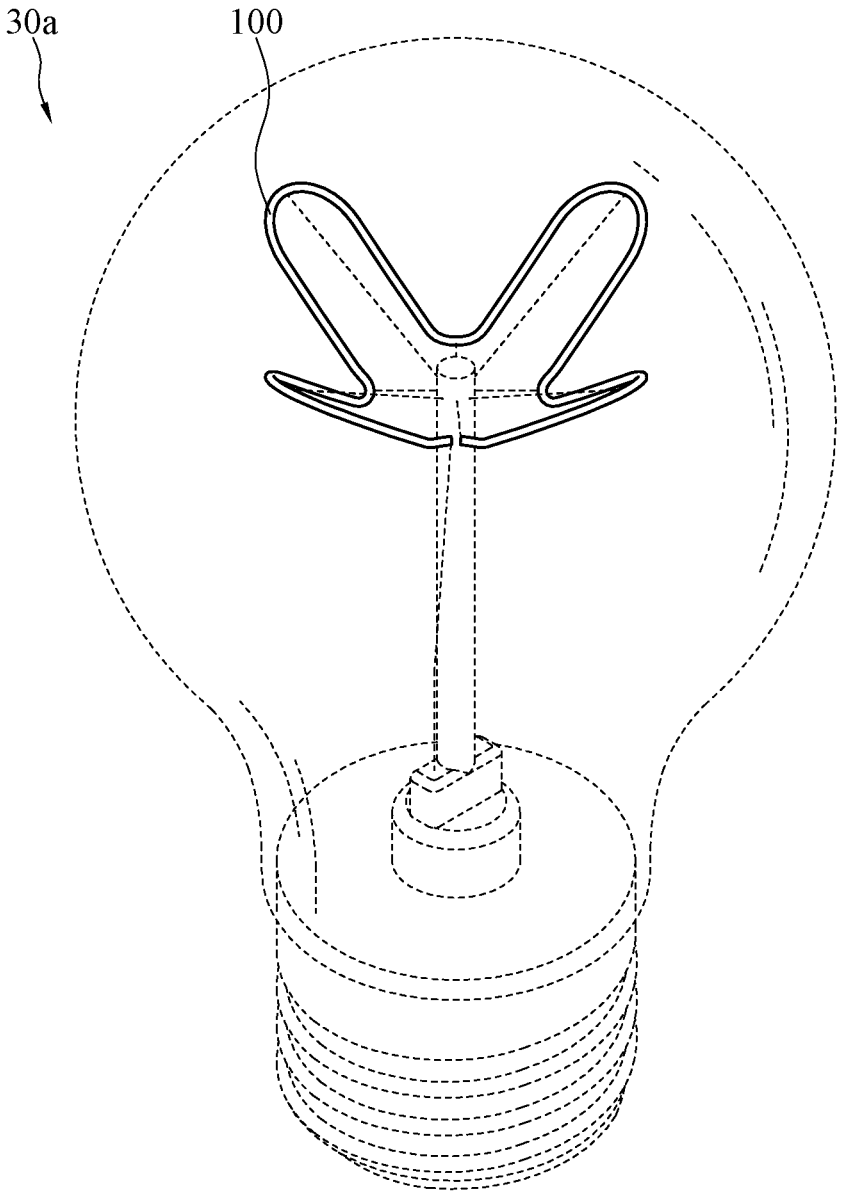
FIGS. 12A-12C are respectively a perspective view, a side view, and a top view of an LED light bulb according to an embodiment of the present invention.
Figure 12B:
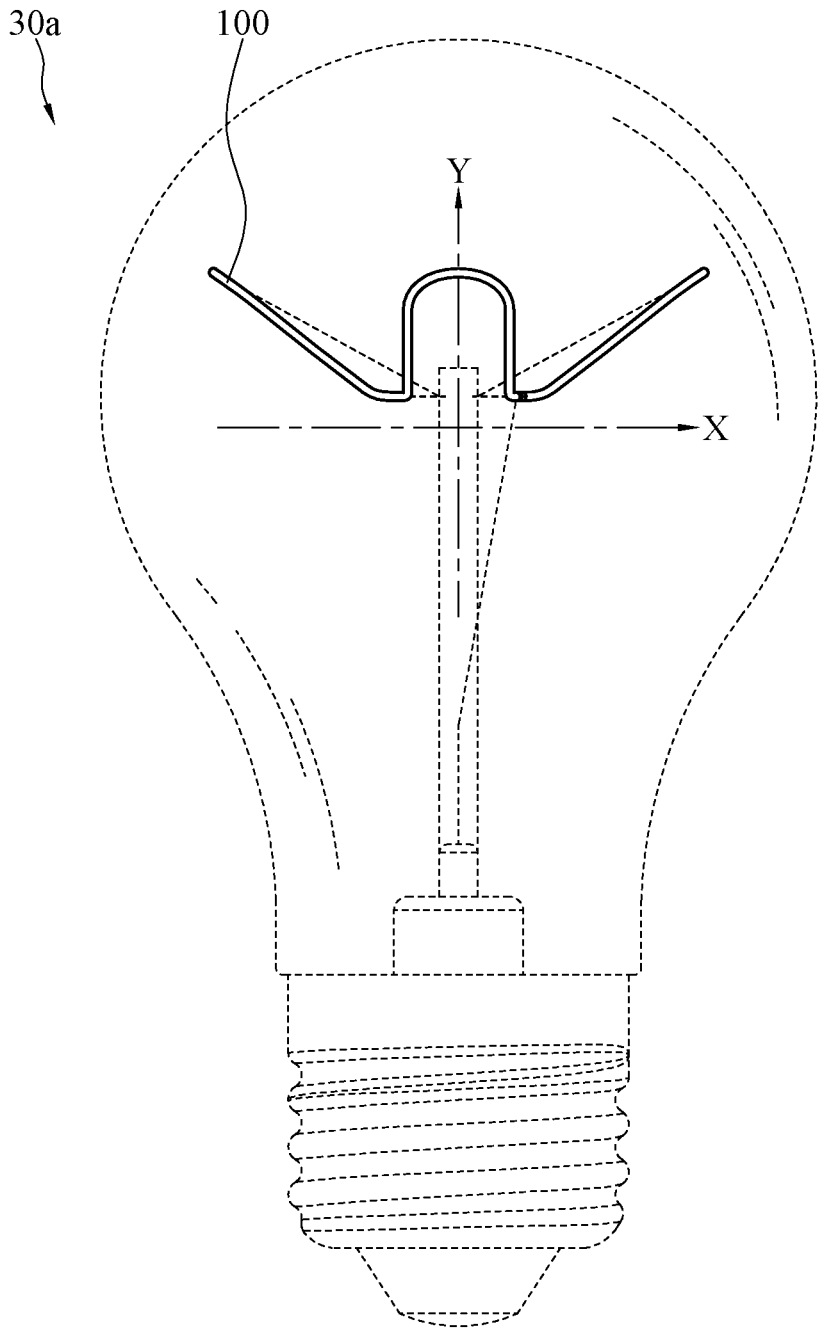
Figure 12C:
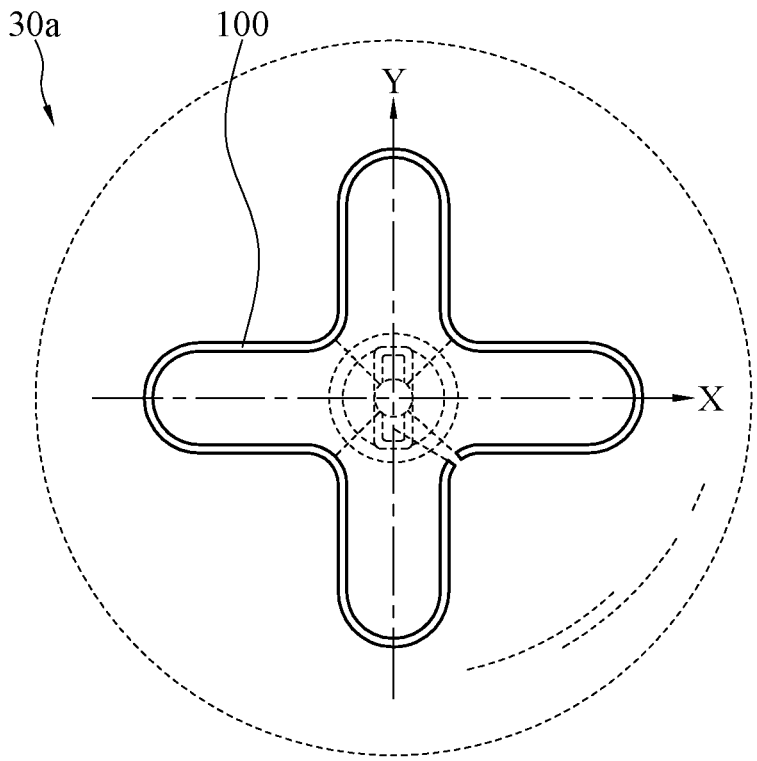

Please refer to FIGS. 12A-12C. FIGS. 12A-12C are respectively a perspective view, a side view, and a top view of an LED light bulb 30*a* according to an embodiment of the present invention. The LED light bulb 30*a* comprising an LED filament 100 is analogous to the discussed LED light bulbs in the above embodiments. A difference between the LED light bulb 30*a* and the discussed LED light bulbs is that the LED filament 100 of the LED light bulb 30*a* has a modified structure. Portions of the LED filament 100 presented in different quadrants in the side view or in the top view may be in line symmetry or in point symmetry in brightness while the LED filament 100 operates. As shown in FIG. 12B, the portions of the LED filament 100 presented in the first quadrant and the second quadrant may be in line symmetry with the Y-axis in the side view in structure, in length, in emitting direction, in arrangement of LED chips, in power configuration of LED chips with different power, in refractive index, or in surface roughness. As shown in FIG. 12C, the portions of the LED filament 100 presented in the four quadrants may be in point symmetry with the origin and in line symmetry with the Y-axis and the X-axis in the top view in structure, in length, in emitting direction, in arrangement of LED chips, in power configuration of LED chips with different power, in refractive index, or in surface roughness.

Figure 13A:
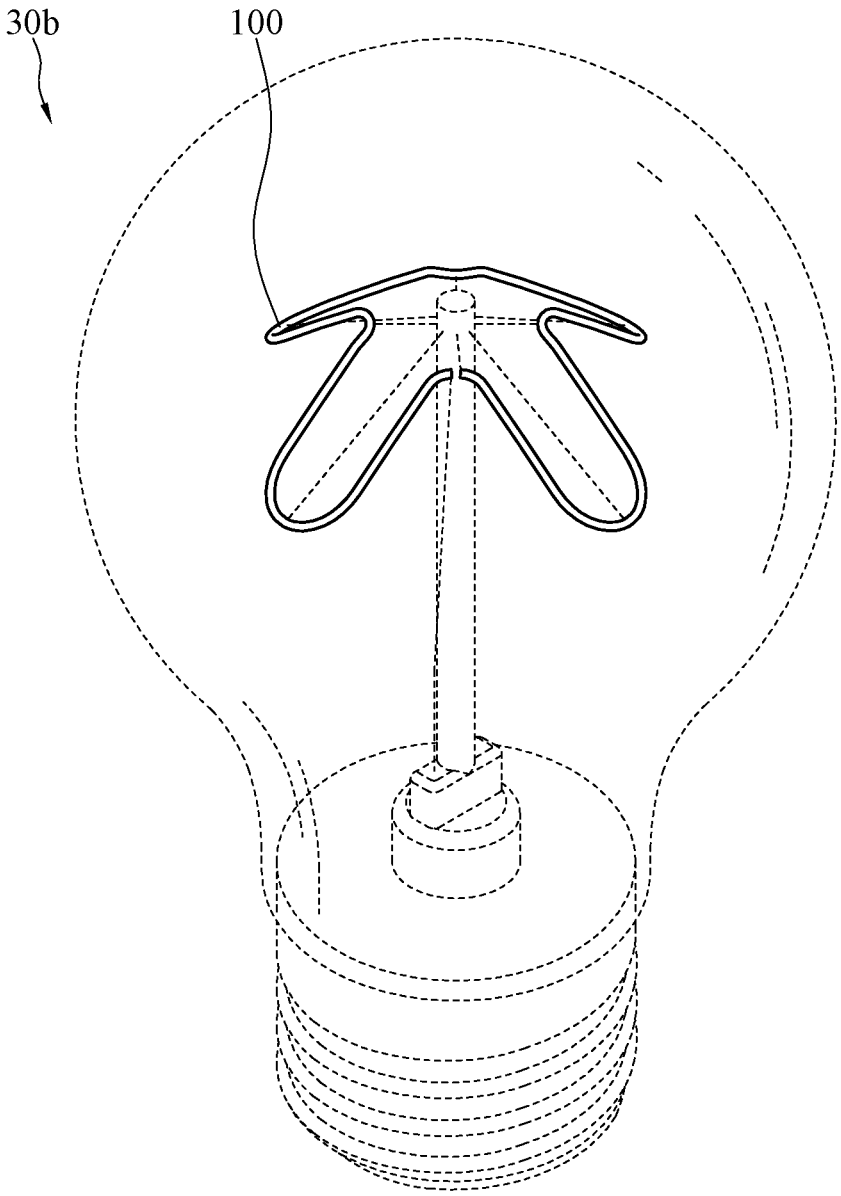
FIGS. 13A-13C are respectively a perspective view, a side view, and a top view of an LED light bulb according to an embodiment of the present invention.
Figure 13B:
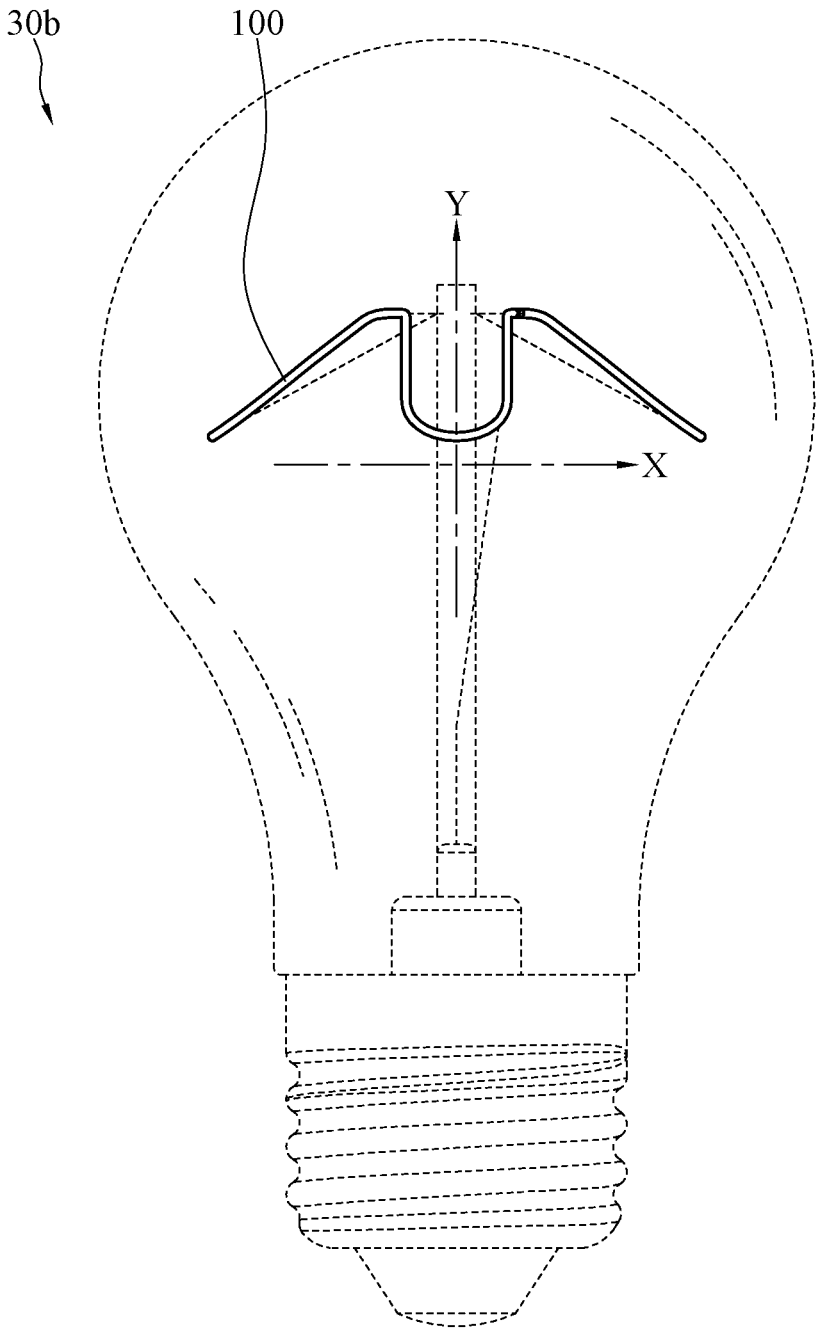
Figure 13C:
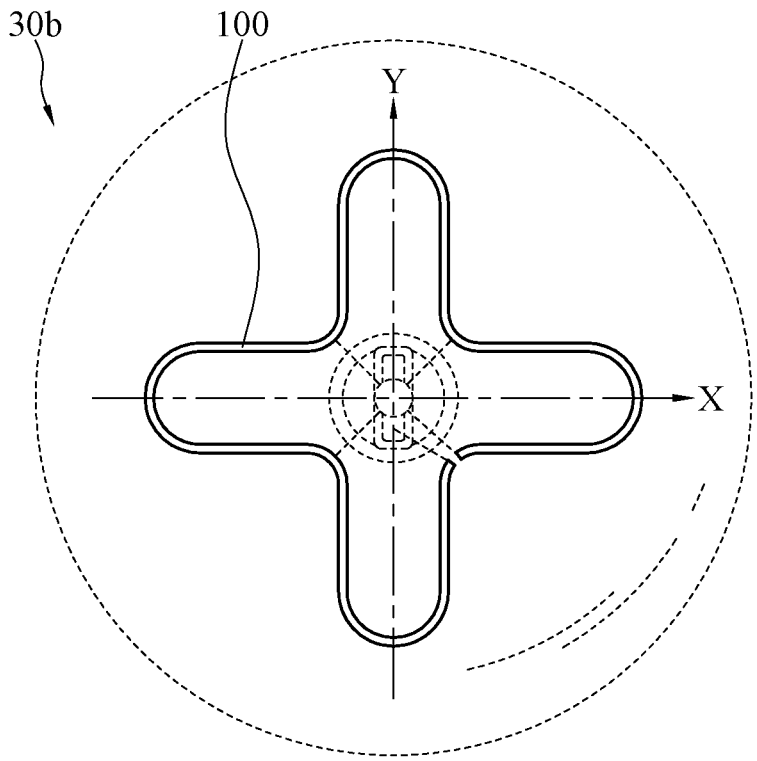

Please refer to FIGS. 13A-13C. FIGS. 13A-13C are respectively a perspective view, a side view, and a top view of an LED light bulb 30*b* according to an embodiment of the present invention. The LED light bulb 30*b* comprising an LED filament 100 is analogous to the discussed LED light bulbs in the above embodiments. A difference between the LED light bulb 30*b* and the discussed LED light bulbs is that the LED filament 100 of the LED light bulb 30*b* has a modified structure. Portions of the LED filament 100 presented in different quadrants in the side view or in the top view may be in line symmetry or in point symmetry in brightness while the LED filament 100 operates. As shown in FIG. 13B, the portions of the LED filament 100 presented in the first quadrant and in the second quadrant may be in line symmetry with the Y-axis in the side view in structure, in length, in emitting direction, in arrangement of LED chips, in power configuration of LED chips with different power, in refractive index, or in surface roughness. As shown in FIG. 13C, the portions of the LED filament 100 presented in the four quadrants may be in point symmetry with the origin and in line symmetry with the Y-axis and the X-axis in the top view in structure, in length, in emitting direction, in arrangement of LED chips, in power configuration of LED chips with different power, in refractive index, or in surface roughness.

Figure 14A:
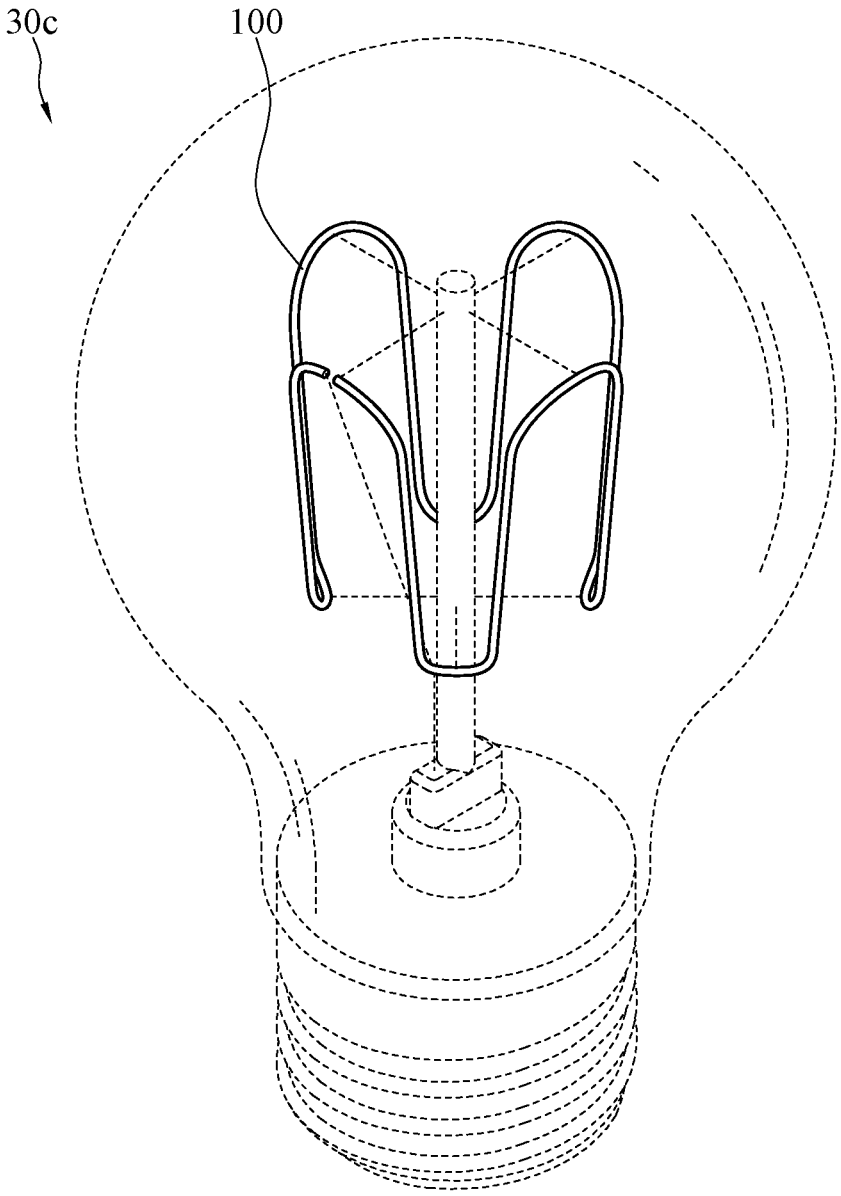
FIGS. 14A-14C are respectively a perspective view, a side view, and a top view of an LED light bulb according to an embodiment of the present invention.
Figure 14B:
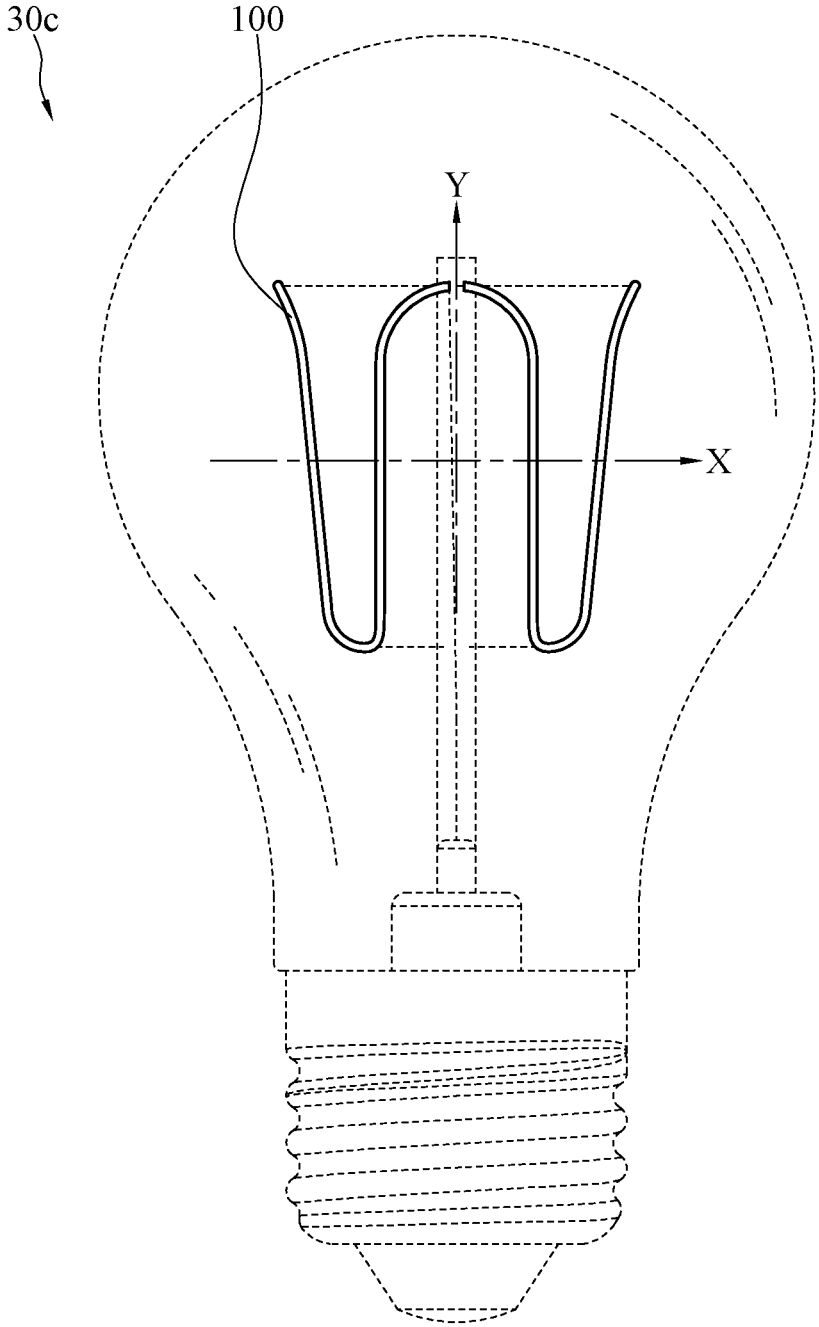
Figure 14C:
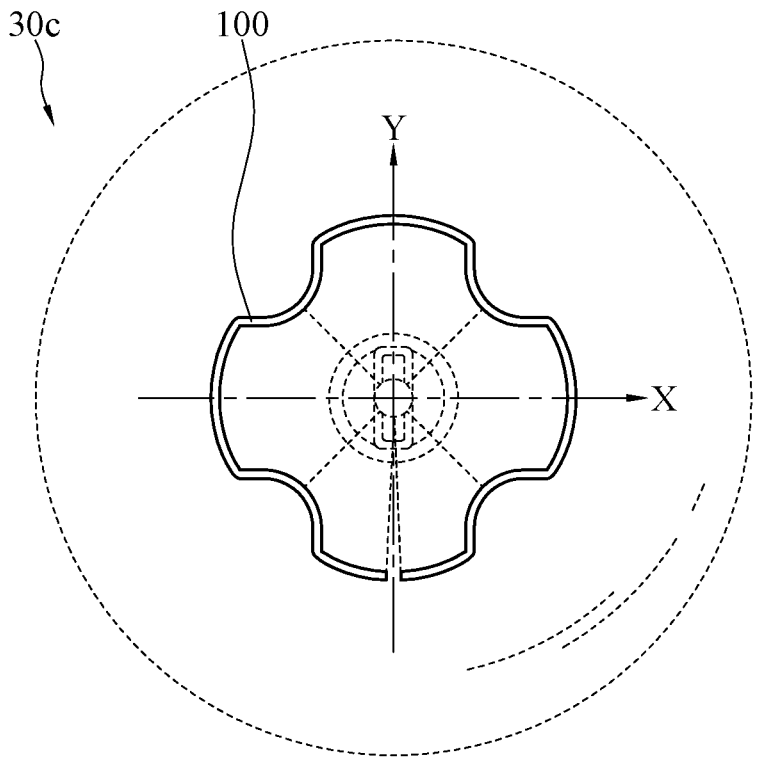

Please refer to FIGS. 14A-14C. FIGS. 14A-14C are respectively a perspective view, a side view, and a top view of an LED light bulb 30*c* according to an embodiment of the present invention. The LED light bulb 30*c* comprising an LED filament 100 is analogous to the discussed LED light bulbs in the above embodiments. A difference between the LED light bulb 30*c* and the discussed LED light bulbs is that the LED filament 100 of the LED light bulb 30*c* has a modified structure. Portions of the LED filament 100 presented in different quadrants in the side view or in the top view may be in line symmetry or in point symmetry in brightness while the LED filament 100 operates. As shown in FIG. 14B, both of the portions of the LED filament 100 presented in the first quadrant and the second quadrant and the portions of the LED filament 100 presented in the third quadrant and the fourth quadrant may be in line symmetry with the Y-axis in the side view in structure, in length, in emitting direction, in arrangement of LED chips, in power configuration of LED chips with different power, in refractive index, or in surface roughness. As shown in FIG. 14C, the portions of the LED filament 100 presented in the four quadrants may be in point symmetry with the origin and in line symmetry with the Y-axis and the X-axis in the top view in structure, in length, in emitting direction, in arrangement of LED chips, in power configuration of LED chips with different power, in refractive index, or in surface roughness.

Figure 15A:
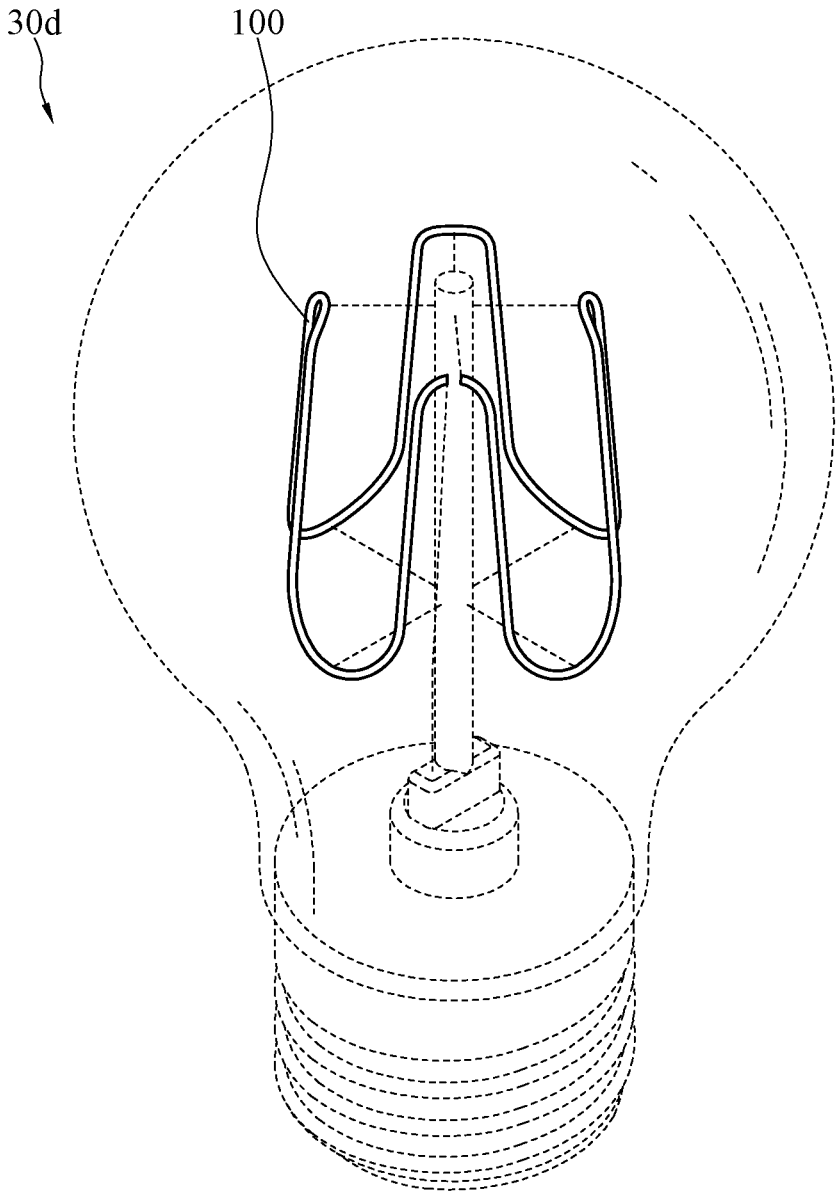
FIGS. 15A-15C are respectively a perspective view, a side view, and a top view of an LED light bulb according to an embodiment of the present invention.
Figure 15B:
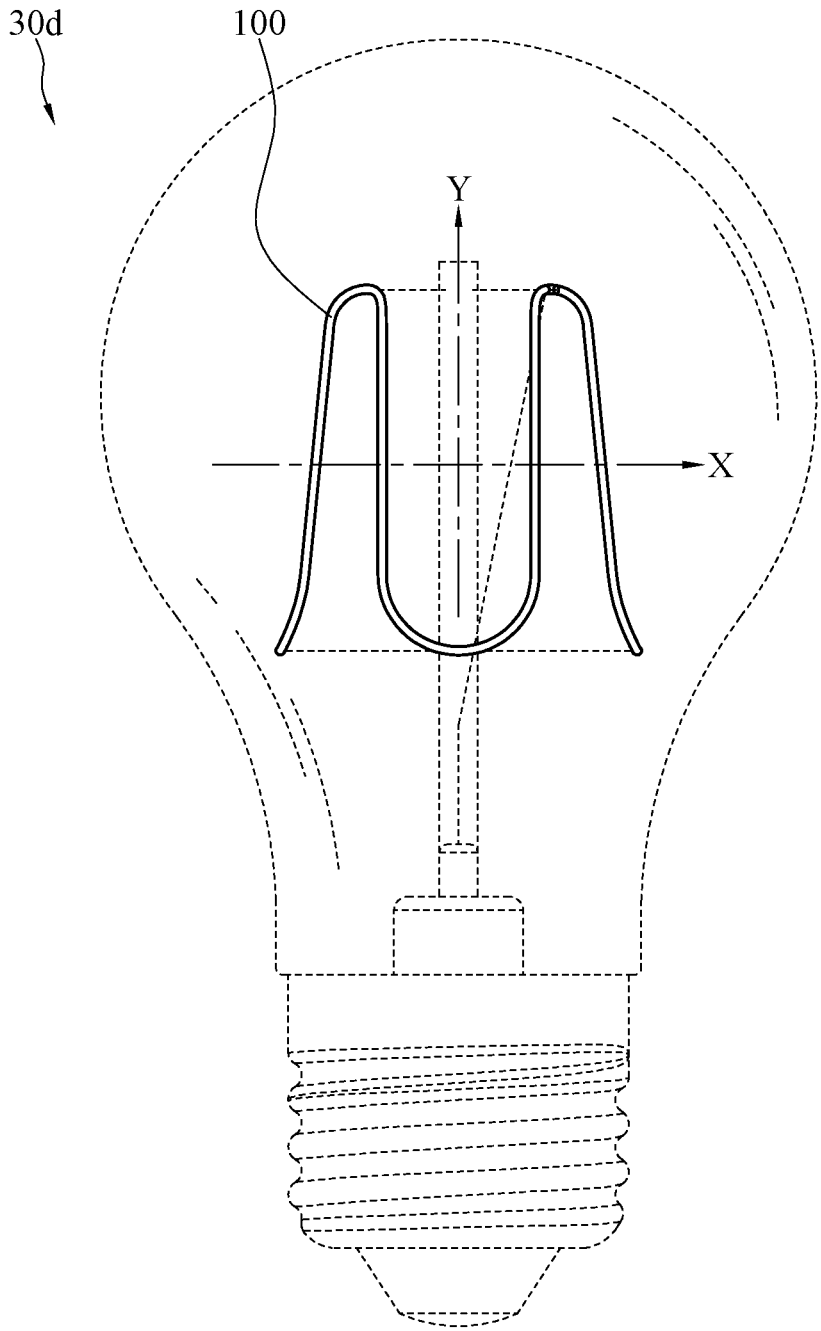
Figure 15C:
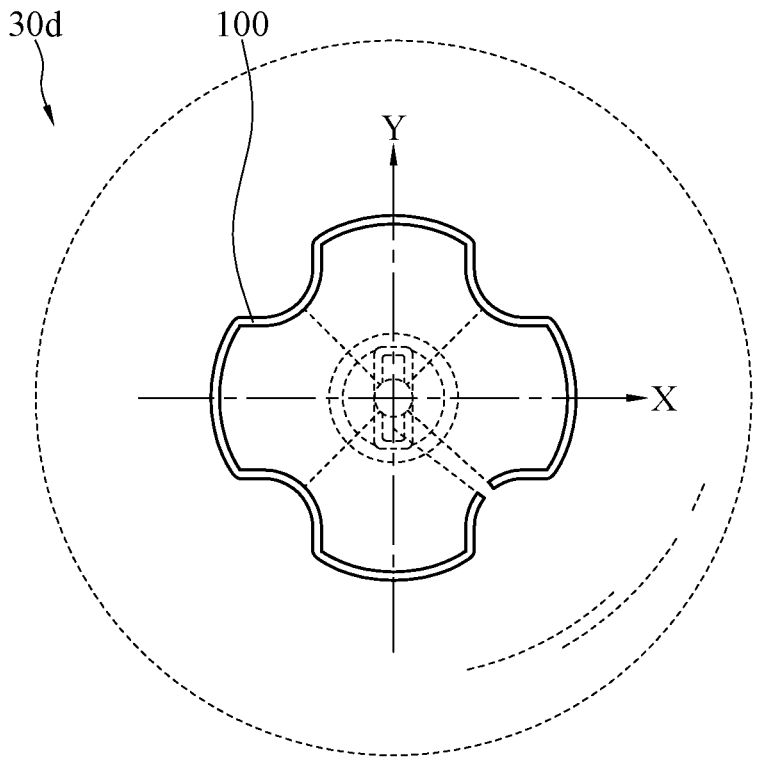

Please refer to FIGS. 15A-15C. FIGS. 15A-15C are respectively a perspective view, a side view, and a top view of an LED light bulb 30*d* according to an embodiment of the present invention. The LED light bulb 30*d* comprising an LED filament 100 is analogous to the discussed LED light bulbs in the above embodiments. A difference between the LED light bulb 30*d* and the discussed LED light bulbs is that the LED filament 100 of the LED light bulb 30*d* has a modified structure. Portions of the LED filament 100 presented in different quadrants in the side view or in the top view may be in line symmetry or in point symmetry in brightness while the LED filament 100 operates. As shown in FIG. 15B, both of the portions of the LED filament 100 presented in the first quadrant and the second quadrant and the portions of the LED filament 100 presented in the third quadrant and the fourth quadrant may be in line symmetry with the Y-axis in the side view in structure, in length, in emitting direction, in arrangement of LED chips, in power configuration of LED chips with different power, in refractive index, or in surface roughness. As shown in FIG. 15C, the portions of the LED filament 100 presented in the four quadrants may be in point symmetry with the origin and in line symmetry with the Y-axis and the X-axis in the top view in structure, in length, in emitting direction, in arrangement of LED chips, in power configuration of LED chips with different power, in refractive index, or in surface roughness.

Figure 16A:
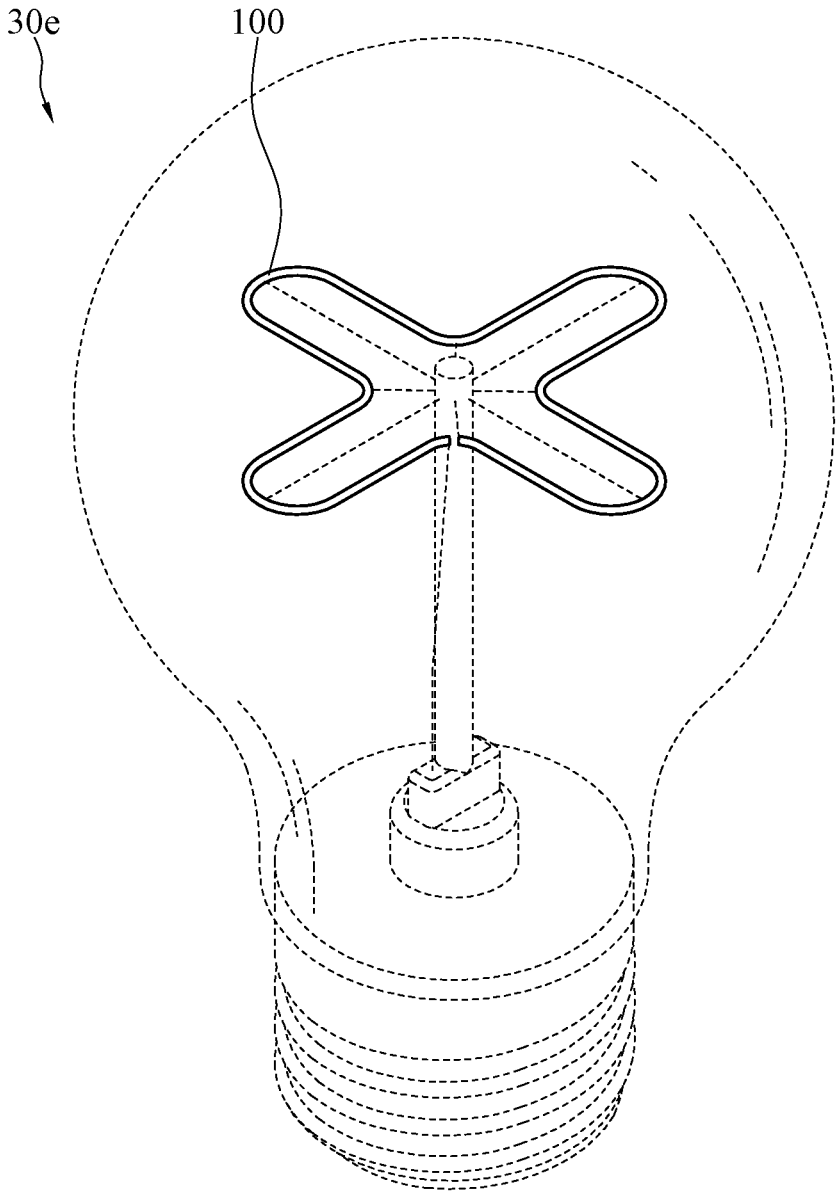
FIGS. 16A-16C are respectively a perspective view, a side view, and a top view of an LED light bulb according to an embodiment of the present invention.
Figure 16B:
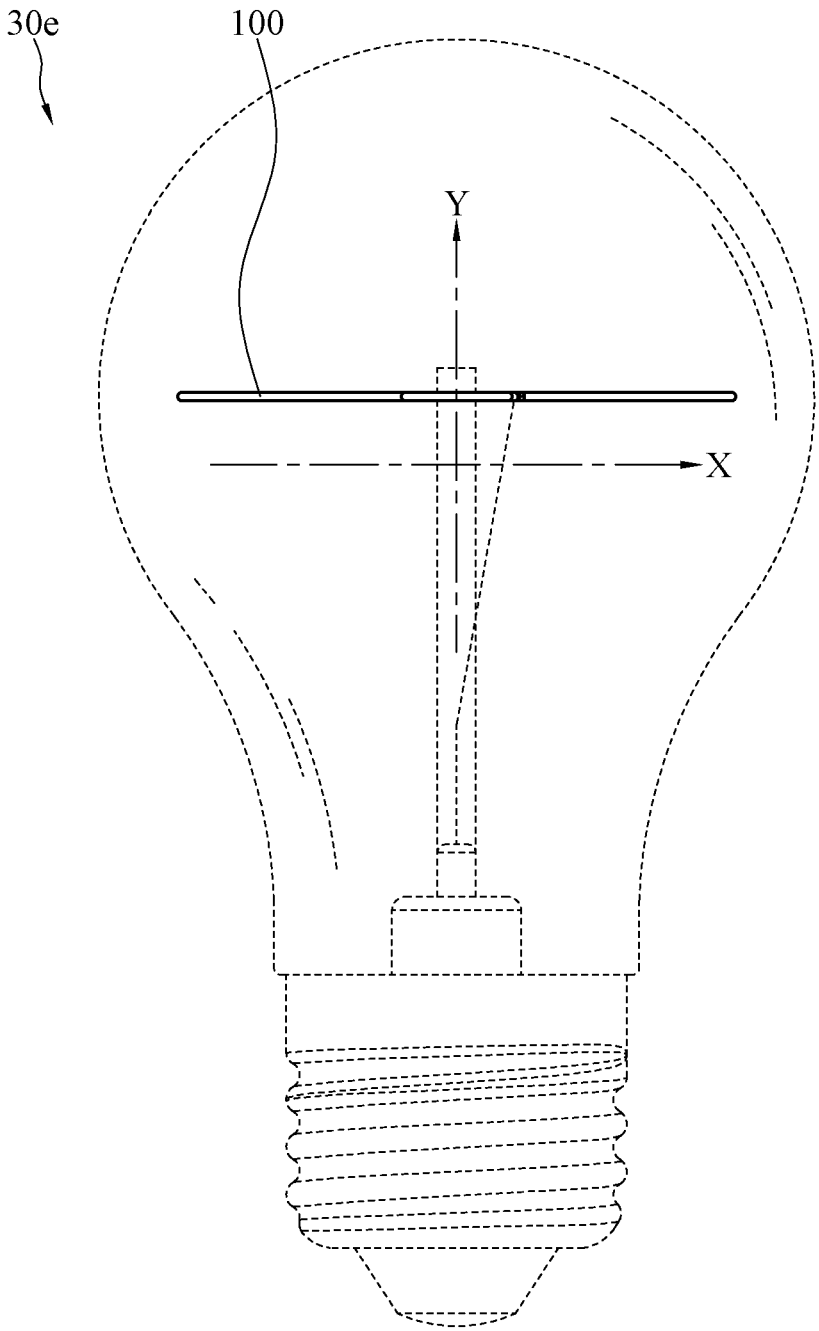
Figure 16C:
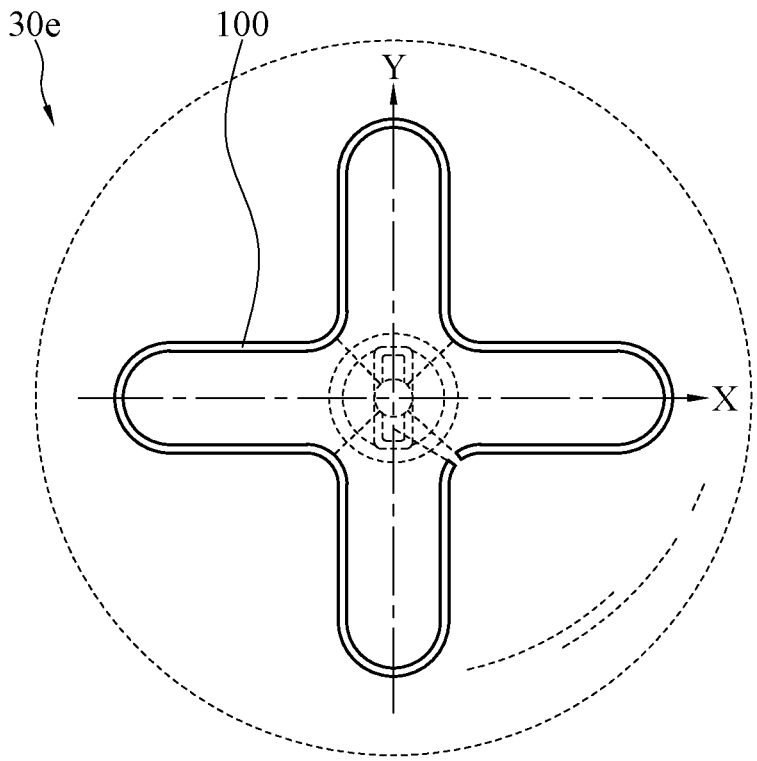

Please refer to FIGS. 16A-16C. FIGS. 16A-16C are respectively a perspective view, a side view, and a top view of an LED light bulb 30*e* according to an embodiment of the present invention. The LED light bulb 30*e* comprising an LED filament 100 is analogous to the discussed LED light bulbs in the above embodiments. A difference between the LED light bulb 30*e* and the discussed LED light bulbs is that the LED filament 100 of the LED light bulb 30*e* has a modified structure. Portions of the LED filament 100 presented in different quadrants in the side view or in the top view may be in line symmetry or in point symmetry in brightness while the LED filament 100 operates. As shown in FIG. 16B, the portions of the LED filament 100 presented in the first quadrant and the second quadrant may be in line symmetry with the Y-axis in the side view in structure, in length, in emitting direction, in arrangement of LED chips, in power configuration of LED chips with different power, in refractive index, or in surface roughness. As shown in FIG. 16C, the portions of the LED filament 100 presented in the four quadrants may be in point symmetry with the origin and in line symmetry with the Y-axis and the X-axis in the top view in structure, in length, in emitting direction, in arrangement of LED chips, in power configuration of LED chips with different power, in refractive index, or in surface roughness.

Figure 17A:
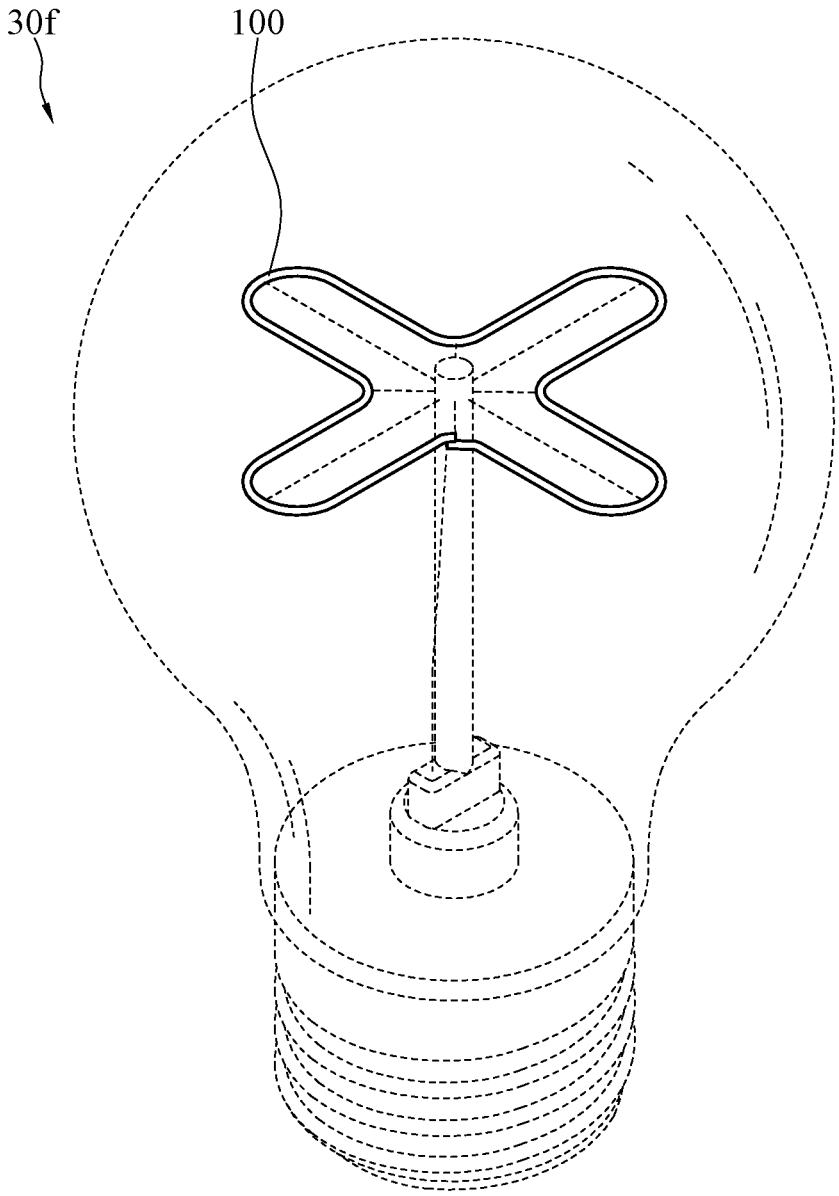
FIGS. 17A-17C are respectively a perspective view, a side view, and a top view of an LED light bulb according to an embodiment of the present invention.
Figure 17B:
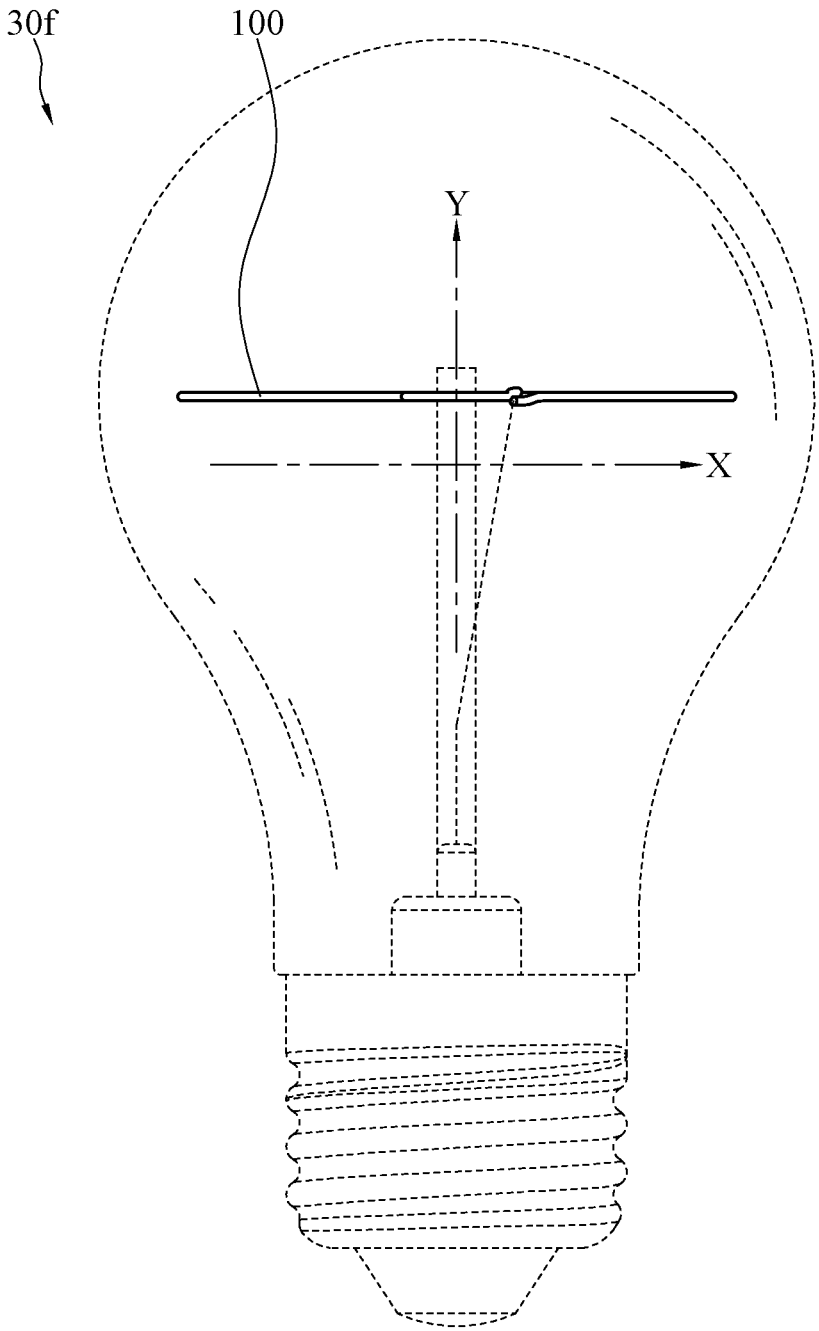
Figure 17C:
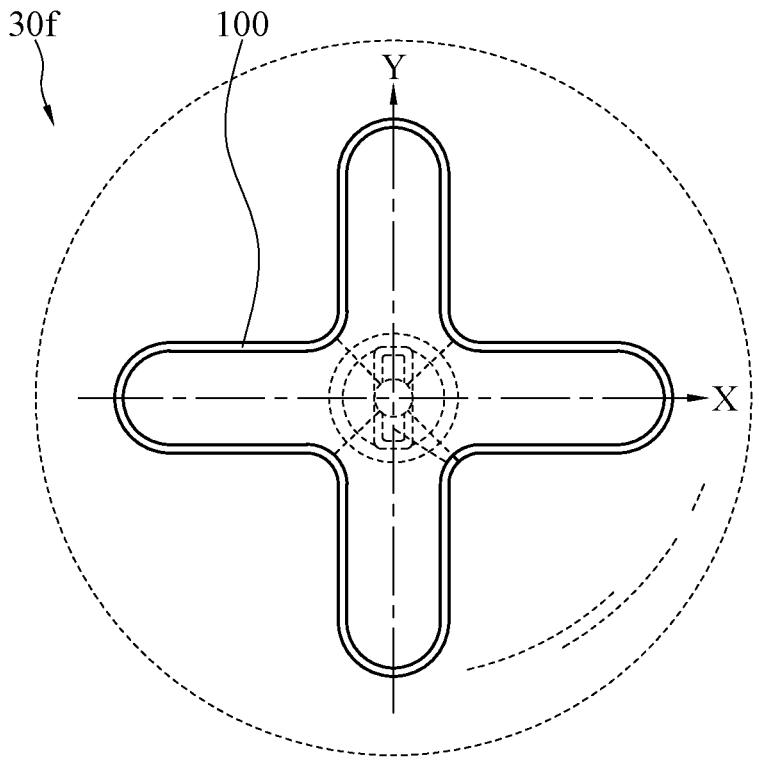

Please refer to FIGS. 17A-17C. FIGS. 17A-17C are respectively a perspective view, a side view, and a top view of an LED light bulb 30*f* according to an embodiment of the present invention. The LED light bulb 30*f* comprising an LED filament 100 is analogous to the discussed LED light bulbs in the above embodiments. A difference between the LED light bulb 30*f* and the discussed LED light bulbs is that the LED filament 100 of the LED light bulb 30*f* has a modified structure. Portions of the LED filament 100 presented in different quadrants in the side view or in the top view may be in line symmetry or in point symmetry in brightness while the LED filament 100 operates. As shown in FIG. 17B, the portions of the LED filament 100 presented in the first quadrant and the second quadrant may be in line symmetry with the Y-axis in the side view in structure, in length, in emitting direction, in arrangement of LED chips, in power configuration of LED chips with different power, in refractive index, or in surface roughness. As shown in FIG. 17C, the portions of the LED filament 100 presented in the four quadrants may be in point symmetry with the origin and in line symmetry with the Y-axis and the X-axis in the top view in structure, in length, in emitting direction, in arrangement of LED chips, in power configuration of LED chips with different power, in refractive index, or in surface roughness.

Figure 18A:
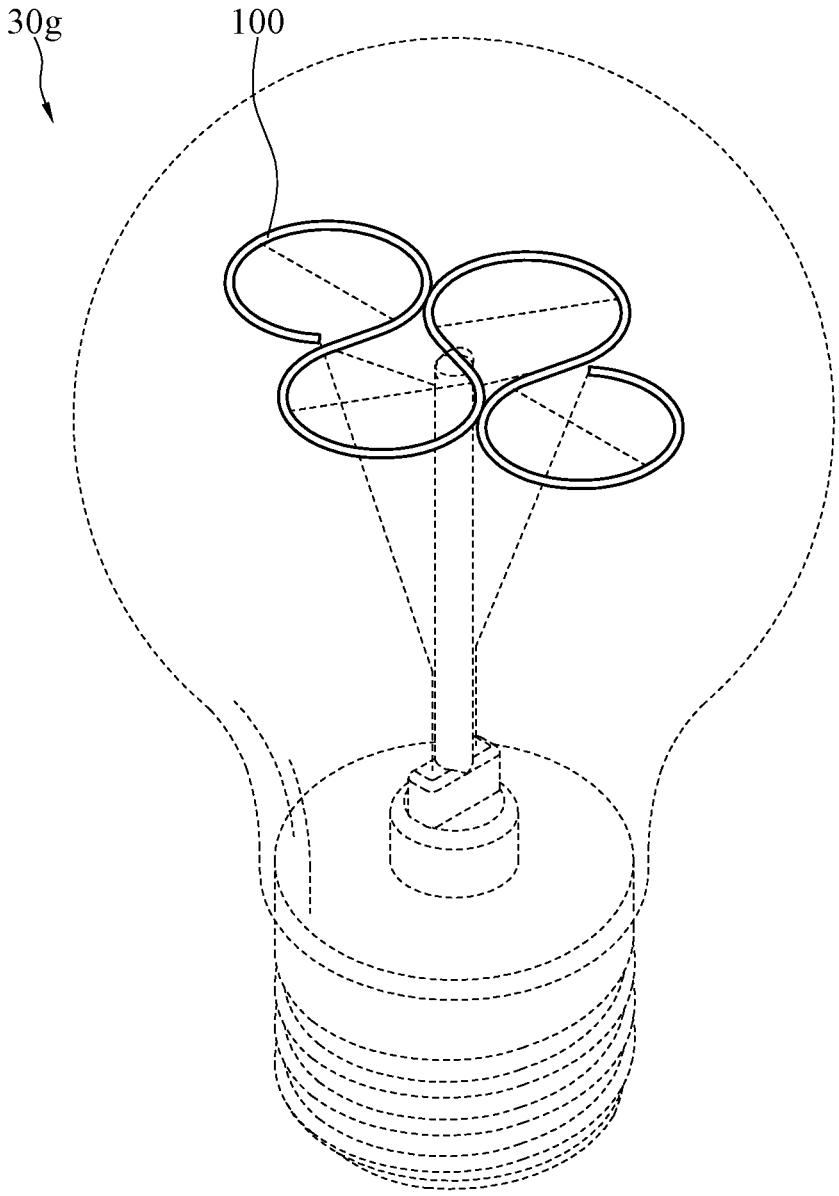
FIGS. 18A-18C are respectively a perspective view, a side view, and a top view of an LED light bulb according to an embodiment of the present invention.
Figure 18B:
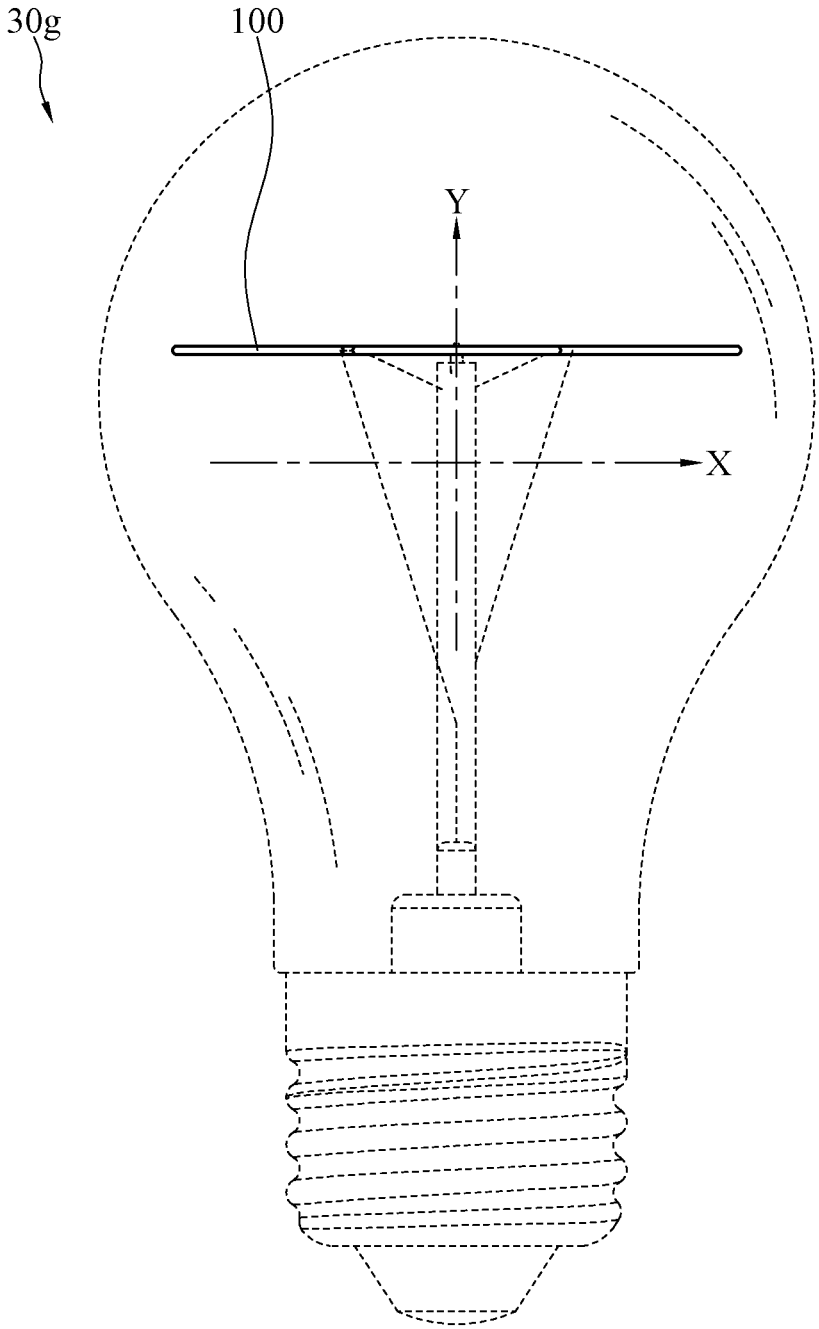
Figure 18C:
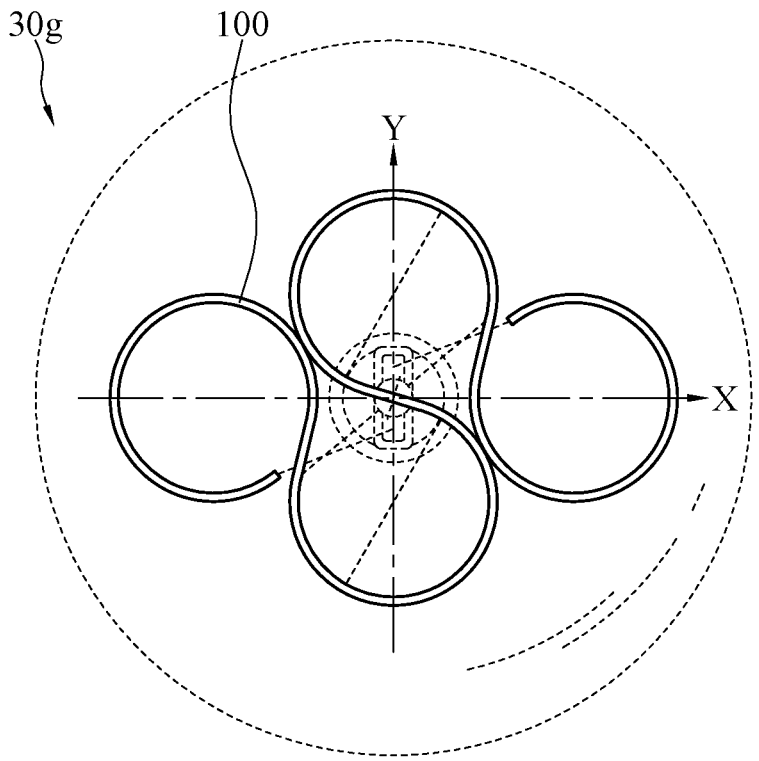

Please refer to FIGS. 18A-18C. FIGS. 18A-18C are respectively a perspective view, a side view, and a top view of an LED light bulb 30*g* according to an embodiment of the present invention. The LED light bulb 30*g* comprising an LED filament 100 is analogous to the discussed LED light bulbs in the above embodiments. A difference between the LED light bulb 30*g* and the discussed LED light bulbs is that the LED filament 100 of the LED light bulb 30*g* has a modified structure. Portions of the LED filament 100 presented in different quadrants in the side view or in the top view may be in line symmetry or in point symmetry in brightness while the LED filament 100 operates. As shown in FIG. 18B, the portions of the LED filament 100 presented in the first quadrant and the second quadrant may be in line symmetry with the Y-axis in the side view in structure, in length, in emitting direction, in arrangement of LED chips, in power configuration of LED chips with different power, in refractive index, or in surface roughness. As shown in FIG. 18C, the portions of the LED filament 100 presented in the four quadrants may be in point symmetry with the origin in the top view in structure, in length, in emitting direction, in arrangement of LED chips, in power configuration of LED chips with different power, in refractive index, or in surface roughness.

Figure 19A:
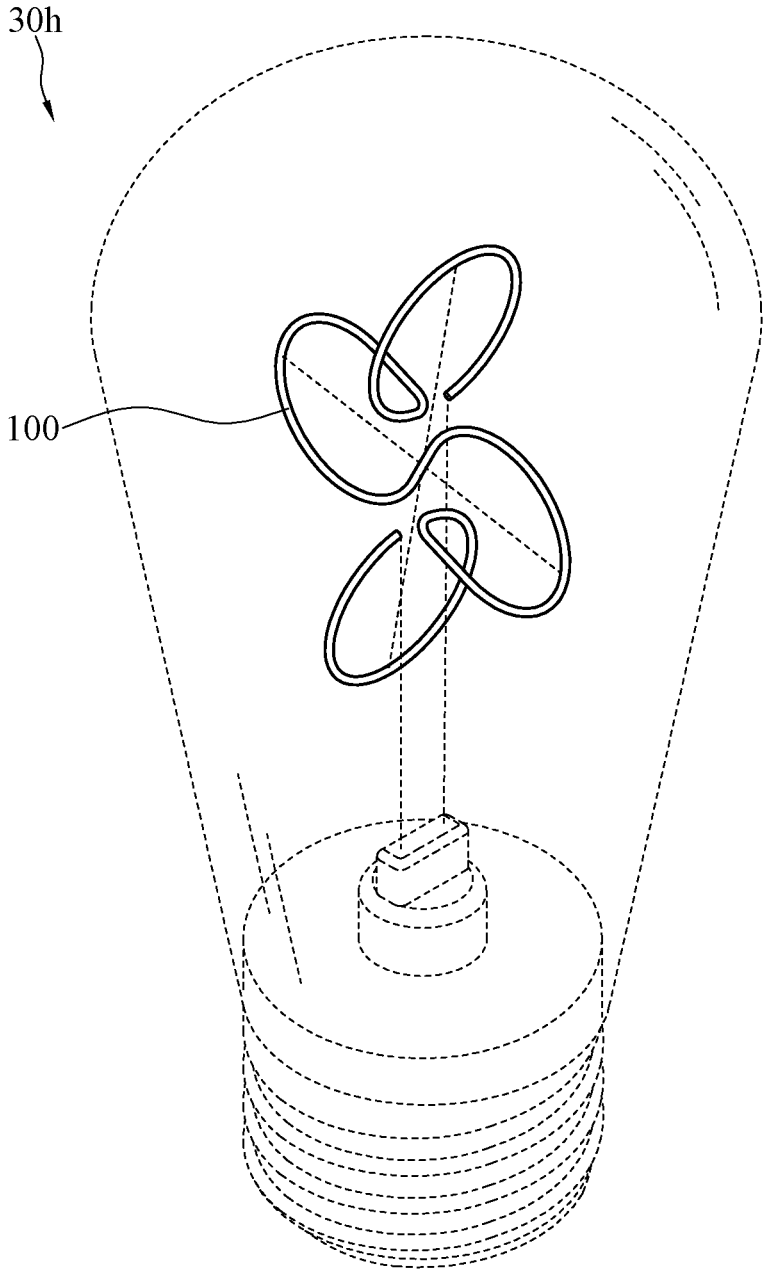
FIGS. 19A-19C are respectively a perspective view, a side view, and a top view of an LED light bulb according to an embodiment of the present invention.
Figure 19B:
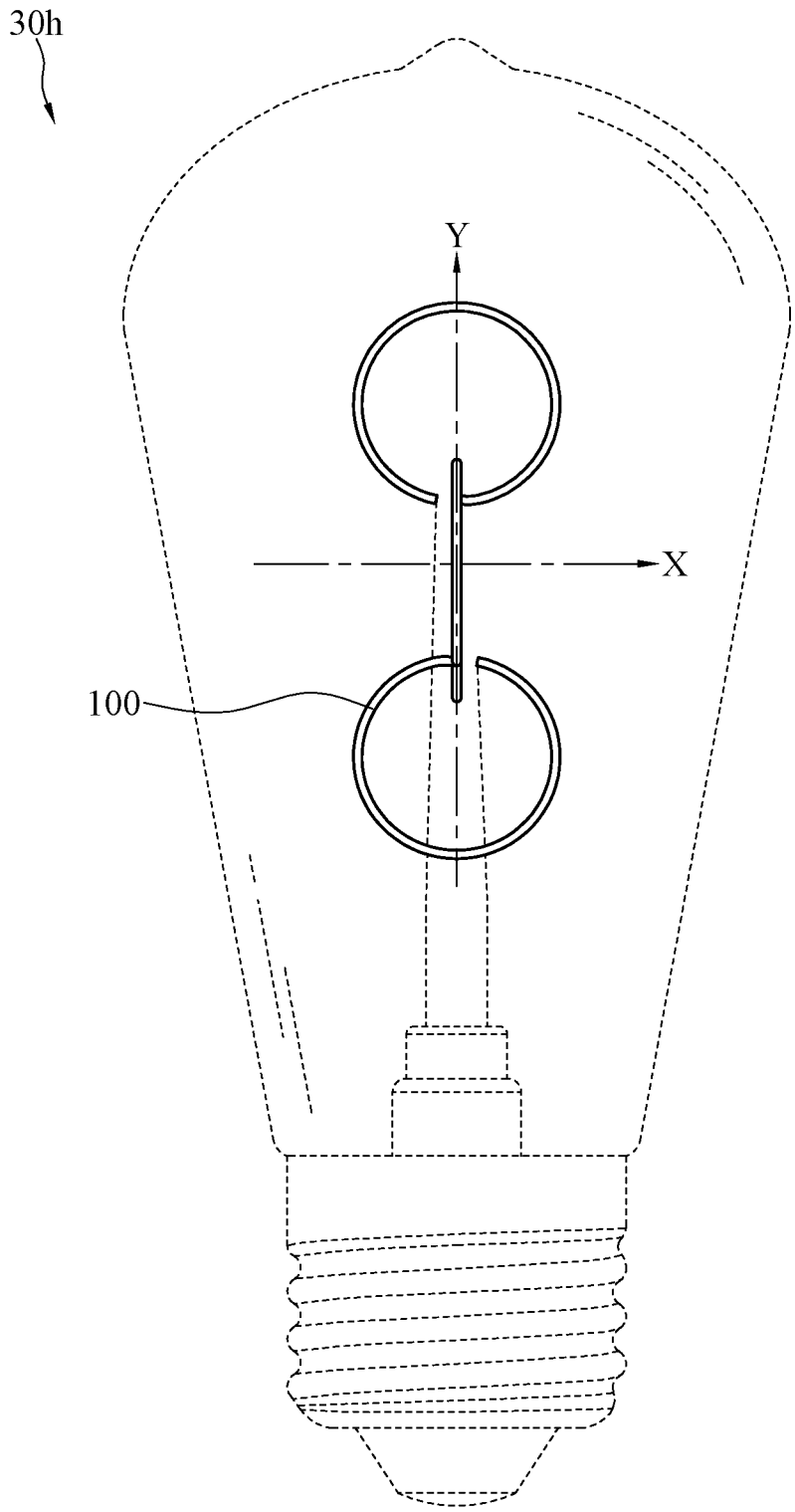
Figure 19C:
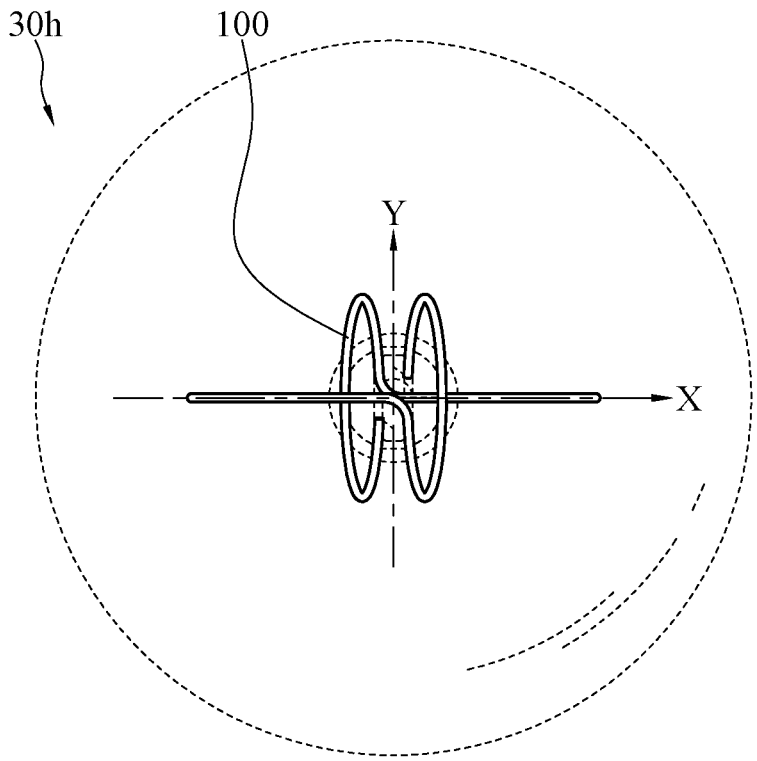

Please refer to FIGS. 19A-19C. FIGS. 19A-19C are respectively a perspective view, a side view, and a top view of an LED light bulb 30*h* according to an embodiment of the present invention. The LED light bulb 30*h* comprising an LED filament 100 is analogous to the discussed LED light bulbs in the above embodiments. A difference between the LED light bulb 30*h* and the discussed LED light bulbs is that the LED filament 100 of the LED light bulb 30*h* has a modified structure. Portions of the LED filament 100 presented in different quadrants in the side view or in the top view may be in line symmetry or in point symmetry in brightness while the LED filament 100 operates. As shown in FIG. 19B, the portions of the LED filament 100 presented in the four quadrants may be in point symmetry with the origin in the side view in structure, in length, in emitting direction, in arrangement of LED chips, in power configuration of LED chips with different power, in refractive index, or in surface roughness. As shown in FIG. 19C, the portions of the LED filament 100 presented in the four quadrants may be in point symmetry with the origin in the top view in structure, in length, in emitting direction, in arrangement of LED chips, in power configuration of LED chips with different power, in refractive index, or in surface roughness.

Figure 20A:
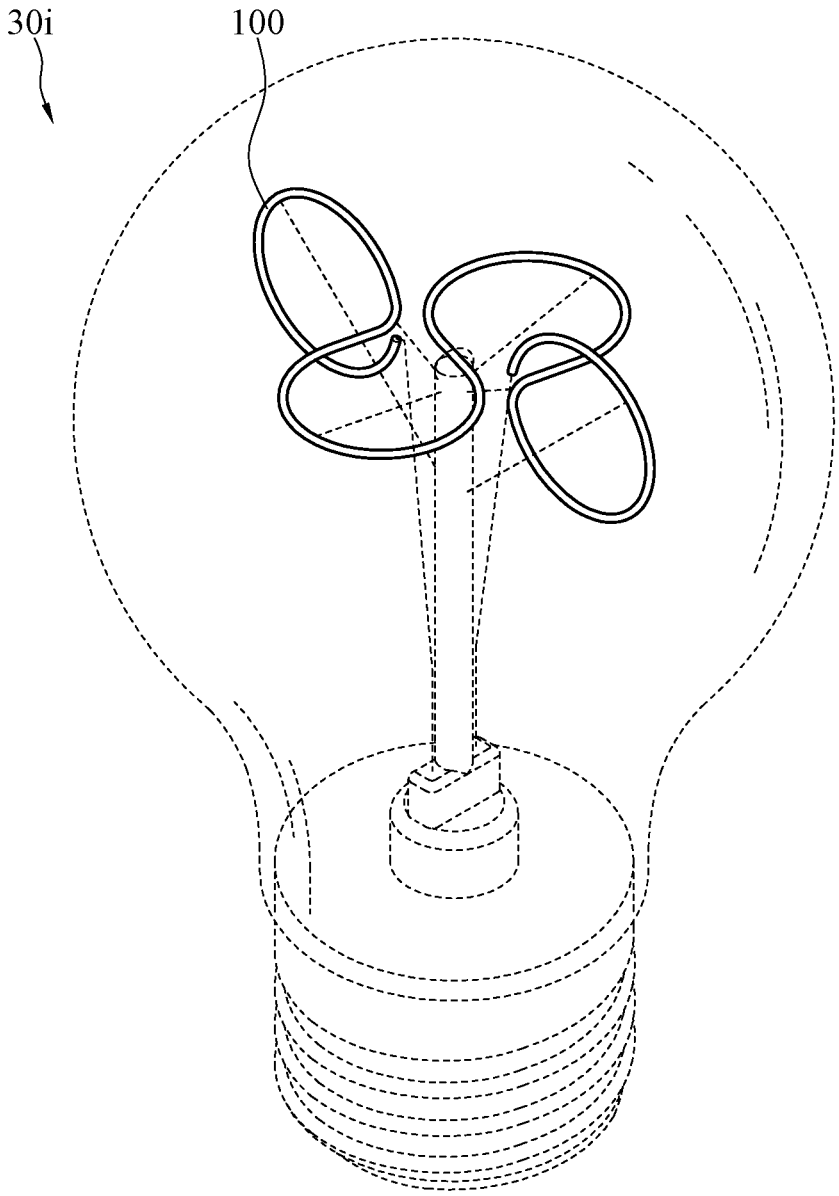
FIGS. 20A-20C are respectively a perspective view, a side view, and a top view of an LED light bulb according to an embodiment of the present invention.
Figure 20B:
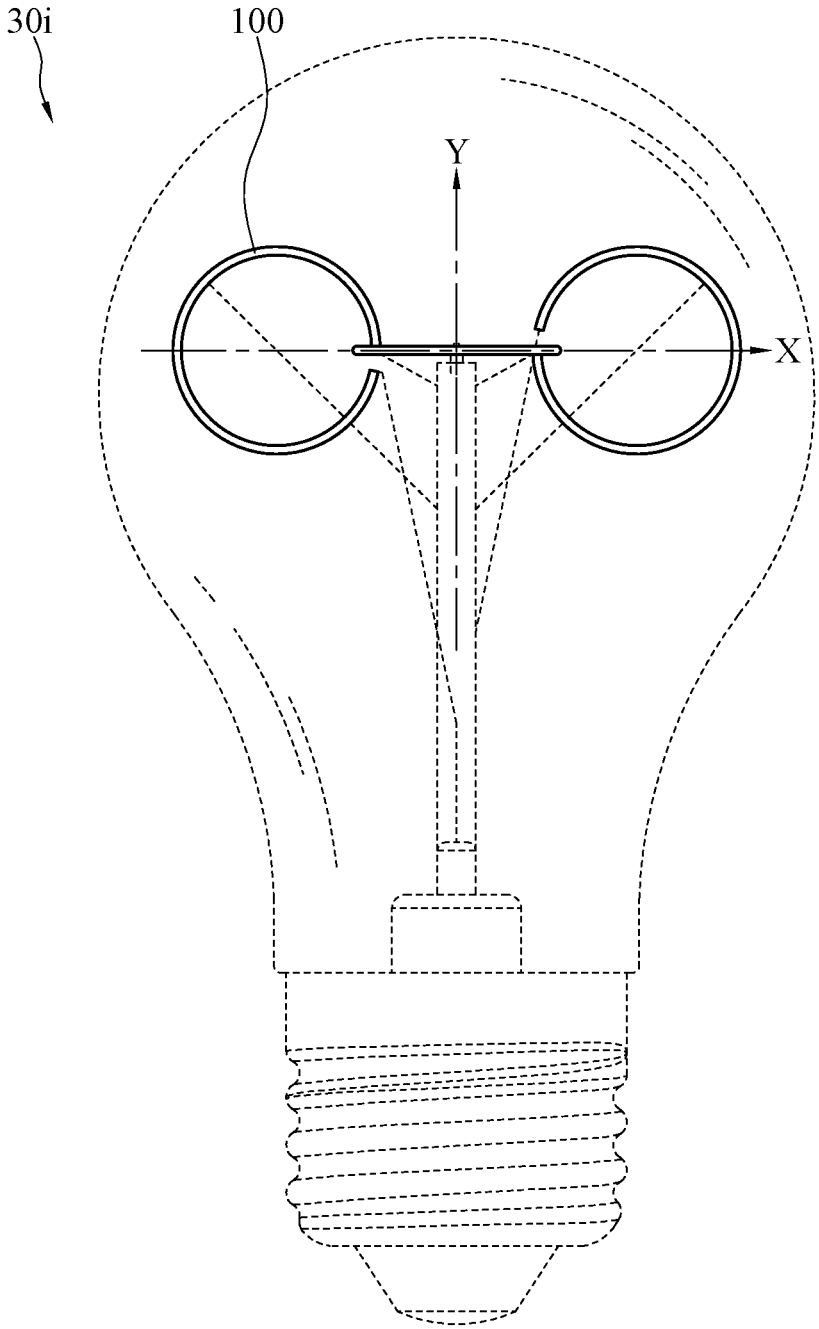
Figure 20C:
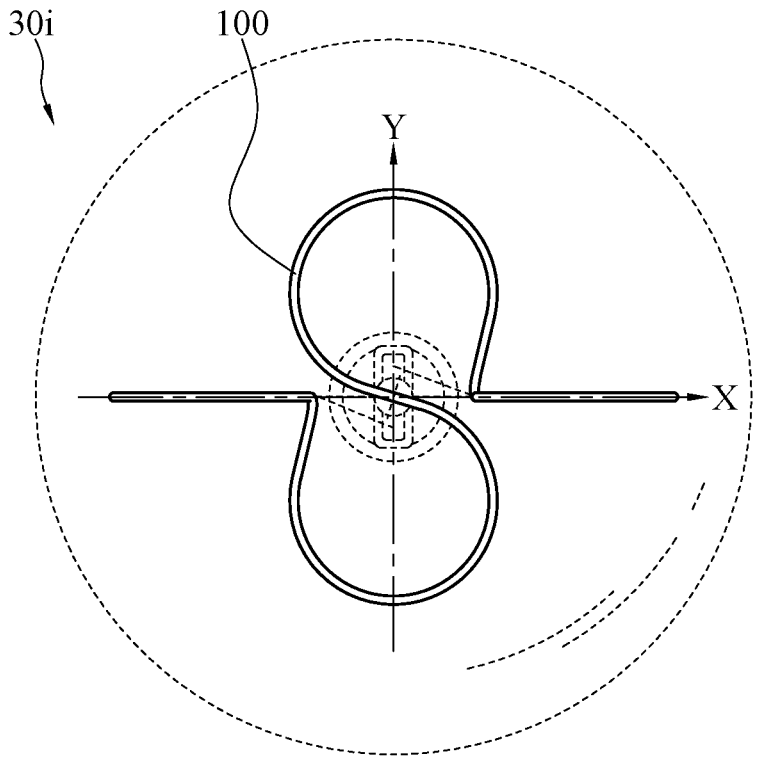

Please refer to FIGS. 20A-20C. FIGS. 20A-20C are respectively a perspective view, a side view, and a top view of an LED light bulb 30*i* according to an embodiment of the present invention. The LED light bulb 30*i* comprising an LED filament 100 is analogous to the discussed LED light bulbs in the above embodiments. A difference between the LED light bulb 30*i* and the discussed LED light bulbs is that the LED filament 100 of the LED light bulb 30*i* has a modified structure. Portions of the LED filament 100 presented in different quadrants in the side view or in the top view may be in line symmetry or in point symmetry in brightness while the LED filament 100 operates. As shown in FIG. 20B, the portions of the LED filament 100 presented in the four quadrants may be in point symmetry with the origin in the side view in structure, in length, in emitting direction, in arrangement of LED chips, in power configuration of LED chips with different power, in refractive index, or in surface roughness. As shown in FIG. 20C, the portions of the LED filament 100 presented in the four quadrants may be in point symmetry with the origin in the top view in structure, in length, in emitting direction, in arrangement of LED chips, in power configuration of LED chips with different power, in refractive index, or in surface roughness.

Figure 21A:
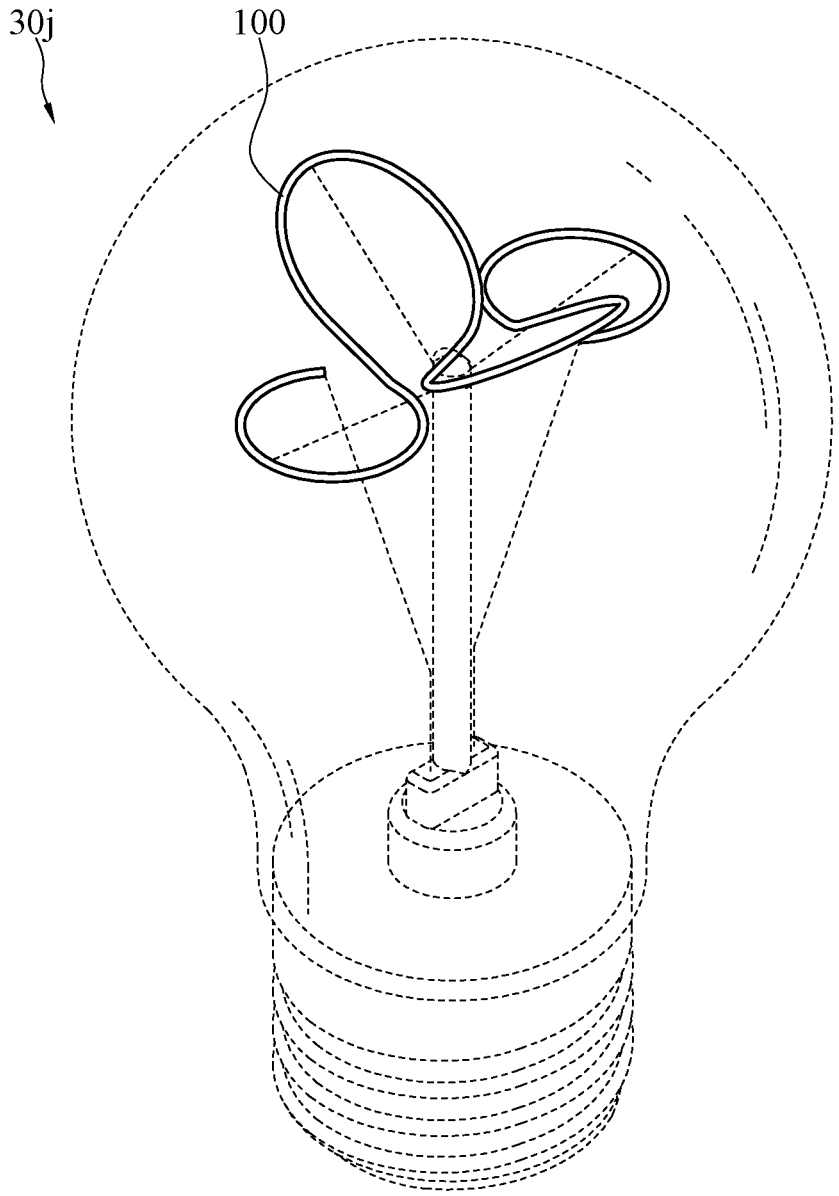
FIGS. 21A-21C are respectively a perspective view, a side view, and a top view of an LED light bulb according to an embodiment of the present invention.
Figure 21B:
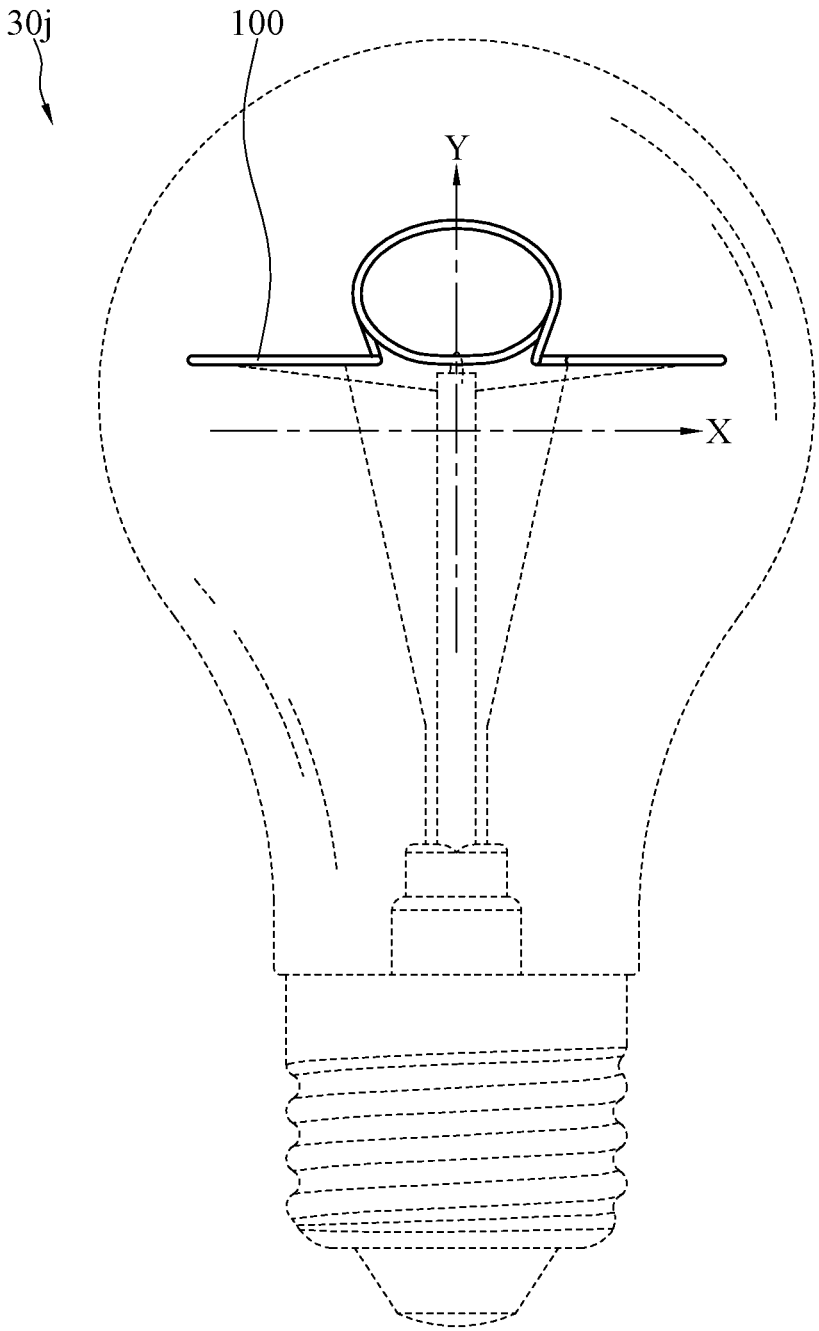
Figure 21C:
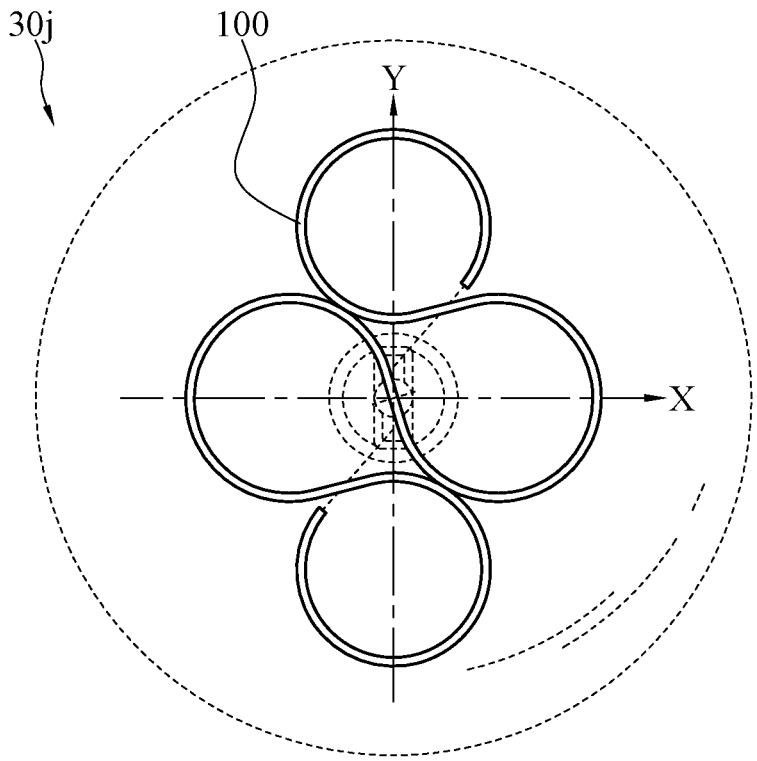

Please refer to FIGS. 21A-21C. FIGS. 21A-21C are respectively a perspective view, a side view, and a top view of an LED light bulb 30*j* according to an embodiment of the present invention. The LED light bulb 30*j* comprising an LED filament 100 is analogous to the discussed LED light bulbs in the above embodiments. A difference between the LED light bulb 30*j* and the discussed LED light bulbs is that the LED filament 100 of the LED light bulb 30*j* has a modified structure. Portions of the LED filament 100 presented in different quadrants in the side view or in the top view may be in line symmetry or in point symmetry in brightness while the LED filament 100 operates. As shown in FIG. 21B, the portions of the LED filament 100 presented in the first quadrant and the second quadrant may be in line symmetry with the Y-axis in the side view in structure, in length, in emitting direction, in arrangement of LED chips, in power configuration of LED chips with different power, in refractive index, or in surface roughness. As shown in FIG. 21C, the portions of the LED filament 100 presented in the four quadrants may be in point symmetry with the origin in the top view in structure, in length, in emitting direction, in arrangement of LED chips, in power configuration of LED chips with different power, in refractive index, or in surface roughness.

Figure 22A:
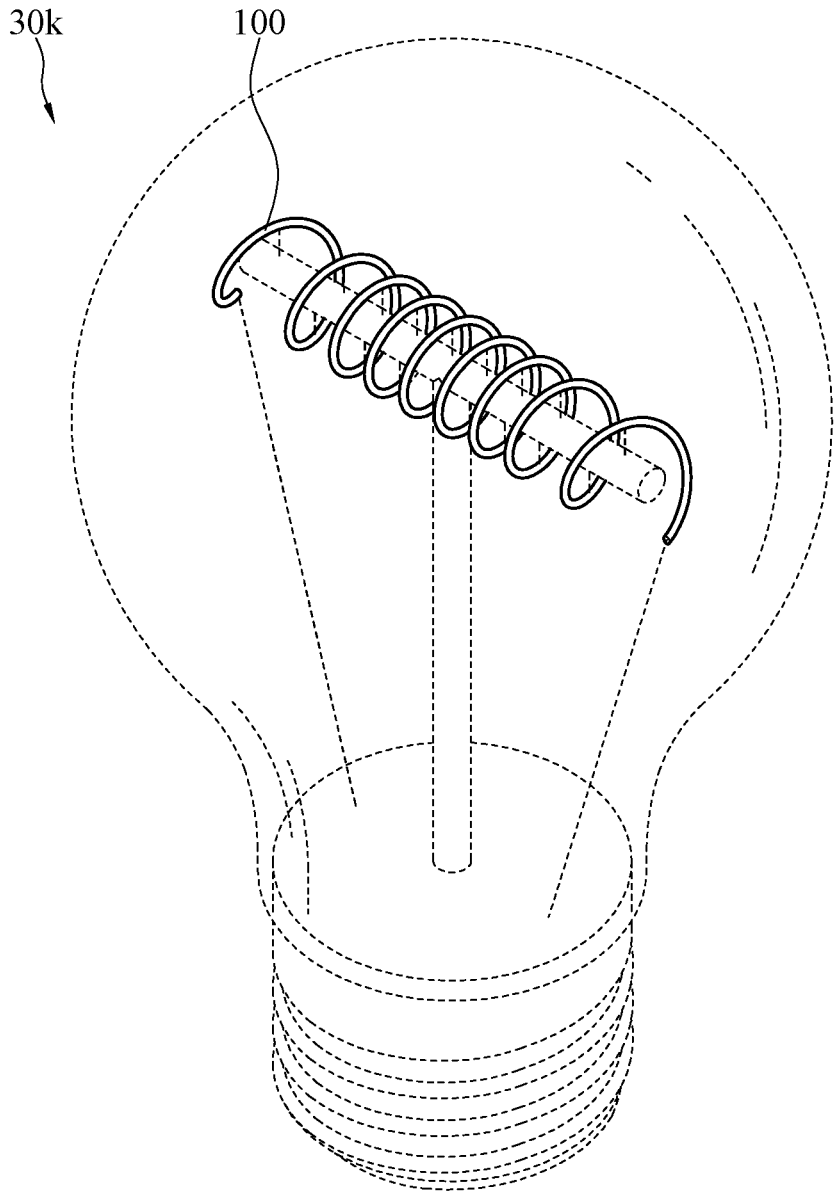
FIGS. 22A-22C are respectively a perspective view, a side view, and a top view of an LED light bulb according to an embodiment of the present invention.
Figure 22B:
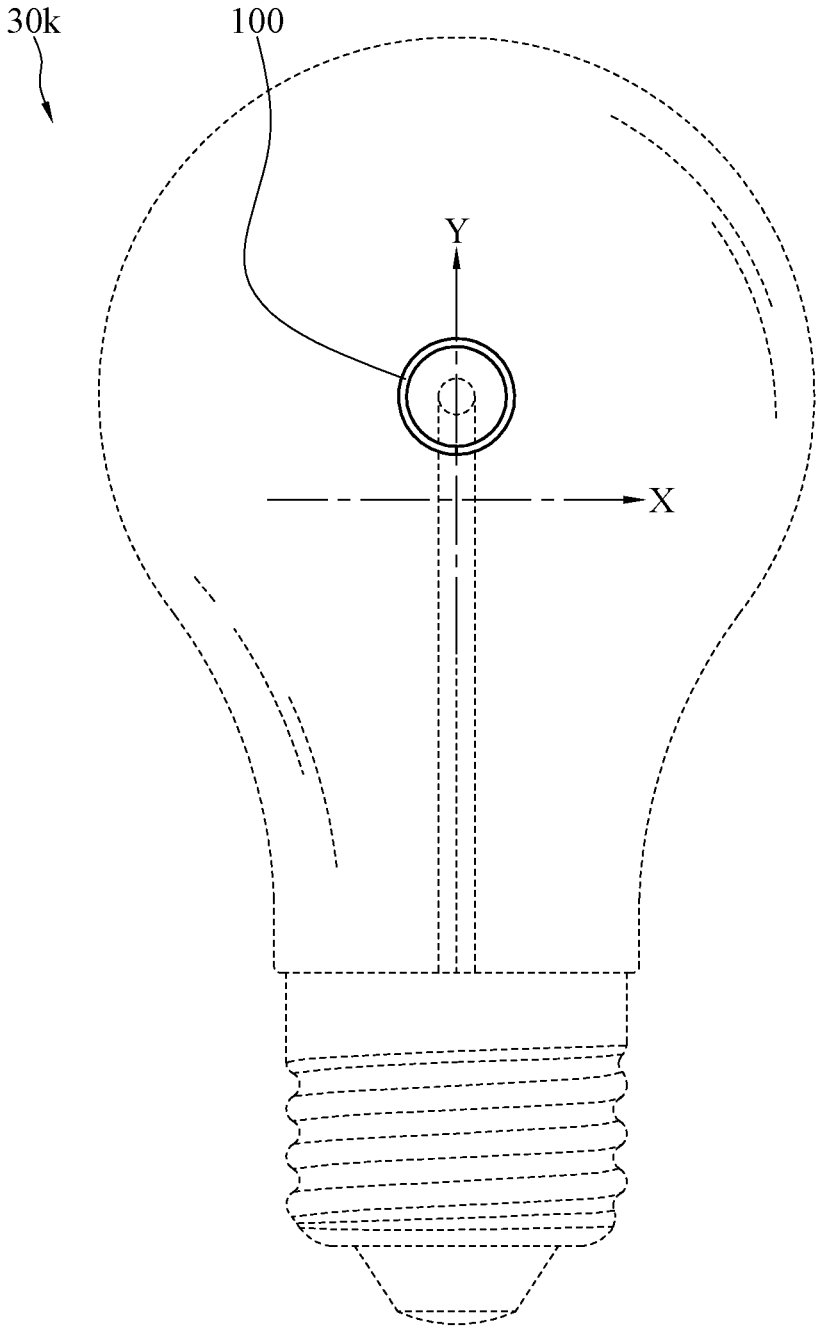
Figure 22C:
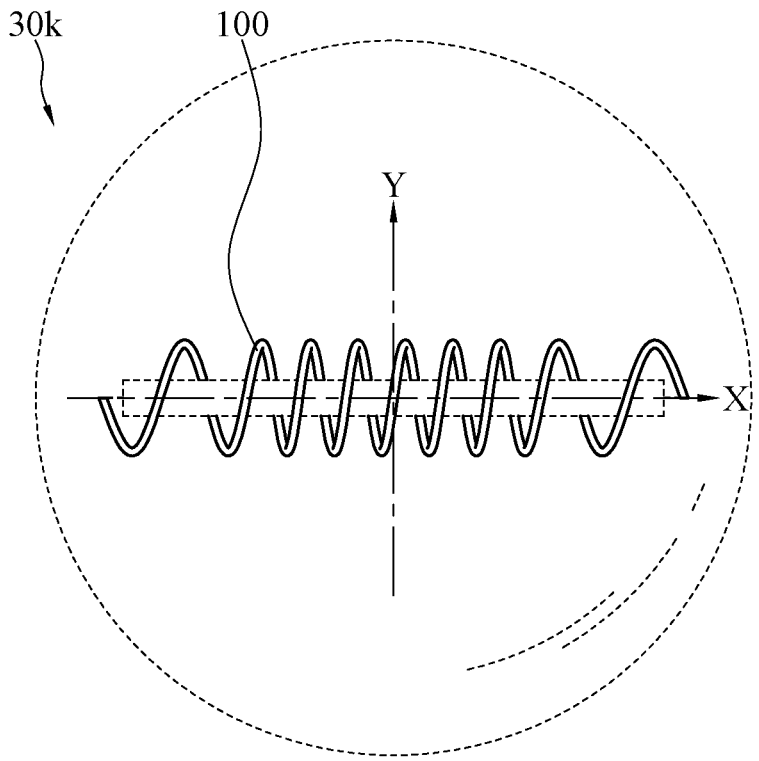

Please refer to FIGS. 22A-22C. FIGS. 22A-22C are respectively a perspective view, a side view, and a top view of an LED light bulb 30*k* according to an embodiment of the present invention. The LED light bulb 30*k* comprising an LED filament 100 is analogous to the discussed LED light bulbs in the above embodiments. A difference between the LED light bulb 30*k* and the discussed LED light bulbs is that the LED filament 100 of the LED light bulb 30*k* has a modified structure. Portions of the LED filament 100 presented in different quadrants in the side view or in the top view may be in line symmetry or in point symmetry in brightness while the LED filament 100 operates. As shown in FIG. 22B, the portions of the LED filament 100 presented in the first quadrant and the second quadrant may be in line symmetry with the Y-axis in the side view in structure, in length, in emitting direction, in arrangement of LED chips, in power configuration of LED chips with different power, in refractive index, or in surface roughness. As shown in FIG. 22C, the portions of the LED filament 100 presented in the four quadrants may be in point symmetry with the origin in the top view in structure, in length, in emitting direction, in arrangement of LED chips, in power configuration of LED chips with different power, in refractive index, or in surface roughness.

Figure 23A:
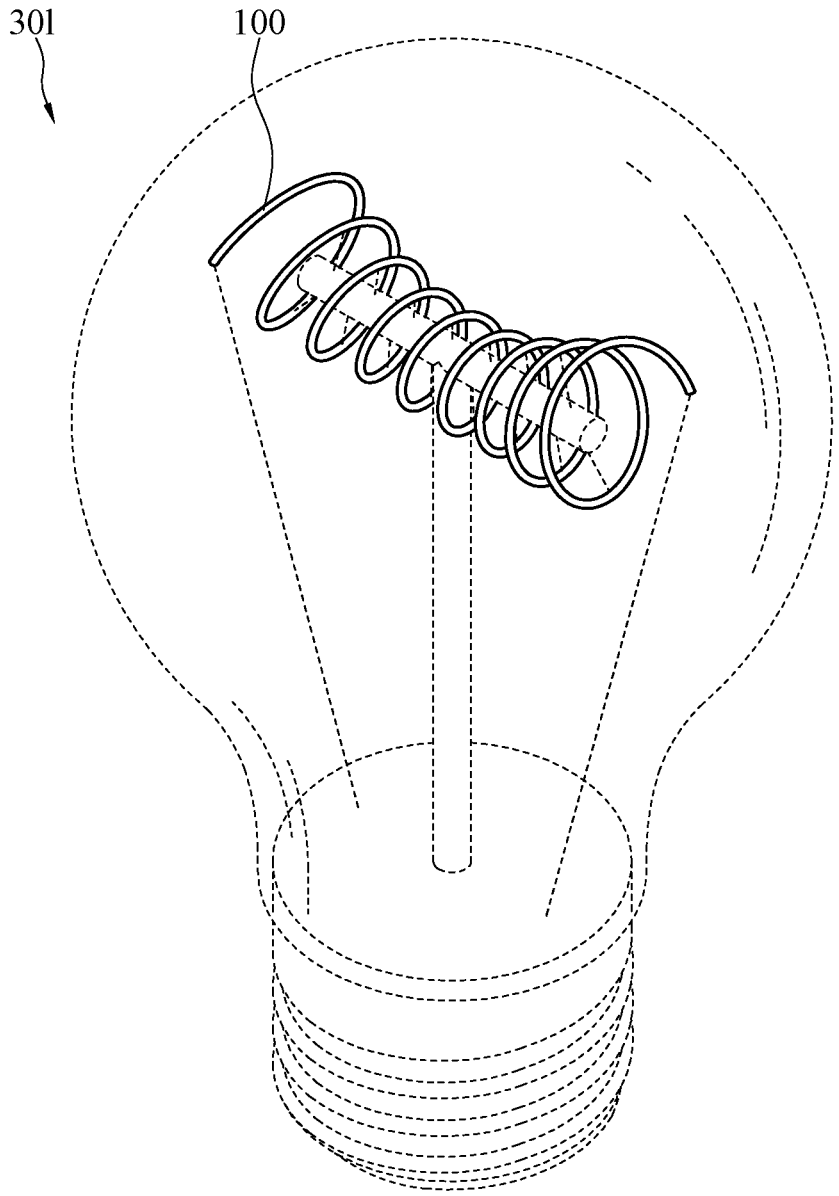
FIGS. 23A-23C are respectively a perspective view, a side view, and a top view of an LED light bulb according to an embodiment of the present invention.
Figure 23B:
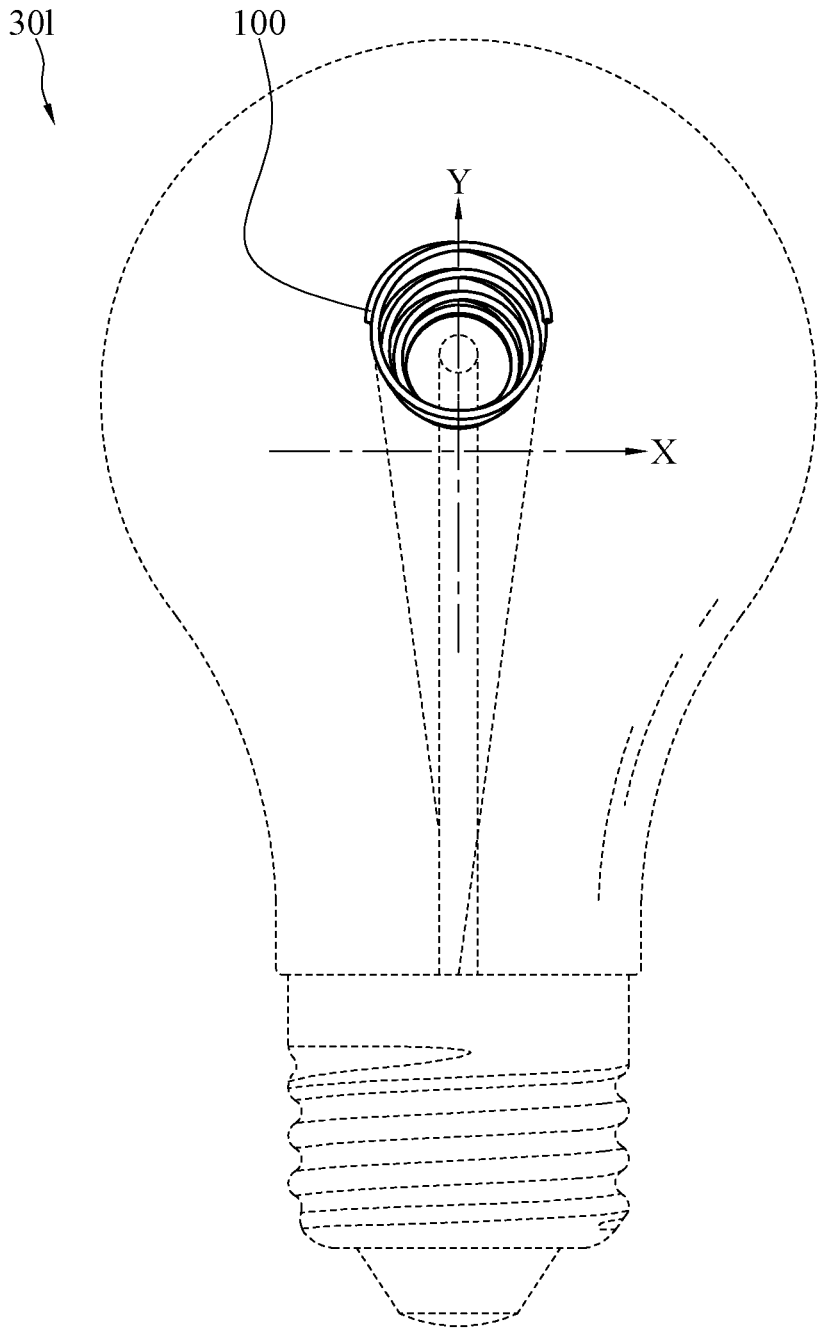
Figure 23C:
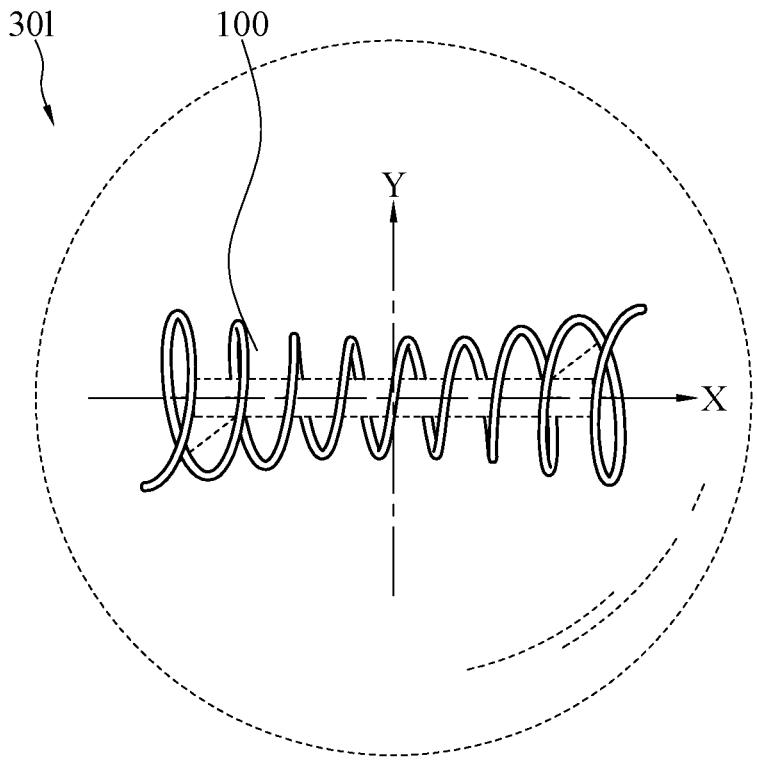

Please refer to FIGS. 23A-23C. FIGS. 23A-23C are respectively a perspective view, a side view, and a top view of an LED light bulb 30*l* according to an embodiment of the present invention. The LED light bulb 30*l* comprising an LED filament 100 is analogous to the discussed LED light bulbs in the above embodiments. A difference between the LED light bulb 30*l* and the discussed LED light bulbs is that the LED filament 100 of the LED light bulb 30*l* has a modified structure. Portions of the LED filament 100 presented in different quadrants in the side view or in the top view may be in line symmetry or in point symmetry in brightness while the LED filament 100 operates. As shown in FIG. 23B, the portions of the LED filament 100 presented in the first quadrant and the second quadrant may be substantially in line symmetry with the Y-axis in the side view in structure, in length, in emitting direction, in arrangement of LED chips, in power configuration of LED chips with different power, in refractive index, or in surface roughness. As shown in FIG. 23C, the portions of the LED filament 100 presented in the four quadrants may be in point symmetry with the origin in the top view in structure, in length, in emitting direction, in arrangement of LED chips, in power configuration of LED chips with different power, in refractive index, or in surface roughness.

Figure 24A:
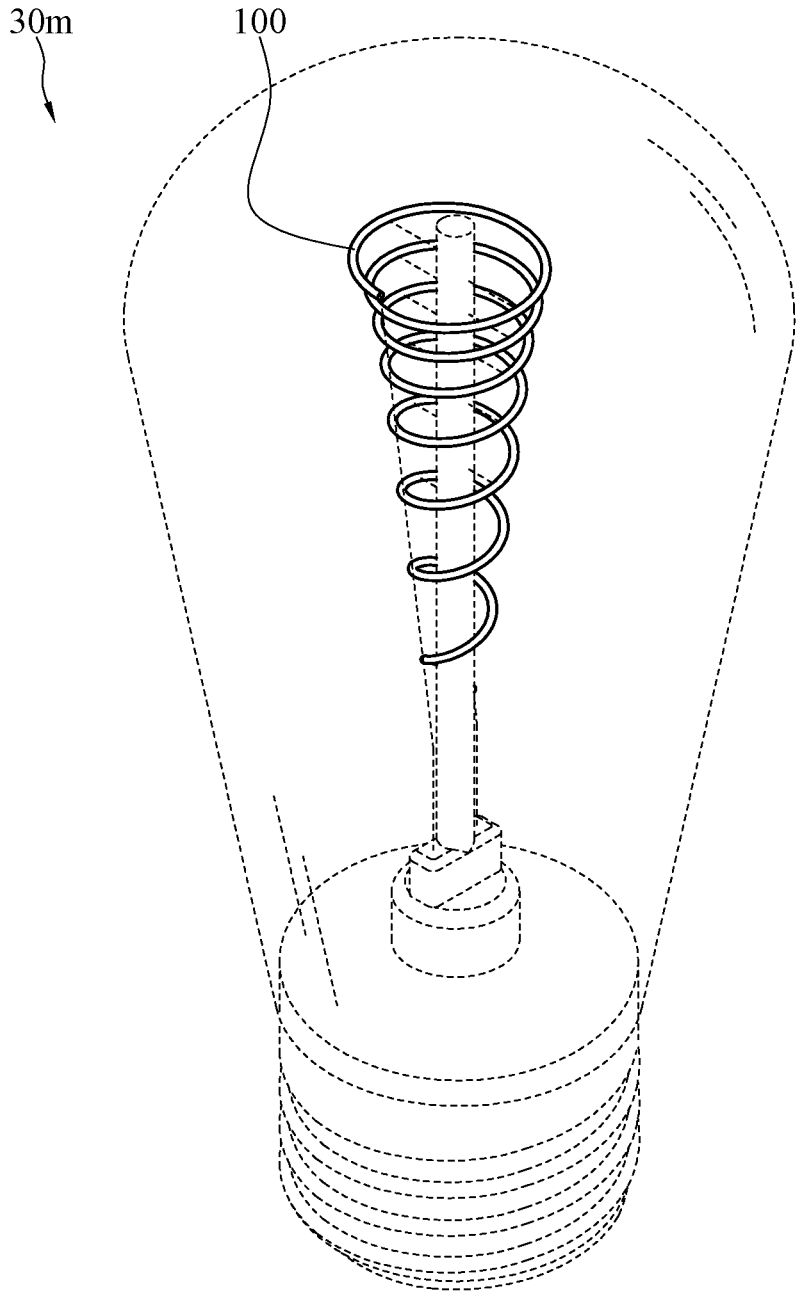
FIGS. 24A and 24B are respectively a perspective view and a top view of an LED light bulb according to an embodiment of the present invention.
Figure 24B:
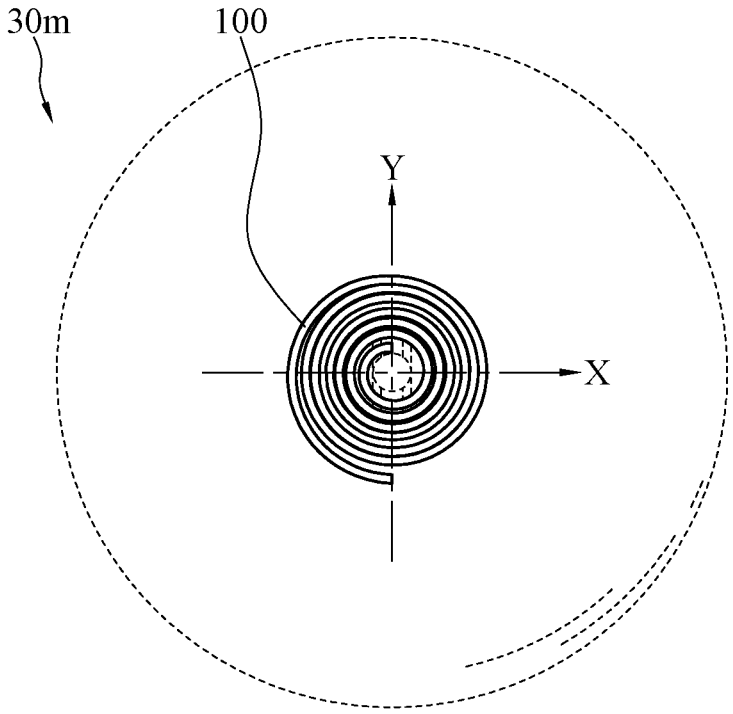

Please refer to FIGS. 24A and 24B. FIGS. 24A and 21B are respectively a perspective view and a top view of an LED light bulb 30*m* according to an embodiment of the present invention. The LED light bulb 30*m* comprising an LED filament 100 is analogous to the discussed LED light bulbs in the above embodiments. A difference between the LED light bulb 30*m* and the discussed LED light bulbs is that the LED filament 100 of the LED light bulb 30*m* has a modified structure. Portions of the LED filament 100 presented in different quadrants in the top view may be in line symmetry in brightness while the LED filament 100 operates. As shown in FIG. 24B, the portions of the LED filament 100 presented in the first quadrant and the second quadrant may be substantially in line symmetry with the Y-axis in the top view in structure, in length, in emitting direction, in arrangement of LED chips, in power configuration of LED chips with different power, in refractive index, or in surface roughness.

Figure 25A:
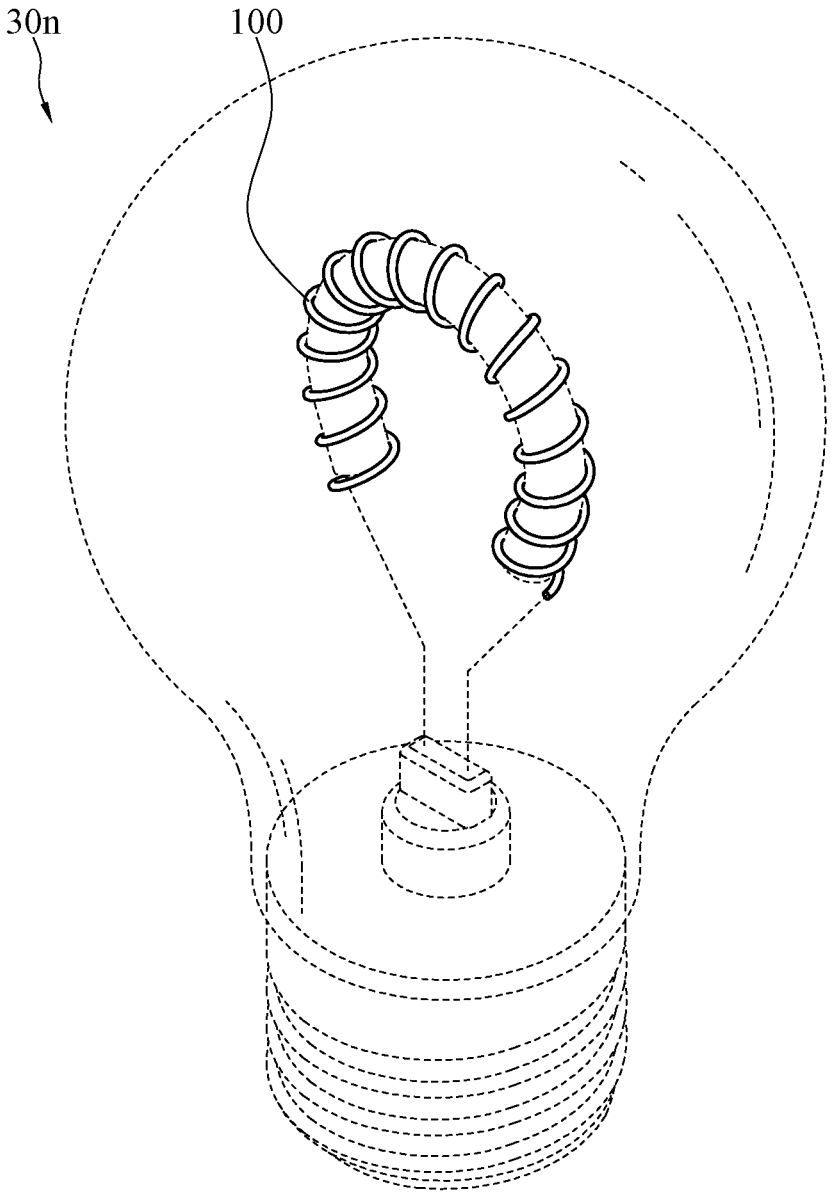
FIGS. 25A-25C are respectively a perspective view, a side view, and a top view of an LED light bulb according to an embodiment of the present invention.
Figure 25B:
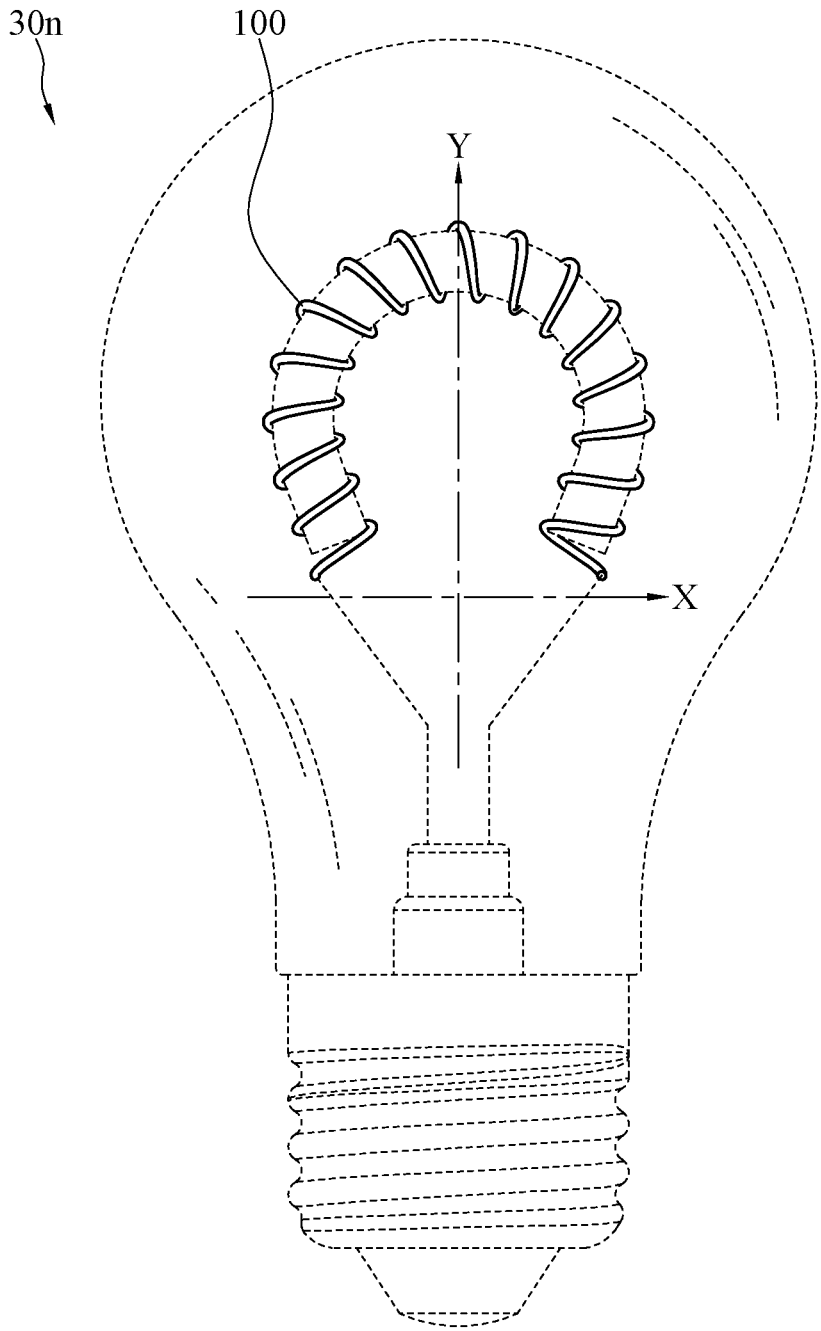
Figure 25C:
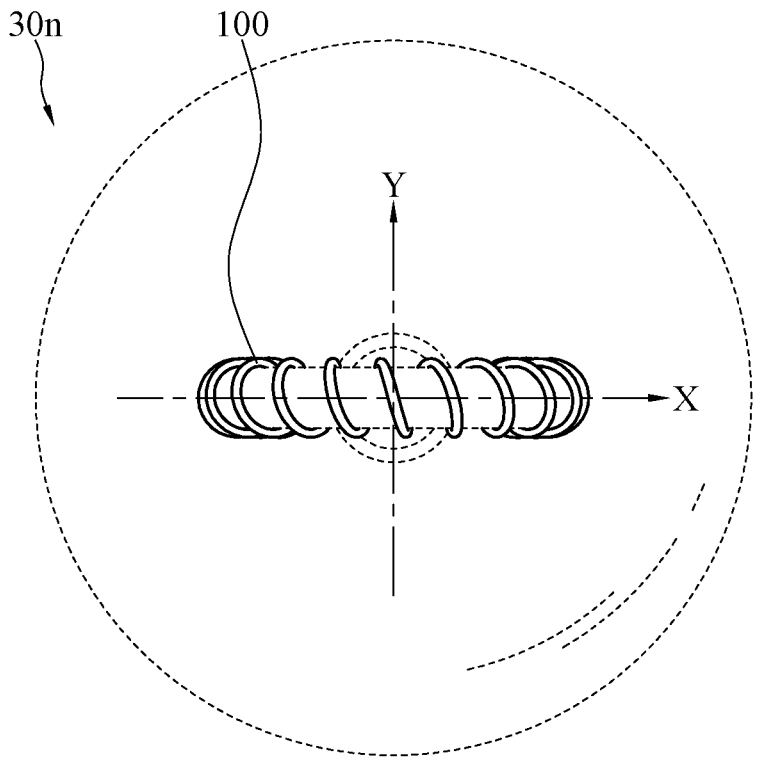

Please refer to FIGS. 25A-25C. FIGS. 25A-25C are respectively a perspective view, a side view, and a top view of an LED light bulb 30*n* according to an embodiment of the present invention. The LED light bulb 30*n* comprising an LED filament 100 is analogous to the discussed LED light bulbs in the above embodiments. A difference between the LED light bulb 30*n* and the discussed LED light bulbs is that the LED filament 100 of the LED light bulb 30*n* has a modified structure. Portions of the LED filament 100 presented in different quadrants in the side view or in the top view may be in line symmetry or in point symmetry in brightness while the LED filament 100 operates. As shown in FIG. 25B, the portions of the LED filament 100 presented in the first quadrant and the second quadrant may be substantially in line symmetry with the Y-axis in the side view in structure, in length, in emitting direction, in arrangement of LED chips, in power configuration of LED chips with different power, in refractive index, or in surface roughness. As shown in FIG. 25C, the portions of the LED filament 100 presented in the four quadrants may be in point symmetry with the origin in the top view in structure, in length, in emitting direction, in arrangement of LED chips, in power configuration of LED chips with different power, in refractive index, or in surface roughness.

Figure 26A:
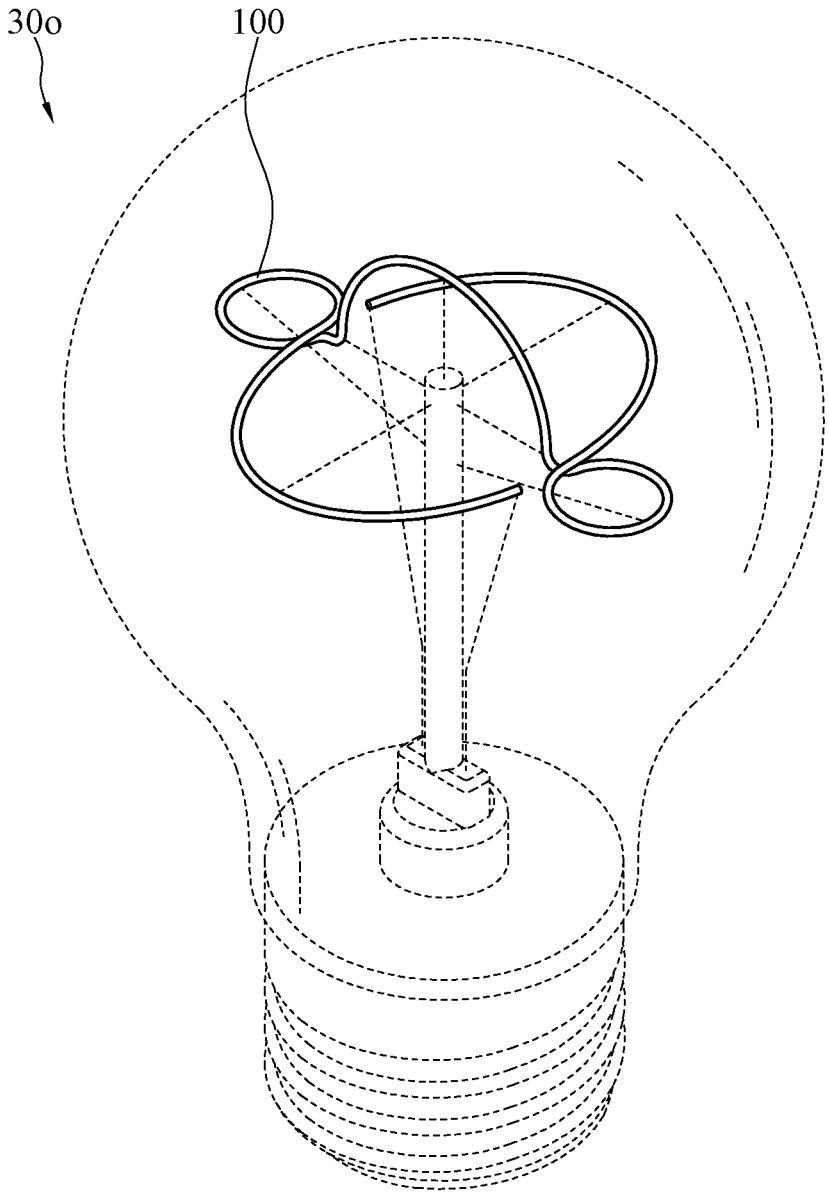
FIGS. 26A-26C are respectively a perspective view, a side view, and a top view of an LED light bulb according to an embodiment of the present invention.
Figure 26B:
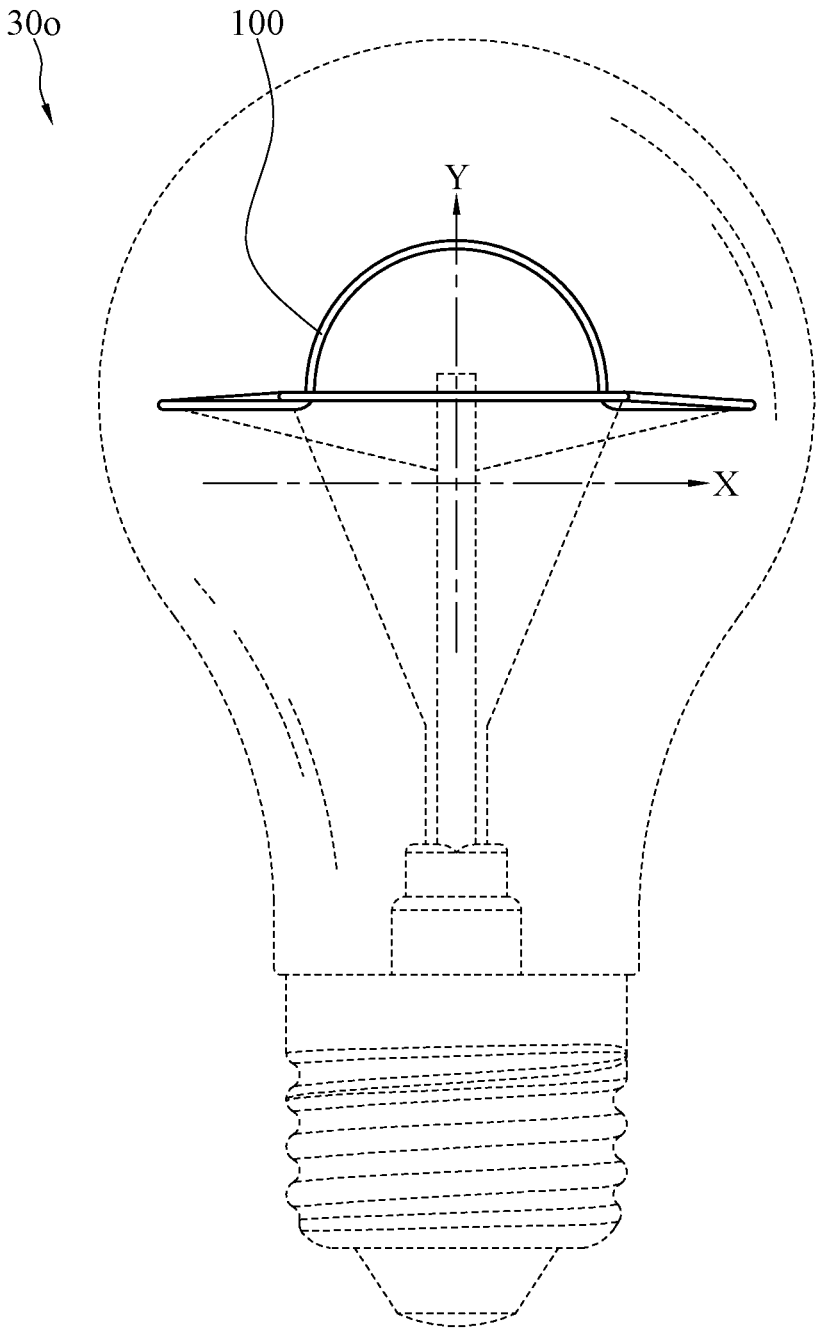
Figure 26C:
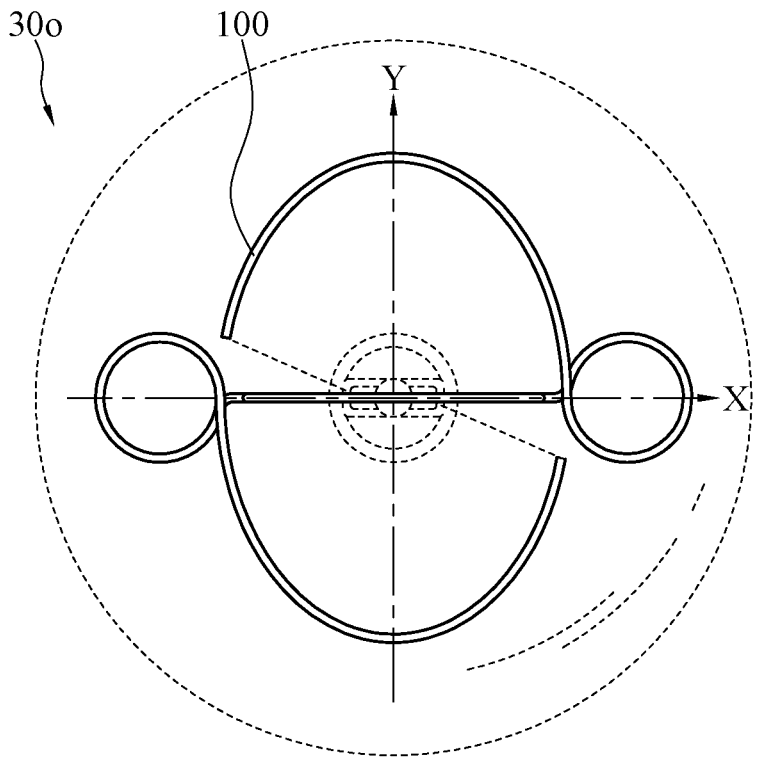

Please refer to FIGS. 26A-26C. FIGS. 26A-26C are respectively a perspective view, a side view, and a top view of an LED light bulb 30*o* according to an embodiment of the present invention. The LED light bulb 30*o* comprising an LED filament 100 is analogous to the discussed LED light bulbs in the above embodiments. A difference between the LED light bulb 30*o* and the discussed LED light bulbs is that the LED filament 100 of the LED light bulb 30*o* has a modified structure. Portions of the LED filament 100 presented in different quadrants in the side view or in the top view may be in line symmetry or in point symmetry in brightness while the LED filament 100 operates. As shown in FIG. 26B, the portions of the LED filament 100 presented in the first quadrant and the second quadrant may be in line symmetry with the Y-axis in the side view in structure, in length, in emitting direction, in arrangement of LED chips, in power configuration of LED chips with different power, in refractive index, or in surface roughness. As shown in FIG. 26C, the portions of the LED filament 100 presented in the four quadrants may be in point symmetry with the origin in the top view in structure, in length, in emitting direction, in arrangement of LED chips, in power configuration of LED chips with different power, in refractive index, or in surface roughness.

Figure 27A:
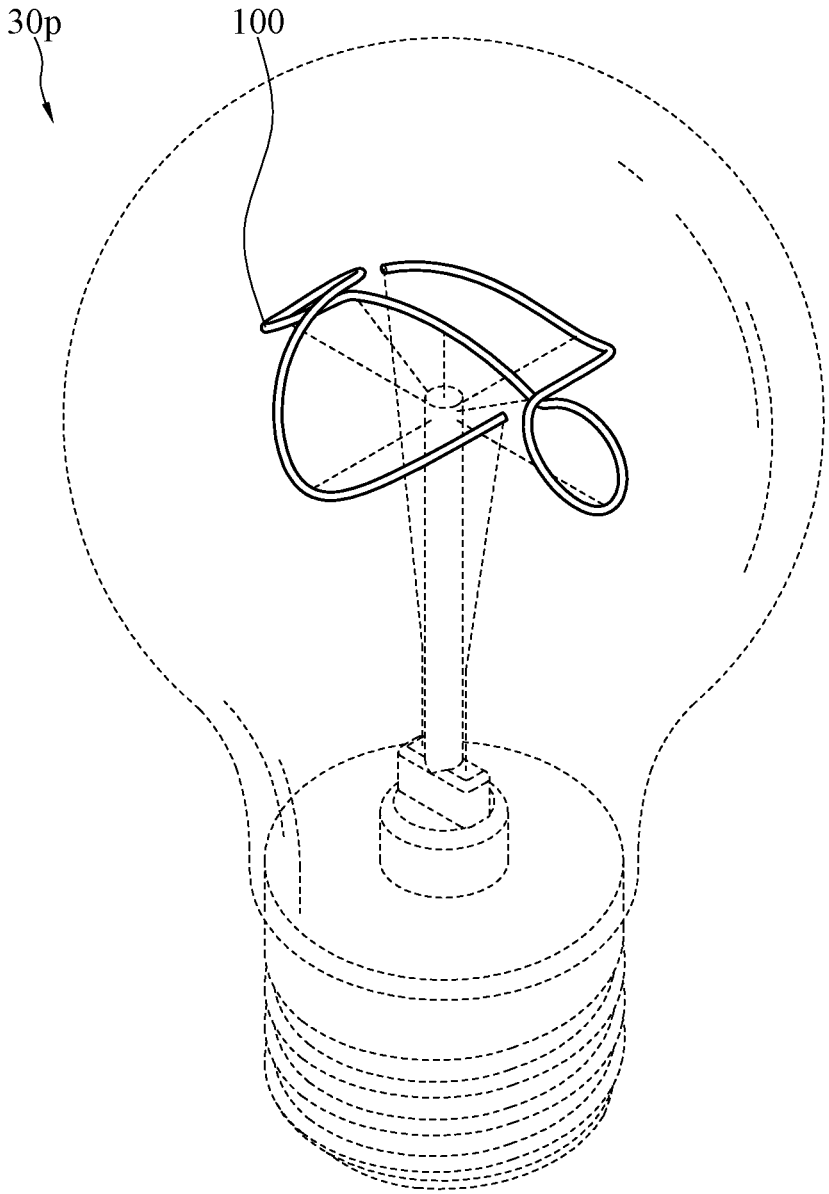
FIGS. 27A-27C are respectively a perspective view, a side view, and a top view of an LED light bulb according to an embodiment of the present invention.
Figure 27B:
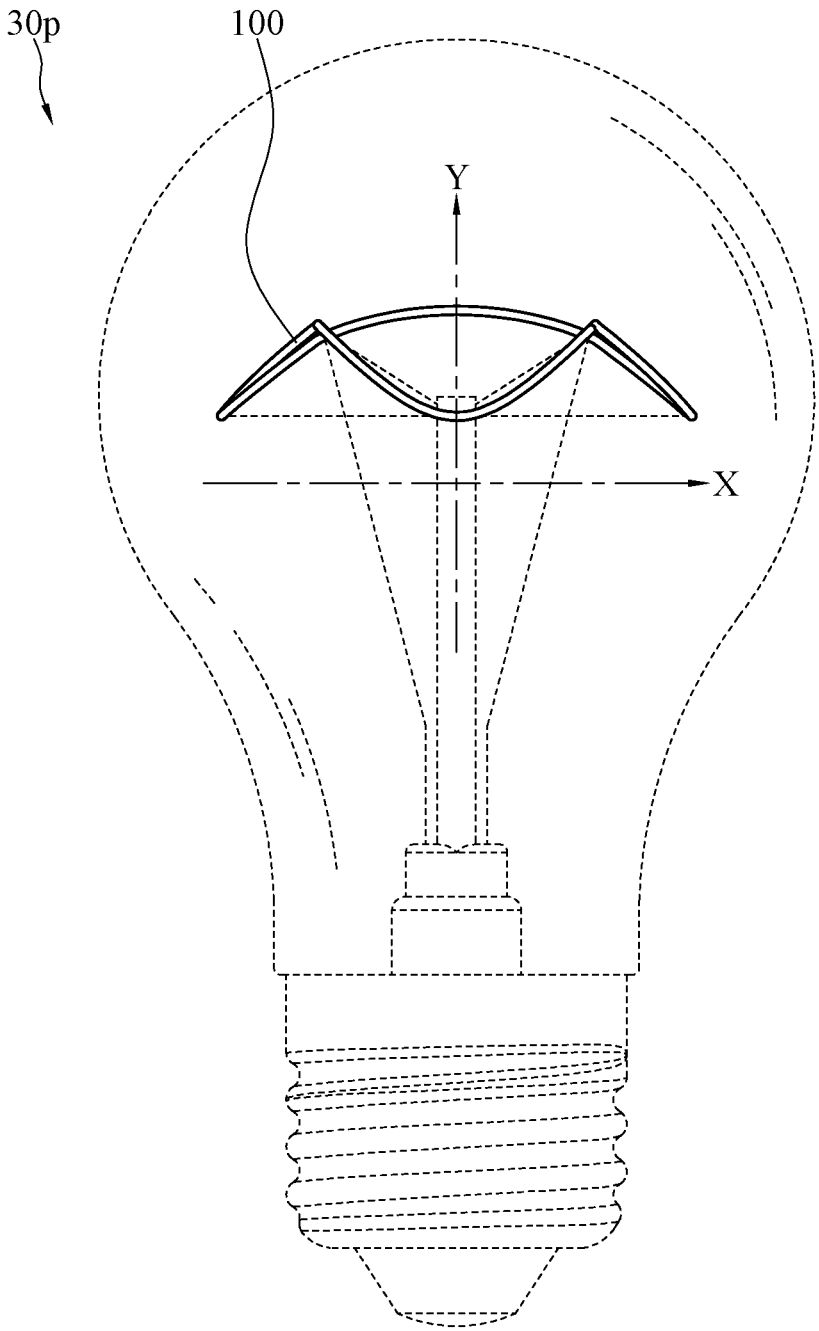
Figure 27C:
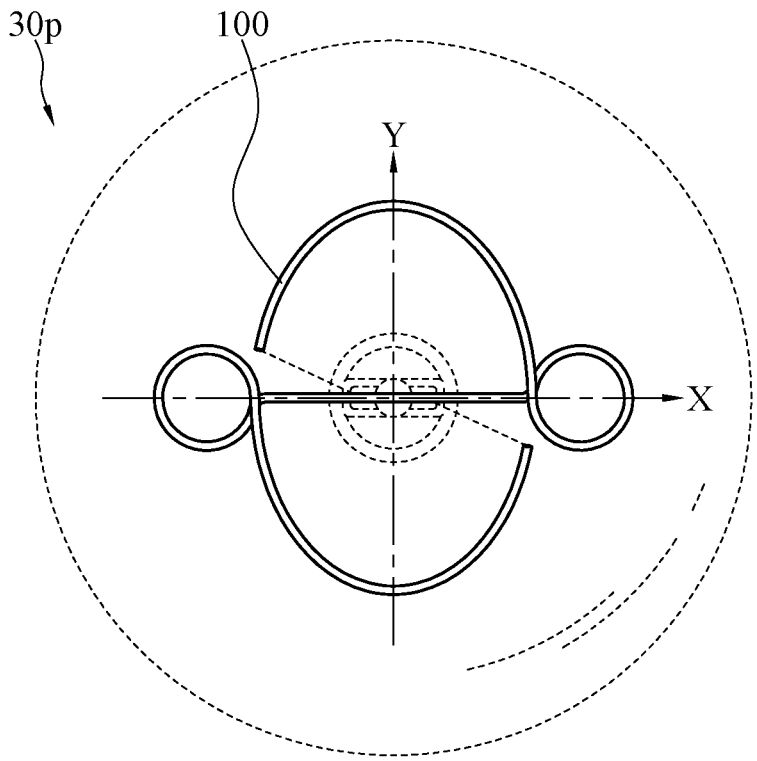

Please refer to FIGS. 27A-27C. FIGS. 27A-27C are respectively a perspective view, a side view, and a top view of an LED light bulb 30*p* according to an embodiment of the present invention. The LED light bulb 30*p* comprising an LED filament 100 is analogous to the discussed LED light bulbs in the above embodiments. A difference between the LED light bulb 30*p* and the discussed LED light bulbs is that the LED filament 100 of the LED light bulb 30*p* has a modified structure. Portions of the LED filament 100 presented in different quadrants in the side view or in the top view may be in line symmetry or in point symmetry in brightness while the LED filament 100 operates. As shown in FIG. 27B, the portions of the LED filament 100 presented in the first quadrant and the second quadrant may be in line symmetry with the Y-axis in the side view in structure, in length, in emitting direction, in arrangement of LED chips, in power configuration of LED chips with different power, in refractive index, or in surface roughness. As shown in FIG. 27C, the portions of the LED filament 100 presented in the four quadrants may be in point symmetry with the origin in the top view in structure, in length, in emitting direction, in arrangement of LED chips, in power configuration of LED chips with different power, in refractive index, or in surface roughness.

Figure 28A:
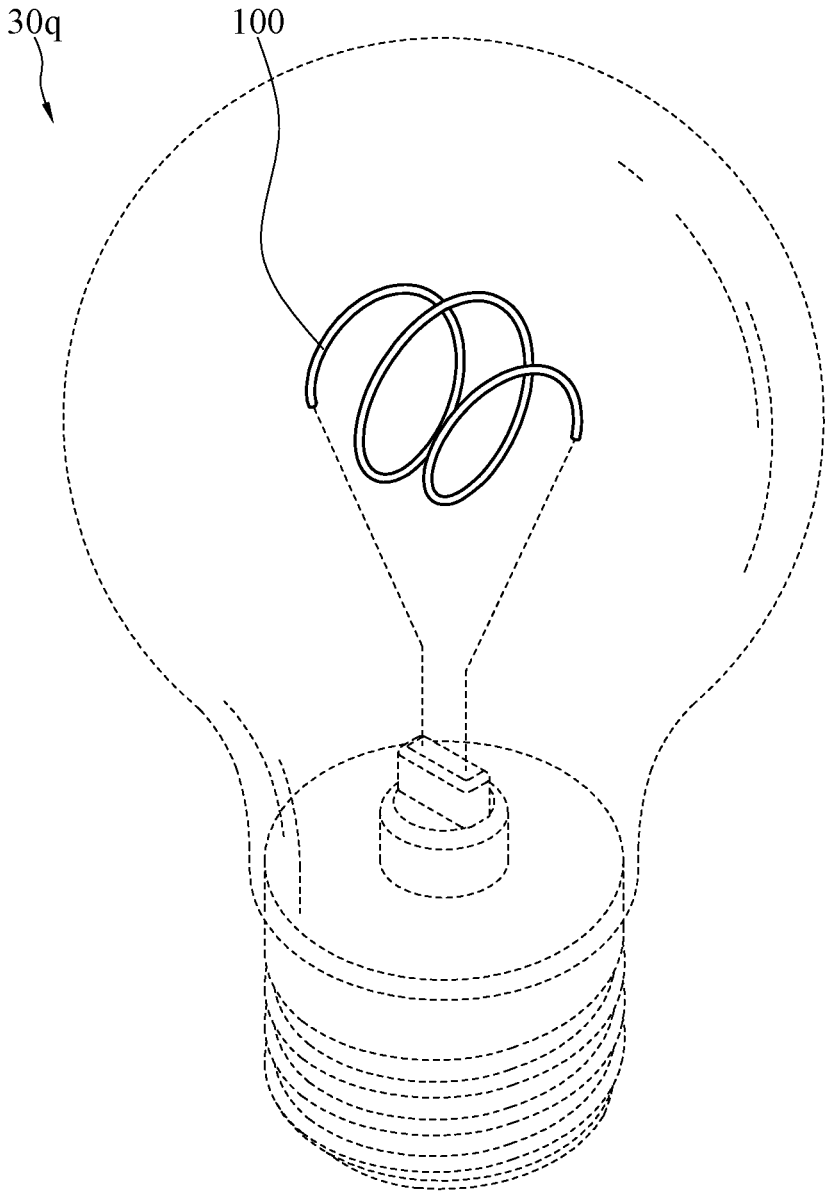
FIGS. 28A-28C are respectively a perspective view, a side view, and a top view of an LED light bulb according to an embodiment of the present invention.
Figure 28B:
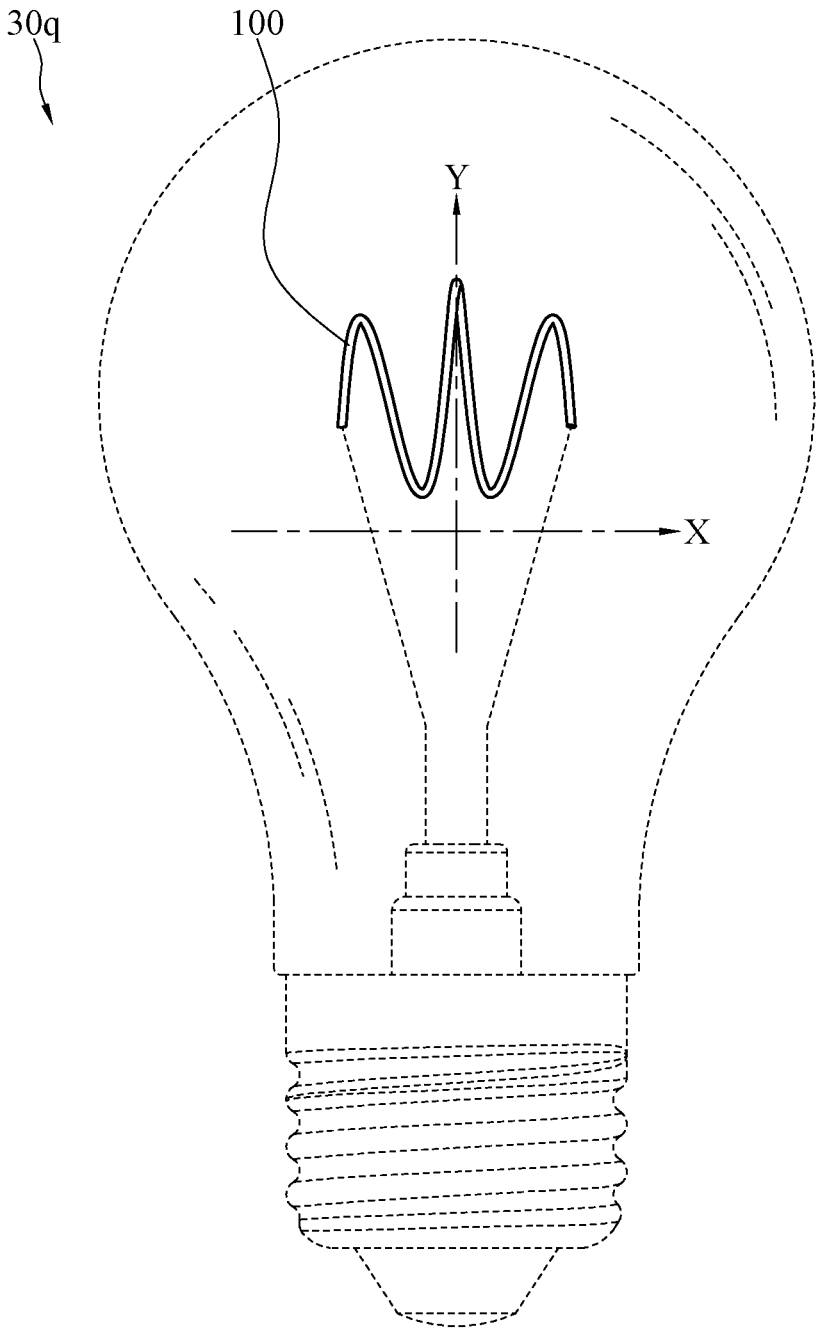
Figure 28C:
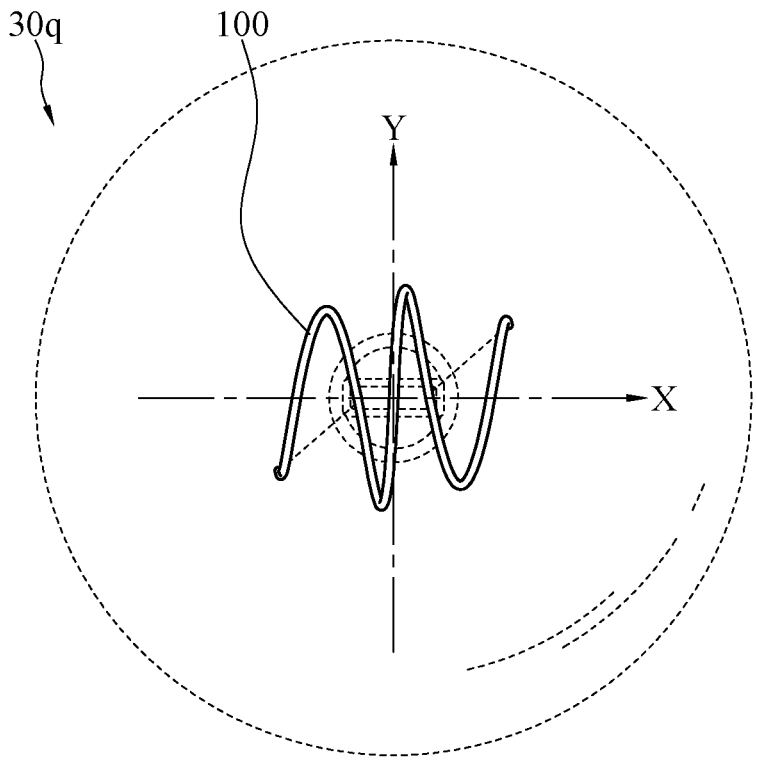

Please refer to FIGS. 28A-28C. FIGS. 28A-28C are respectively a perspective view, a side view, and a top view of an LED light bulb 30*q* according to an embodiment of the present invention. The LED light bulb 30*q* comprising an LED filament 100 is analogous to the discussed LED light bulbs in the above embodiments. A difference between the LED light bulb 30*q* and the discussed LED light bulbs is that the LED filament 100 of the LED light bulb 30*q* has a modified structure. Portions of the LED filament 100 presented in different quadrants in the side view or in the top view may be in line symmetry or in point symmetry in brightness while the LED filament 100 operates. As shown in FIG. 28B, the portions of the LED filament 100 presented in the first quadrant and the second quadrant may be in line symmetry with the Y-axis in the side view in structure, in length, in emitting direction, in arrangement of LED chips, in power configuration of LED chips with different power, in refractive index, or in surface roughness. As shown in FIG. 28C, the portions of the LED filament 100 presented in the four quadrants may be in point symmetry with the origin in the top view in structure, in length, in emitting direction, in arrangement of LED chips, in power configuration of LED chips with different power, in refractive index, or in surface roughness.

Figure 29A:
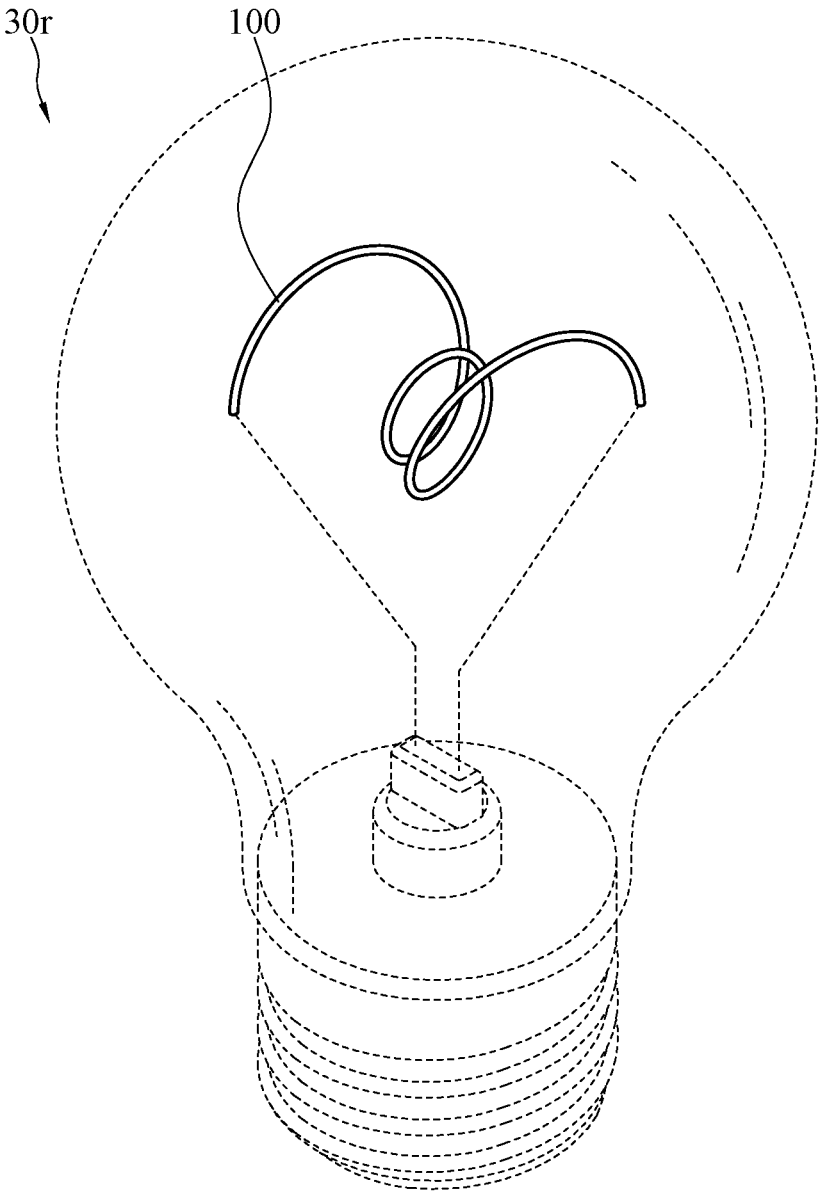
FIGS. 29A-29D are respectively a perspective view, a side view, another side view, and a top view of an LED light bulb according to an embodiment of the present invention.
Figure 29B:
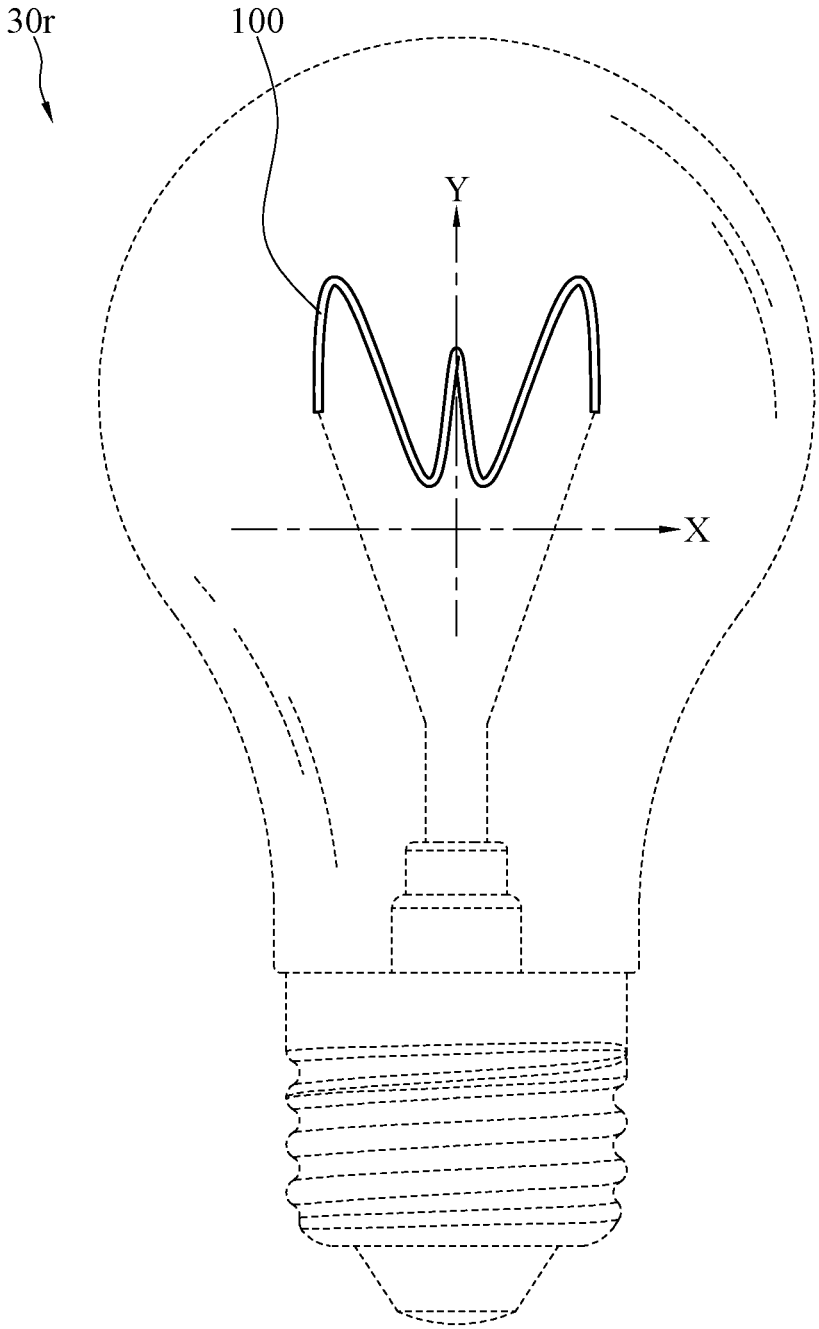
Figure 29C:
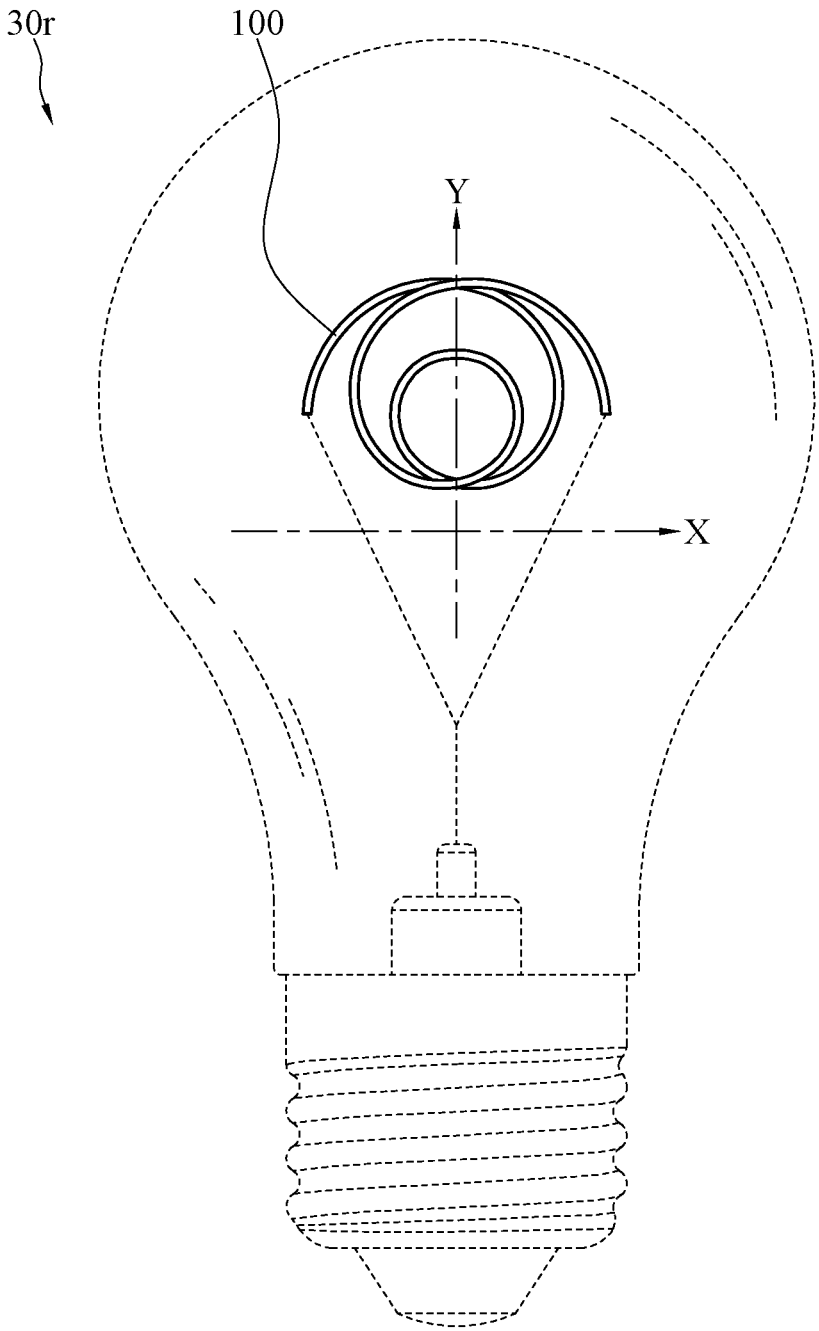

Please refer to FIGS. 29A-29D. FIGS. 29A-29D are respectively a perspective view, a side view (e.g., a front view), another side view (e.g., a lateral view), and a top view of an LED light bulb 30*r* according to an embodiment of the present invention. In the embodiment, FIG. 29B illustrates the front view, and FIG. 29C illustrates the lateral view. The lateral view is projected on a plane perpendicular to planes on which the front view and the top view are projected respectively. The LED light bulb 30*r* comprising an LED filament 100 is analogous to the discussed LED light bulbs in the above embodiments. A difference between the LED light bulb 30*r* and the discussed LED light bulbs is that the LED filament 100 of the LED light bulb 30*r* has a modified structure. Portions of the LED filament 100 presented in different quadrants in the side view or in the top view may be in line symmetry or in point symmetry in brightness while the LED filament 100 operates.

Figure 29D:
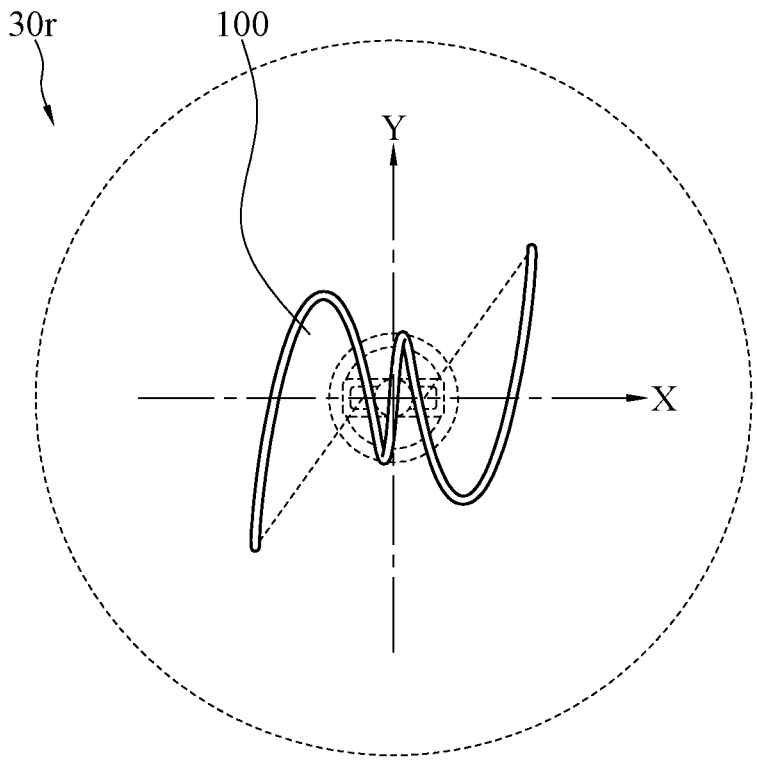

As shown in FIG. 29B, the portions of the LED filament 100 presented in the first quadrant and the second quadrant may be in line symmetry with the Y-axis in the side view in structure, in length, in emitting direction, in arrangement of LED chips, in power configuration of LED chips with different power, in refractive index, or in surface roughness. As shown in FIG. 29C, the portions of the LED filament 100 presented in the first quadrant and the second quadrant may be in line symmetry with the Y-axis in the another side view in structure, in length, in emitting direction, in arrangement of LED chips, in power configuration of LED chips with different power, in refractive index, or in surface roughness. As shown in FIG. 29D, the portions of the LED filament 100 presented in the four quadrants may be in point symmetry with the origin in the top view in structure, in length, in emitting direction, in arrangement of LED chips, in power configuration of LED chips with different power, in refractive index, or in surface roughness.

The definition of the omnidirectional light depends upon the area the LED light bulb is used and varies over time. According to different authority or countries, LED light bulbs alleged that can provide omnidirectional light may be required to comply with different standards. The definition of the omnidirectional light may be, but not limited to, the following example. Page 24 of Eligibility Criteria version 1.0 of US Energy Star Program Requirements for Lamps (Light Bulbs) defines omnidirectional lamp in base-up position requires that light emitted from the zone of 135 degree to 180 degree should be at least 5% of total flux (1 m), and 90% of the measured intensity values may vary by no more than 25% from the average of all measured values in all planes (luminous intensity (cd) is measured within each vertical plane at a 5 degree vertical angle increment (maximum) from 0 degree to 135 degree). JEL 801 of Japan regulates the flux from the zone within 120 degrees along the light axis should be not less than 70% of total flux of the bulb. Based upon the configuration of the LED filaments of the above embodiments which have the symmetry characteristic, the LED light bulbs with the LED filaments can comply with different standards of the omnidirectional lamps.

It should be understood that the above described embodiments are merely preferred embodiments of the invention, but not intended to limit the invention. Any modifications, equivalent alternations and improvements, or any direct and indirect applications in other related technical field that are made within the spirit and scope of the invention described in the specification and the figures should be included in the protection scope of the invention.

What is claimed is:

1. An LED light bulb, comprising:

a bulb shell;

a bulb base connected with the bulb shell;

two conductive supports disposed in the bulb shell;

a stem extending from the bulb base to inside of the bulb shell; and an LED filament comprising:

a plurality of LED chips arranged in an array along an elongated direction of the LED filament; and two conductive electrodes respectively disposed at two ends of the LED filament and connected to the LED chips, wherein the two conductive electrodes are respectively connected to the two conductive supports;

wherein the LED filament is curled to satisfy symmetry characteristics in which:

while a top view of the LED light bulb is presented in a two dimensional coordinate system defining four quadrants with a X-axis crossing the stem, a Y-axis crossing the stem, and an origin, a brightness presented by a portion of the LED filament in the first quadrant in the top view is symmetric to a brightness presented by a portion of the LED filament in the second quadrant in the top view with respect to the Y-axis and/or is symmetric to a brightness presented by a portion of the LED filament in the third quadrant in the top view with respect to the origin; and while a side view of the LED light bulb is presented in another two dimensional coordinate system defining four quadrants with a Y'-axis aligned with the stem, an X'-axis crossing the Y'-axis, and an origin, a brightness presented by a portion of the LED filament in the first quadrant in the side view is symmetric to a brightness presented by a portion of the LED filament in the second quadrant in the side view with respect to the Y'-axis.

2. The LED light bulb of claim 1, wherein a brightness presented by a portion of the LED filament in the third quadrant in the side view is symmetric to a brightness presented by a portion of the LED filament in the fourth quadrant in the side view with respect to the Y'-axis while the LED filament operates.

3. The LED light bulb of claim 1, wherein the brightness presented by the portion of the LED filament in the first quadrant in the side view is asymmetric to a brightness presented by a portion of the LED filament in the fourth quadrant in the side view with respect to the X'-axis while the LED filament operates.

4. The LED light bulb of claim 1, wherein the LED filament is in line symmetry in the side view, a structure of the portion of the LED filament in the first quadrant in the side view is symmetric to a structure of the portion of the LED filament in the second quadrant in the side view with respect to the Y'-axis, and a structure of a portion of the LED filament in the third quadrant in the side view is symmetric to a structure of a portion of the LED filament in the fourth quadrant in the side view with respect to the Y'-axis.

5. The LED light bulb of claim 4, wherein the structure of the portion of the LED filament in the first quadrant in the side view is asymmetric to the structure of the portion of the LED filament in the fourth quadrant in the side view, and the structure of the portion of the LED filament in the second quadrant in the side view is asymmetric to the structure of the portion of the LED filament in the third quadrant in the side view.

6. The LED light bulb of claim 4, wherein the portions of the LED filament in the first quadrant and the second quadrant in the side view respectively form a "V" shape, a reversed "V" shape, or a semicircle shape.

7. The LED light bulb of claim 1, wherein a length of the portion of the LED filament in the first quadrant in the side view is substantially equal to that of the portion of the LED filament in the second quadrant in the side view, and a length of the portion of the LED filament in the third quadrant in the side view is substantially equal to that of the portion of the LED filament in the fourth quadrant in the side view.

8. The LED light bulb of claim 1, wherein the LED filament is in line symmetry in the side view, an emitting direction of the portion of the LED filament in the first quadrant in the side view is symmetric to an emitting direction of the portion of the LED filament in the second quadrant in the side view with respect to the Y'-axis, and an emitting direction of a portion of the LED filament in the third quadrant in the side view is symmetric to an emitting direction of a portion of the LED filament in the fourth quadrant in the side view with respect to the Y'-axis.

9. The LED light bulb of claim 1, wherein the LED filament is in point symmetry in the side view, a structure of the portion of the LED filament in the first quadrant in the side view is symmetric to a structure of a portion of the LED filament in the third quadrant in the side view with respect to the origin, and a structure of the portion of the LED filament in the second quadrant in the side view is symmetric to a structure of a portion of the LED filament in the fourth quadrant in the side view with respect to the origin.

10. The LED light bulb of claim 9, wherein a length of the portion of the LED filament in the first quadrant in the side view is substantially equal to that of the portion of the LED filament in the third quadrant in the side view, and a length of the portion of the LED filament in the second quadrant in the side view is substantially equal to that of the portion of the LED filament in the fourth quadrant in the side view.

11. The LED light bulb of claim 9, wherein the LED filament elongates to form two helixes, the two helixes are arranged side by side and form an "S" shape in a plane view of the LED filament.

12. The LED light bulb of claim 1, wherein the LED filament is in line symmetry in the side view, an arrangement of LED chips in the portion of the LED filament in the first quadrant in the side view is symmetric to an arrangement of LED chips in the portion of the LED filament in the second quadrant in the side view with respect to the Y'-axis, and an arrangement of LED chips in a portion of the LED filament in the third quadrant in the side view is symmetric to an arrangement of LED chips in a portion of the LED filament in the fourth quadrant in the side view with respect to the Y'-axis.

13. The LED light bulb of claim 1, wherein the LED filament is in line symmetry in the side view, a power configuration of LED chips with different power in the portion of the LED filament in the first quadrant in the side view is symmetric to a power configuration of LED chips with different power in the portion of the LED filament in the second quadrant in the side view with respect to the Y'-axis, and a power configuration of LED chips with different power in a portion of the LED filament in the third quadrant in the side view is symmetric to a power configuration of LED chips with different power in a portion of the LED filament in the fourth quadrant in the side view with respect to the Y'-axis.

14. The LED light bulb of claim 1, wherein the LED filament is in line symmetry in the side view, refractive indexes of segments of the portion of the LED filament in the first quadrant in the side view is symmetric to refractive indexes of segments of the portion of the LED filament in the second quadrant in the side view with respect to the Y'-axis, and refractive indexes of segments of a portion of the LED filament in the third quadrant in the side view is symmetric to refractive indexes of segments of a portion of the LED filament in the fourth quadrant in the side view with respect to the Y'-axis.

15. The LED light bulb of claim 1, wherein the LED filament is in line symmetry in the side view, surface roughness of segments of the portion of the LED filament in the first quadrant in the side view is symmetric to surface roughness of segments of the portion of the LED filament in the second quadrant in the side view with respect to the Y'-axis, and surface roughness of segments of a portion of the LED filament in the third quadrant in the side view is symmetric to surface roughness of segments of a portion of the LED filament in the fourth quadrant in the side view with respect to the Y'-axis.

16. The LED light bulb of claim 1, wherein the LED filament is in point symmetry in the side view, an emitting direction of the portion of the LED filament in the first quadrant in the side view is symmetric to an emitting direction of a portion of the LED filament in the third quadrant in the side view with respect to the origin, and an emitting direction of the portion of the LED filament in the second quadrant in the side view is symmetric to an emitting direction of a portion of the LED filament in the fourth quadrant in the side view with respect to the origin.

17. The LED light bulb of claim 1, wherein the brightness presented by the portion of the LED filament in the third quadrant in the top view is symmetric to a brightness presented by a portion of the LED filament in the fourth quadrant in the top view with respect to the Y-axis while the LED filament operates.

18. The LED light bulb of claim 1, wherein a length of the portion of the LED filament in the first quadrant in the top view is substantially equal to that of the portion of the LED filament in the second quadrant in the top view, and a length of the portion of the LED filament in the third quadrant in the top view is substantially equal to that of a portion of the LED filament in the fourth quadrant in the top view.

19. The LED light bulb of claim 1, wherein the LED filament is in line symmetry in the top view, a structure of the portion of the LED filament in the first quadrant in the top view is symmetric to a structure of the portion of the LED filament in the second quadrant in the top view with respect to the Y-axis, and a structure of the portion of the LED filament in the third quadrant in the top view is symmetric to a structure of a portion of the LED filament in the fourth quadrant in the top view with respect to the Y-axis.

20. The LED light bulb of claim 19, wherein the structure of the portion of the LED filament in the first quadrant in the top view is further symmetric to the structure of the portion of the LED filament in the fourth quadrant in the top view with respect to the X-axis, and the structure of the portion of the LED filament in the second quadrant in the top view is further symmetric to the structure of the portion of the LED filament in the third quadrant in the top view with respect to the X-axis.

21. The LED light bulb of claim 19, wherein the portions of the LED filament in the first quadrant and the second quadrant in the top view respectively form an "L" shape, a reversed "L" shape, a circle shape, or a leaf shape.

22. The LED light bulb of claim 19, wherein the portions of the LED filament in the first quadrant, the second quadrant, the third quadrant, and the fourth quadrant in the top view jointly form an "X" shape or a four-leaf clover shape.

23. The LED light bulb of claim 1, wherein the LED filament is in point symmetry in the top view, a structure of the portion of the LED filament in the first quadrant in the top view is symmetric to a structure of the portion of the LED filament in the third quadrant in the top view with respect to the origin, and a structure of the portion of the LED filament in the second quadrant in the top view is symmetric to a structure of a portion of the LED filament in the fourth quadrant in the top view with respect to the origin.

24. The LED light bulb of claim 23, wherein a length of the portion of the LED filament in the first quadrant in the top view is substantially equal to that of the portion of the LED filament in the third quadrant in the top view, and a length of the portion of the LED filament in the second quadrant in the top view is substantially equal to that of the portion of the LED filament in the fourth quadrant in the top view.

25. The LED light bulb of claim 23, wherein the LED filament elongates to form two helixes, the two helixes are arranged side by side and form an "S" shape in a plane view of the LED filament.

26. The LED light bulb of claim 23, wherein the portions of the LED filament in the first quadrant, the second quadrant, the third quadrant, and the fourth quadrant in the top view jointly form an "X" shape or an infinity symbol shape.

27. The LED light bulb of claim 1, wherein the LED filament is in line symmetry in the top view, an emitting direction of the portion of the LED filament in the first quadrant in the top view is symmetric to an emitting direction of the portion of the LED filament in the second quadrant in the top view with respect to the Y-axis, and an emitting direction of the portion of the LED filament in the third quadrant in the top view is symmetric to an emitting direction of a portion of the LED filament in the fourth quadrant in the top view with respect to the Y-axis.

28. The LED light bulb of claim 1, wherein the LED filament is in line symmetry in the top view, an arrangement of LED chips in the portion of the LED filament in the first quadrant in the top view is symmetric to an arrangement of LED chips in the portion of the LED filament in the second quadrant in the top view with respect to the Y-axis, and an arrangement of LED chips in the portion of the LED filament in the third quadrant in the top view is symmetric to an arrangement of LED chips in a portion of the LED filament in the fourth quadrant in the top view with respect to the Y-axis.

29. The LED light bulb of claim 1, wherein the LED filament is in line symmetry in the top view, a power configuration of LED chips with different power in the portion of the LED filament in the first quadrant in the top view is symmetric to a power configuration of LED chips with different power in the portion of the LED filament in the second quadrant in the top view with respect to the Y-axis, and a power configuration of LED chips with different power in the portion of the LED filament in the third quadrant in the top view is symmetric to a power configuration of LED chips with different power in a portion of the LED filament in the fourth quadrant in the top view with respect to the Y-axis.

30. The LED light bulb of claim 1, wherein the LED filament is in line symmetry in the top view, refractive indexes of segments of the portion of the LED filament in the first quadrant in the top view is symmetric to refractive indexes of segments of the portion of the LED filament in the second quadrant in the top view with respect to the Y-axis, and refractive indexes of segments of the portion of the LED filament in the third quadrant in the top view is symmetric to refractive indexes of segments of a portion of the LED filament in the fourth quadrant in the top view with respect to the Y-axis.

31. The LED light bulb of claim 1, wherein the LED filament is in line symmetry in the top view, surface roughness of segments of the portion of the LED filament in the first quadrant in the top view is symmetric to surface roughness of segments of the portion of the LED filament in the second quadrant in the top view with respect to the Y-axis, and surface roughness of segments of the portion of the LED filament in the third quadrant in the top view is symmetric to surface roughness of segments of a portion of the LED filament in the fourth quadrant in the top view with respect to the Y-axis.

32. The LED light bulb of claim 1, wherein the LED filament is in point symmetry in the top view, an emitting direction of the portion of the LED filament in the first quadrant in the top view is symmetric to an emitting direction of the portion of the LED filament in the third quadrant in the top view with respect to the origin, and an emitting direction of the portion of the LED filament in the second quadrant in the top view is symmetric to an emitting direction of a portion of the LED filament in the fourth quadrant in the top view with respect to the origin.

33. The LED light bulb of claim 1, wherein the LED filament comprises a main lighting face, the LED chips face the main lighting face, and an emitting direction of the LED filament is aligned with a normal direction of the main lighting face.

34. The LED light bulb of claim 33, wherein the main lighting face of the LED filament is towards the bulb shell or the bulb base and is away from the stem.

35. The LED light bulb of claim 33, further comprising a supporting arm, wherein an end of the supporting arm is connected to the stem and another end of the supporting arm clamps the LED filament and has the main lighting face oriented.

36. An LED light bulb, comprising:

a bulb shell;

a bulb base connected with the bulb shell;

two conductive supports disposed in the bulb shell;

a stem extending from the bulb base to inside of the bulb shell; and an LED filament comprising:

a plurality of LED chips arranged in an array along an elongated direction of the LED filament; and two conductive electrodes respectively disposed at two ends of the LED filament and connected to the LED chips, wherein the two conductive electrodes are respectively connected to the two conductive supports;

wherein the LED filament is curled to satisfy symmetry characteristics in which:

while a top view of the LED light bulb is presented in a two dimensional coordinate system defining four quadrants with a X-axis crossing the stem, a Y-axis crossing the stem, and an origin, a structure of a portion of the LED filament in the first quadrant in the top view is symmetric to a structure of a portion of the LED filament in the second quadrant in the top view with respect to the Y-axis and/or is symmetric to a structure of a portion of the LED filament in the third quadrant in the top view with respect to the origin; and while a side view of the LED light bulb is presented in another two dimensional coordinate system defining four quadrants with a Y'-axis aligned with the stem, an X'-axis crossing the Y'-axis, and an origin, a structure of a portion of the LED filament in the first quadrant in the side view is symmetric to a structure of a portion of the LED filament in the second quadrant in the side view with respect to the Y'-axis.

37. The LED light bulb of claim 36, wherein the LED filament is in line symmetry in the side view, a structure of a portion of the LED filament in the third quadrant in the side view is symmetric to a structure of a portion of the LED filament in the fourth quadrant in the side view with respect to the Y'-axis.

38. The LED light bulb of claim 37, wherein the structure of the portion of the LED filament in the first quadrant in the side view is asymmetric to the structure of the portion of the LED filament in the fourth quadrant in the side view, and the structure of the portion of the LED filament in the second quadrant in the side view is asymmetric to the structure of the portion of the LED filament in the third quadrant in the side view.

39. The LED light bulb of claim 36, wherein the LED filament is in line symmetry in the top view, the structure of the portion of the LED filament in the third quadrant in the top view is symmetric to a structure of a portion of the LED filament in the fourth quadrant in the top view with respect to the Y-axis.

40. The LED light bulb of claim 39, wherein the structure of the portion of the LED filament in the first quadrant in the top view is further symmetric to the structure of the portion of the LED filament in the fourth quadrant in the top view with respect to the X-axis, and the structure of the portion of the LED filament in the second quadrant in the top view is further symmetric to the structure of the portion of the LED filament in the third quadrant in the top view with respect to the X-axis.

41. The LED light bulb of claim 36, wherein the LED filament is in point symmetry in the top view, the structure of the portion of the LED filament in the second quadrant in the top view is symmetric to a structure of a portion of the LED filament in the fourth quadrant in the top view with respect to the origin.

42. An LED light bulb, comprising:

a bulb shell;

a bulb base connected with the bulb shell;

two conductive supports disposed in the bulb shell;

a stem extending from the bulb base to inside of the bulb shell; and an LED filament comprising:

a plurality of LED chips arranged in an array along an elongated direction of the LED filament; and two conductive electrodes respectively disposed at two ends of the LED filament and connected to the LED chips, wherein the two conductive electrodes are respectively connected to the two conductive supports;

wherein the LED filament is curled to satisfy symmetry characteristics in which:

while a top view of the LED light bulb is presented in a two dimensional coordinate system defining four quadrants with a X-axis crossing the stem, Y-axis crossing the stem, and an origin, a length of a portion of the LED filament in the first quadrant in the top view is substantially equal to that of a portion of the LED filament in the second quadrant in the top view and/or is substantially equal to that of a portion of the LED filament in the third quadrant in the top view; and while a side view of the LED light bulb is presented in another two dimensional coordinate system defining four quadrants with a Y'-axis aligned with the stem, an X'-axis crossing the Y'-axis, and an origin, a length of a portion of the LED filament in the first quadrant in the side view is substantially equal to that of a portion of the LED filament in the second quadrant in the side view.

43. The LED light bulb of claim 42, wherein a length of a portion of the LED filament in the third quadrant in the side view is substantially equal to that of a portion of the LED filament in the fourth quadrant in the side view.

44. The LED light bulb of claim 42, wherein the length of the portion of the LED filament in the third quadrant in the top view is substantially equal to that of a portion of the LED filament in the fourth quadrant in the top view.

45. The LED light bulb of claim 42, wherein the length of the portion of the LED filament in the second quadrant in the top view is substantially equal to that of a portion of the LED filament in the fourth quadrant in the top view.

* * * * *